US009226633B2

(12) United States Patent
Conrad et al.

(10) Patent No.: US 9,226,633 B2
(45) **Date of Patent: *Jan. 5, 2016**

(54) SURFACE CLEANING APPARATUS

(71) Applicant: OMACHRON INTELLECTUAL PROPERTY INC., Hampton, CA (US)

(72) Inventors: Wayne Ernest Conrad, Hampton, CA (US); Jason Boyd Thorne, Wellesley, MA (US)

(73) Assignee: Omachron Intellectual Property Inc., Hampton, Ontario ( * ) Notice: Subject to any disclaimer, the term of this patent is extended or adjusted under 35 U.S.C. 154(b) by 0 days.

This patent is subject to a terminal disclaimer.

(21) Appl. No.: 14/298,240

(22) Filed: Jun. 6, 2014

(65) Prior Publication Data

US 2015/0000069 A1 Jan. 1, 2015

Related U.S. Application Data

(60) Continuation-in-part of application No. 13/781,441, filed on Feb. 28, 2013, and a continuation-in-part of application No. 13/541,745, filed on Jul. 4, 2012, which is a division of application No. 12/720,570, filed on Mar. 9, 2010, now Pat. No. 9,138,114.

(30) Foreign Application Priority Data

| | | |
|---|---|---|
| Mar. 13, 2009 | (CA) | 2658402 |
| Jul. 28, 2009 | (CA) | 2674056 |
| Sep. 8, 2009 | (CA) | 2678220 |

(51) Int. Cl.
*A47L 9/20* (2006.01)
*A47L 9/28* (2006.01)

(Continued)

(52) U.S. Cl.
CPC ..... *A47L 9/2857* (2013.01); *A47L 5/225* (2013.01); *A47L 5/24* (2013.01); *A47L 5/32* (2013.01);

(Continued)

(58) Field of Classification Search
USPC ..... 15/347, 350, 352, 353
See application file for complete search history.

(56) References Cited

U.S. PATENT DOCUMENTS

| | | | |
|---|---|---|---|
| 1,759,947 | A | 5/1930 | Lee |
| 2,071,975 | A | 2/1937 | Ruscoe |

(Continued)

FOREIGN PATENT DOCUMENTS

| | | | |
|---|---|---|---|
| CA | 1218962 | A1 | 3/1987 |
| CA | 2423405 | C | 10/2006 |

(Continued)

OTHER PUBLICATIONS

International Preliminary Report on Patentability, dated Sep. 16, 2008 for International application No. PCT/CA2007/000380.

(Continued)

*Primary Examiner* — Lee D Wilson
*Assistant Examiner* — Shantese McDonald
(74) *Attorney, Agent, or Firm* — Philip C. Mendes da Costa; Bereskin & Parr LLP/S.E.N.C.R.L., s.r.l.

(57) ABSTRACT

A vacuum cleaner is provided with a handle assembly drivingly connected to the surface cleaning head and a main power control and a brush control controllingly coupled to the brush motor is provided on the handle assembly. An surface cleaning apparatus is also provided that includes an air flow path extending from the cleaning head air outlet to the air treatment member air inlet and comprising a flexible electrified air flow conduit and a handle assembly drivingly connected to the surface cleaning head with a light source disposed on the handle assembly.

22 Claims, 39 Drawing Sheets

(51) Int. Cl.

| | |
|---|---|
| ***A47L 9/30*** | (2006.01) |
| ***A47L 5/22*** | (2006.01) |
| ***A47L 5/24*** | (2006.01) |
| ***A47L 5/32*** | (2006.01) |
| ***A47L 9/00*** | (2006.01) |
| ***A47L 9/02*** | (2006.01) |
| ***A47L 9/12*** | (2006.01) |
| ***A47L 9/16*** | (2006.01) |
| ***A47L 9/22*** | (2006.01) |
| ***A47L 9/24*** | (2006.01) |
| ***A47L 9/32*** | (2006.01) |

(52) U.S. Cl.

CPC ..... *A47L 9/0081* (2013.01); *A47L 9/02* (2013.01); *A47L 9/122* (2013.01); *A47L 9/16* (2013.01); *A47L 9/1691* (2013.01); *A47L 9/22* (2013.01); *A47L 9/246* (2013.01); *A47L 9/248* (2013.01); *A47L 9/30* (2013.01); *A47L 9/325* (2013.01)

(56) References Cited

U.S. PATENT DOCUMENTS

| | | | | |
|---|---|---|---|---|
| 2,072,690 | A | | 3/1937 | Smellie |
| 2,210,950 | A | | 8/1940 | Replogle |
| 2,542,634 | A | | 2/1951 | Davis et al. |
| 2,632,524 | A | | 3/1953 | Senne |
| 2,890,264 | A | | 6/1959 | Duff |
| 2,913,111 | A | | 11/1959 | Rogers |
| 2,927,625 | A | | 3/1960 | Rothermel et al. |
| 2,942,691 | A | | 6/1960 | Dillon |
| 2,954,802 | A | | 10/1960 | Duff |
| 2,963,750 | A | | 12/1960 | Pavlic |
| 2,998,474 | A | | 8/1961 | Pavlic |
| 2,993,223 | A | | 2/1962 | Gerber |
| 3,080,891 | A | | 3/1963 | Duff |
| 3,130,157 | A | | 4/1964 | Kelsall et al. |
| 3,200,568 | A | | 8/1965 | McNeil |
| 3,310,828 | A | | 3/1967 | Clark |
| 3,320,727 | A | | 5/1967 | Farley Forney E et al. |
| 3,356,334 | A | | 12/1967 | Scaramucci Domer |
| 3,486,532 | A | | 12/1969 | Sawada |
| 3,530,649 | A | | 9/1970 | Porsch et al. |
| 3,582,616 | A | | 6/1971 | Wrob |
| 3,822,533 | A | | 7/1974 | Oranje |
| 3,898,068 | A | | 8/1975 | McNeil |
| 3,988,132 | A | | 10/1976 | Oranje |
| 3,988,133 | A | | 10/1976 | Schady |
| 4,187,088 | A | | 2/1980 | Hodgson |
| 4,230,899 | A | | 10/1980 | Kanao |
| 4,236,903 | A | | 12/1980 | Malmsten |
| 4,354,051 | A | | 10/1982 | Kutnyak |
| 4,373,228 | A | | 2/1983 | Dyson |
| 4,393,536 | A | | 7/1983 | Tapp |
| 4,443,910 | A | | 4/1984 | Fitzwater |
| 4,489,759 | A | | 12/1984 | Yamamura |
| 4,573,236 | A | | 3/1986 | Dyson |
| 4,635,315 | A | | 1/1987 | Kozak |
| 4,660,246 | A | | 4/1987 | Duncan et al. |
| 4,693,324 | A | | 9/1987 | Choiniere et al. |
| 4,826,515 | A | | 5/1989 | Dyson |
| 4,831,685 | A | | 5/1989 | Bosyj et al. |
| 5,054,157 | A | | 10/1991 | Werner et al. |
| 5,078,761 | A | | 1/1992 | Dyson |
| 5,129,125 | A | | 7/1992 | Gamou et al. |
| 5,230,722 | A | | 7/1993 | Yonkers |
| 5,287,591 | A | | 2/1994 | Rench et al. |
| 5,309,600 | A | | 5/1994 | Weaver et al. |
| 5,309,601 | A | | 5/1994 | Hampton et al. |
| 5,416,270 | A | | 5/1995 | Kanao |
| 5,524,321 | A | | 6/1996 | Weaver et al. |
| 5,555,915 | A | | 9/1996 | Kanao |
| 5,715,566 | A | | 2/1998 | Weaver et al. |
| 5,836,047 | A | | 11/1998 | Lee et al. |
| 5,842,254 | A | | 12/1998 | Lee |
| 5,858,038 | A | | 1/1999 | Dyson et al. |
| 5,927,758 | A | | 7/1999 | Carlsson |
| 5,996,175 | A | | 12/1999 | Fusco |
| 6,024,132 | A | | 2/2000 | Fujimoto |
| 6,032,321 | A | | 3/2000 | Shirey et al. |
| 6,058,559 | A | | 5/2000 | Yoshimi et al. |
| 6,070,291 | A | | 6/2000 | Bair et al. |
| 6,079,080 | A | * | 6/2000 | Rutter et al. ..... 15/410 |
| 6,081,961 | A | | 7/2000 | Wang |
| 6,094,775 | A | | 8/2000 | Behmer |
| 6,103,971 | A | | 8/2000 | Sato et al. |
| 6,122,796 | A | | 9/2000 | Downham et al. |
| 6,155,620 | A | | 12/2000 | Armstrong |
| 6,209,925 | B1 | | 4/2001 | Edin |
| 6,210,469 | B1 | | 4/2001 | Tokar |
| 6,221,134 | B1 | | 4/2001 | Conrad et al. |
| 6,228,260 | B1 | | 5/2001 | Conrad et al. |
| 6,231,645 | B1 | | 5/2001 | Conrad et al. |
| 6,243,916 | B1 | | 6/2001 | Embree et al. |
| 6,251,296 | B1 | | 6/2001 | Conrad et al. |
| 6,289,553 | B1 | | 9/2001 | Dyson |
| 6,295,692 | B1 | | 10/2001 | Shideler |
| 6,317,920 | B1 | | 11/2001 | Brickner et al. |
| 6,323,570 | B1 | | 11/2001 | Nishimura et al. |
| 6,334,234 | B1 | | 1/2002 | Conrad et al. |
| 6,374,453 | B1 | | 4/2002 | Kim |
| 6,406,505 | B1 | | 6/2002 | Oh et al. |
| 6,440,197 | B1 | | 8/2002 | Conrad et al. |
| 6,463,622 | B2 | | 10/2002 | Wright et al. |
| 6,497,001 | B2 | | 12/2002 | Di Nunzio et al. |
| 6,531,066 | B1 | | 3/2003 | Saunders et al. |
| 6,532,621 | B2 | | 3/2003 | Stephens |
| 6,553,612 | B1 | | 4/2003 | Dyson et al. |
| 6,560,818 | B1 | | 5/2003 | Hasko |
| 6,561,549 | B1 | | 5/2003 | Moris et al. |
| 6,574,831 | B2 | | 6/2003 | Hunter et al. |
| 6,581,239 | B1 | | 6/2003 | Dyson et al. |
| 6,581,974 | B1 | | 6/2003 | Ragner et al. |
| 6,599,338 | B2 | | 7/2003 | Oh et al. |
| 6,623,539 | B2 | | 9/2003 | Lee et al. |
| 6,695,352 | B2 | | 2/2004 | Park et al. |
| 6,735,818 | B2 | | 5/2004 | Hamada |
| 6,736,873 | B2 | | 5/2004 | Conrad et al. |
| 6,746,500 | B1 | | 6/2004 | Park et al. |
| 6,766,559 | B2 | | 7/2004 | Roney et al. |
| 6,779,229 | B2 | | 8/2004 | Lee et al. |
| 6,782,583 | B2 | | 8/2004 | Oh |
| 6,782,585 | B1 | | 8/2004 | Conrad et al. |
| 6,807,708 | B2 | | 10/2004 | Roney et al. |
| 6,833,015 | B2 | | 12/2004 | Oh et al. |
| 6,839,934 | B2 | | 1/2005 | Houghton et al. |
| 6,848,146 | B2 | | 2/2005 | Wright et al. |
| 6,860,799 | B2 | | 3/2005 | Loveless |
| 6,874,197 | B1 | | 4/2005 | Conrad |
| 6,902,596 | B2 | | 6/2005 | Conrad et al. |
| 6,941,615 | B2 | | 9/2005 | Shanor et al. |
| 6,948,212 | B2 | | 9/2005 | Oh et al. |
| 6,961,975 | B2 | | 11/2005 | Park et al. |
| 7,014,671 | B2 | | 3/2006 | Oh |
| 7,048,804 | B2 | | 5/2006 | Kisela et al. |
| 7,055,204 | B2 | | 6/2006 | Ajhuni |
| D532,944 | S | | 11/2006 | Choi |
| 7,131,165 | B2 | | 11/2006 | Wright et al. |
| 7,137,169 | B2 | | 11/2006 | Murphy et al. |
| 7,140,068 | B1 | | 11/2006 | Baan et al. |
| 7,146,681 | B2 | | 12/2006 | Wright et al. |
| D535,070 | S | | 1/2007 | Shin |
| 7,156,127 | B2 | | 1/2007 | Moulton et al. |
| 7,159,271 | B2 | | 1/2007 | Sepke et al. |
| 7,159,274 | B2 | | 1/2007 | Freidell |
| 7,160,346 | B2 | | 1/2007 | Park |
| 7,188,388 | B2 | | 3/2007 | Best et al. |
| 7,222,393 | B2 | | 5/2007 | Kaffenberger et al. |
| 7,281,298 | B2 | | 10/2007 | Joung et al. |
| 7,293,322 | B2 | | 11/2007 | Matousek et al. |
| 7,350,266 | B2 | | 4/2008 | Park et al. |
| 7,356,874 | B2 | | 4/2008 | Macleod et al. |
| 7,360,274 | B2 | | 4/2008 | Park et al. |

(56) References Cited

U.S. PATENT DOCUMENTS

| | | | |
|---|---|---|---|
| 7,377,007 | B2 | 5/2008 | Best |
| 7,377,008 | B2 | 5/2008 | Park et al. |
| 7,381,234 | B2 | 6/2008 | Oh |
| 7,383,609 | B2 | 6/2008 | Ji |
| 7,386,916 | B2 | 6/2008 | Bone |
| 7,448,363 | B1 | 11/2008 | Rasmussen et al. |
| 7,485,164 | B2 | 2/2009 | Jeong et al. |
| 7,496,984 | B2 | 3/2009 | Pang |
| 7,547,338 | B2 | 6/2009 | Kim et al. |
| 7,581,286 | B2 | 9/2009 | Choi |
| 7,584,522 | B1 | 9/2009 | Weeter et al. |
| 7,594,296 | B2 | 9/2009 | Park |
| 7,604,675 | B2 | 10/2009 | Makarov et al. |
| 7,624,475 | B2 | 12/2009 | Choi |
| 7,645,311 | B2 | 1/2010 | Oh et al. |
| 7,686,858 | B2 | 3/2010 | Oh |
| 7,735,523 | B2 | 6/2010 | Smith et al. |
| 7,832,050 | B2 | 11/2010 | Pullins et al. |
| 7,882,592 | B2 | 2/2011 | Hwang et al. |
| 7,887,612 | B2 | 2/2011 | Conrad |
| 7,922,794 | B2 | 4/2011 | Morphey |
| 7,979,953 | B2 | 7/2011 | Yoo |
| 8,032,981 | B2 | 10/2011 | Yoo |
| 8,032,983 | B2 | 10/2011 | Griffith et al. |
| 8,127,398 | B2 | 3/2012 | Conrad |
| 8,166,607 | B2 | 5/2012 | Conrad |
| 8,191,203 | B2 | 6/2012 | Yoo |
| 8,468,646 | B2 | 6/2013 | Yoo |
| 8,484,799 | B2 | 7/2013 | Conrad |
| 8,528,160 | B2 | 9/2013 | Conrad |
| 8,650,709 | B2 | 2/2014 | McLeod et al. |
| 8,671,151 | B2 | 3/2014 | Joshi et al. |
| 8,671,517 | B2 | 3/2014 | Ventress et al. |
| 8,959,708 | B2 | 2/2015 | Ventress et al. |
| 2002/0011053 | A1 | 1/2002 | Oh |
| 2002/0062531 | A1 | 5/2002 | Oh |
| 2002/0078519 | A1 | 6/2002 | Boothby |
| 2002/0101075 | A1 | 8/2002 | Park et al. |
| 2002/0134059 | A1 | 9/2002 | Oh |
| 2002/0162188 | A1 | 11/2002 | Harmen |
| 2002/0178535 | A1 | 12/2002 | Oh et al. |
| 2002/0178698 | A1 | 12/2002 | Oh et al. |
| 2002/0178699 | A1 | 12/2002 | Oh |
| 2003/0046910 | A1 | 3/2003 | Lee |
| 2003/0066273 | A1 | 4/2003 | Choi et al. |
| 2003/0098084 | A1 | 5/2003 | Ragner et al. |
| 2003/0131441 | A1 | 7/2003 | Murphy et al. |
| 2003/0158238 | A1 | 8/2003 | Hale et al. |
| 2003/0159411 | A1 | 8/2003 | Hansen et al. |
| 2003/0163891 | A1 | 9/2003 | Nagai et al. |
| 2004/0010885 | A1 | 1/2004 | Hitzelberger et al. |
| 2004/0025285 | A1 | 2/2004 | McCormick et al. |
| 2004/0060144 | A1 | 4/2004 | Bowden et al. |
| 2004/0163201 | A1 | 8/2004 | Murphy et al. |
| 2004/0216263 | A1 | 11/2004 | Best et al. |
| 2004/0250376 | A1 | 12/2004 | Hori et al. |
| 2004/0255426 | A1 | 12/2004 | Davis et al. |
| 2005/0081326 | A1 | 4/2005 | Jeon |
| 2005/0115017 | A1 | 6/2005 | Kim |
| 2005/0115018 | A1 | 6/2005 | Jeon |
| 2005/0125945 | A1 | 6/2005 | Park |
| 2005/0198769 | A1 | 9/2005 | Lee et al. |
| 2005/0235454 | A1 | 10/2005 | Courtney |
| 2005/0252179 | A1 | 11/2005 | Oh et al. |
| 2006/0026789 | A1 | 2/2006 | Fischer et al. |
| 2006/0037172 | A1 | 2/2006 | Choi |
| 2006/0042206 | A1 | 3/2006 | Arnold et al. |
| 2006/0070205 | A1 | 4/2006 | Fischer et al. |
| 2006/0080947 | A1 | 4/2006 | Lee et al. |
| 2006/0123590 | A1 | 6/2006 | Fester et al. |
| 2006/0137304 | A1 | 6/2006 | Jeong et al. |
| 2006/0137305 | A1 | 6/2006 | Jung |
| 2006/0137306 | A1 | 6/2006 | Jeong et al. |
| 2006/0137309 | A1 | 6/2006 | Jeong et al. |
| 2006/0137314 | A1 | 6/2006 | Conrad et al. |
| 2006/0156509 | A1 | 7/2006 | Luebbering et al. |
| 2006/0156510 | A1 | 7/2006 | Park et al. |
| 2006/0156699 | A1 | 7/2006 | Kim |
| 2006/0162298 | A1 | 7/2006 | Oh et al. |
| 2006/0162299 | A1 | 7/2006 | North |
| 2006/0168922 | A1 | 8/2006 | Oh |
| 2006/0168923 | A1 | 8/2006 | Lee et al. |
| 2006/0207055 | A1 | 9/2006 | Ivarsson et al. |
| 2006/0207231 | A1 | 9/2006 | Arnold |
| 2006/0230715 | A1 | 10/2006 | Oh et al. |
| 2006/0230723 | A1 | 10/2006 | Kim et al. |
| 2006/0230724 | A1 | 10/2006 | Han et al. |
| 2006/0230726 | A1 | 10/2006 | Oh et al. |
| 2006/0236663 | A1 | 10/2006 | Oh |
| 2006/0278081 | A1 | 12/2006 | Han et al. |
| 2007/0012002 | A1 | 1/2007 | Oh et al. |
| 2007/0012003 | A1 | 1/2007 | Oh et al. |
| 2007/0039120 | A1 | 2/2007 | Choi |
| 2007/0067944 | A1 | 3/2007 | Kitamura |
| 2007/0079473 | A1 | 4/2007 | Min |
| 2007/0079584 | A1 | 4/2007 | Kim |
| 2007/0079585 | A1 | 4/2007 | Oh et al. |
| 2007/0079587 | A1 | 4/2007 | Kim |
| 2007/0084161 | A1 | 4/2007 | Yoo |
| 2007/0095028 | A1 | 5/2007 | Kim |
| 2007/0095029 | A1 | 5/2007 | Min |
| 2007/0226947 | A1 | 10/2007 | Kang |
| 2007/0251048 | A1 | 11/2007 | Choi |
| 2007/0289085 | A1 | 12/2007 | Yoo |
| 2007/0289089 | A1 | 12/2007 | Yacobi |
| 2007/0289264 | A1 | 12/2007 | Oh |
| 2008/0047091 | A1 | 2/2008 | Nguyen |
| 2008/0072397 | A1 | 3/2008 | Overvaag et al. |
| 2008/0083085 | A1 | 4/2008 | Genn |
| 2008/0134462 | A1 | 6/2008 | Jansen et al. |
| 2008/0155774 | A1 | 7/2008 | Pang |
| 2008/0172821 | A1 | 7/2008 | Kang et al. |
| 2008/0172995 | A1 | 7/2008 | Conrad |
| 2008/0178416 | A1 | 7/2008 | Conrad |
| 2009/0031522 | A1 | 2/2009 | Yoo |
| 2009/0044371 | A1 | 2/2009 | Yoo et al. |
| 2009/0056054 | A1* | 3/2009 | Hanschur et al. ..... 15/323 |
| 2009/0144928 | A1 | 6/2009 | Yoo |
| 2009/0144929 | A1 | 6/2009 | Yoo |
| 2010/0005611 | A1 | 1/2010 | Hong et al. |
| 2010/0071153 | A1 | 3/2010 | Genn |
| 2010/0095476 | A1 | 4/2010 | Kim et al. |
| 2010/0132150 | A1* | 6/2010 | Egler et al. ..... 15/320 |
| 2010/0139030 | A1 | 6/2010 | Yoo |
| 2010/0162515 | A1 | 7/2010 | Stephens |
| 2010/0175217 | A1 | 7/2010 | Conrad |
| 2010/0175219 | A1 | 7/2010 | Soen et al. |
| 2010/0229315 | A1 | 9/2010 | Rosenzweig |
| 2010/0229336 | A1 | 9/2010 | Conrad |
| 2010/0229338 | A1 | 9/2010 | Conrad |
| 2010/0242222 | A1 | 9/2010 | Conrad |
| 2011/0023262 | A1 | 2/2011 | Conrad |
| 2011/0219573 | A1 | 9/2011 | Conrad |
| 2011/0314629 | A1 | 12/2011 | Conrad |
| 2012/0000030 | A1 | 1/2012 | Conrad |
| 2012/0159734 | A1 | 6/2012 | Fujiwara |
| 2012/0222245 | A1 | 9/2012 | Conrad |
| 2012/0222262 | A1 | 9/2012 | Conrad |
| 2012/0272472 | A1 | 11/2012 | Conrad |
| 2013/0104335 | A1 | 5/2013 | Conrad |
| 2013/0111694 | A1 | 5/2013 | Morgan et al. |

FOREIGN PATENT DOCUMENTS

| | | |
|---|---|---|
| CA | 2241644 | 12/2007 |
| CA | 2675723 | 6/2008 |
| CA | 2436555 C | 7/2008 |
| CA | 2551200 C | 12/2009 |
| CA | 2658005 | 9/2010 |
| CA | 2658381 | 9/2010 |
| CA | 2658651 | 9/2010 |
| CA | 2659212 | 9/2010 |
| CA | 2674056 | 9/2010 |
| CA | 2674758 | 9/2010 |

(56) References Cited

FOREIGN PATENT DOCUMENTS

| | | | |
|---|---|---|---|
| CA | 2674761 | | 9/2010 |
| CA | 2678119 | | 9/2010 |
| CA | 2755305 | | 9/2010 |
| CA | 2755307 | | 9/2010 |
| CA | 2495073 | C | 5/2011 |
| CA | 2581799 | C | 8/2011 |
| CA | 2730689 | | 9/2011 |
| CA | 2574291 | C | 8/2013 |
| CA | 2677530 | | 1/2014 |
| CN | 2524655 | Y | 12/2002 |
| CN | 2534954 | Y | 2/2003 |
| CN | 2592103 | Y | 12/2003 |
| CN | 1765283 | A | 5/2006 |
| CN | 1806741 | A | 7/2006 |
| CN | 201101488 | Y | 8/2008 |
| CN | 101357051 | A | 2/2009 |
| CN | 101631494 | B | 4/2012 |
| CN | 200780051146.7 | | 4/2012 |
| CN | 202699035 | | 1/2013 |
| DE | 3734355 | C2 | 6/1989 |
| EP | 0489468 | A1 | 6/1992 |
| EP | 1027855 | A2 | 8/2000 |
| EP | 1674009 | A2 | 6/2006 |
| EP | 1771104 | B1 | 9/2008 |
| EP | 966912 | B1 | 3/2010 |
| EP | 2049000 | B1 | 6/2011 |
| EP | 1629758 | B1 | 10/2013 |
| FR | 2812531 | B1 | 11/2004 |
| GB | 2163703 | B | 1/1988 |
| GB | 2365324 | B | 7/2002 |
| GB | 2416296 | B | 6/2007 |
| GB | 2458243 | | 4/2012 |
| JP | 9-28638 | A | 2/1997 |
| JP | 2000140533 | A | 5/2000 |
| JP | 2004-344642 | A | 12/2004 |
| JP | 2005-40246 | A | 2/2005 |
| JP | 2005087508 | Y | 4/2005 |
| JP | 2010227287 | A | 10/2010 |
| KR | 1999-012242 | U | 4/1999 |
| WO | 9619294 | A1 | 6/1996 |
| WO | 00/78546 | A1 | 12/2000 |
| WO | 2004069021 | | 8/2004 |
| WO | 2005/089618 | | 2/2006 |
| WO | 2006026414 | A3 | 8/2007 |
| WO | 2007104138 | A1 | 9/2007 |
| WO | 2007084699 | A3 | 2/2008 |
| WO | 2008017802 | A1 | 2/2008 |
| WO | 2008-070980 | | 6/2008 |
| WO | 2008070966 | A1 | 6/2008 |
| WO | 2009026709 | A1 | 3/2009 |
| WO | 2010102410 | | 9/2010 |
| WO | 2010102411 | | 9/2010 |

OTHER PUBLICATIONS

Supplementary European Search Report, dated Jun. 16, 2009, as received on the corresponding EP application No. 07719394.4.

Office Action, dated Sep. 8, 2009, for U.S. Appl. No. 11/683,751.

International Search Report received on the corresponding international application No. PCT/CA2010/000366 dated Jun. 16, 2010.

International Search Report received on the corresponding international application No. PCT/CA2010/000342 dated Jun. 17, 2010.

Translation of Office Action received in connection to Chinese Patent Application No. 200880113799.8 dated Jul. 23, 2012.

International Search Report received on the corresponding International Patent Application No. PCT/CA2007/002228 mailed May 20, 2008.

Supplementary Search Report received in the corresponding European Patent Application No. 07855510.9, mailed on May 26, 2010.

The Office Action which issued in connection to the corresponding Canadian Patent Application No. 2,677,530 dated Nov. 30, 2011.

The Office Action received in connection to the corresponding Chinese Patent Application No. 200780051146.7 dated Feb. 23, 2011.

Translation of Office Action received in connection to Chinese Patent Application No. 200880113799.8 dated Nov. 9, 2011.

International Search Report and Written Opinion received in connection to international patent application No. PCT/CA2015/050485, mailed on Aug. 12, 2015.

* cited by examiner

SURFACE CLEANING APPARATUS

CROSS-REFERENCES TO RELATED APPLICATIONS

This application claims benefit under 35 USC 120 as continuation in part of co-pending U.S. patent application Ser. No. 13/781,441, filed on Feb. 28, 2013, the specification of which is incorporated herein by reference in its entirety.

FIELD

This specification relates to a surface cleaning apparatus. In one embodiment, the surface cleaning apparatus, which may be a reconfigurable upright surface cleaning apparatus, has a main power control and a brush control controllingly coupled to the brush motor that is provided on the handle assembly. In another embodiment, the surface cleaning apparatus, which may be a reconfigurable upright surface cleaning apparatus, has a light source disposed on the handle assembly.

INTRODUCTION

The following is not an admission that anything discussed below is part of the prior art or part of the common general knowledge of a person skilled in the art.

Various types of surface cleaning apparatus are known. Typically, an upright vacuum cleaner includes an upper portion or upper section, including an air treatment member such as one or more cyclones and/or filters, drivingly mounted to a surface cleaning head. An up flow conduit is typically provided between the surface cleaning head and the upper portion. In some such vacuum cleaners, a spine, casing or backbone extends between the surface cleaning head and the upper portion for supporting the air treatment member. The suction motor may be provided in the upper portion or in the surface cleaning head.

Surface cleaning apparatus having a portable cleaning module that is removably mounted to an upright vacuum cleaner are known. See for example U.S. Pat. No. 5,309,600, U.S. Pat. No. 4,635,315 and US 2011/0314629. US 2011/0314629 discloses an upright vacuum cleaner having a surface cleaning head and an upright section pivotally mounted thereto. A hand vacuum cleaner or a pod is removably mounted on the upper portion and is connected in airflow communication with the surface cleaning head via a flexible hose. A portion of the upper portion is bendable so as to allow the surface cleaning head to extend under furniture. This bendable portion is external to the airflow path. In use, the hand vacuum cleaner is locked on the upper portion. A user may manually unlock the hand vacuum cleaner so as to remove it for use as a hand vacuum cleaner and/or for emptying the cyclone bin assembly. In addition, an above floor cleaning wand may be provided and may be removable with the pod.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In a first aspect, there is provided a surface cleaning apparatus, such as an upright vacuum cleaner, wherein both the main power control and the brush control are located proximate each other and may be located so as to be operable by the same hand as is used to manipulate the surface cleaning apparatus, such as being provided proximate, and optionally on, a handle assembly, and may be on the hand grip portion of the handle assembly. This provides a user with conveniently located controls and enables the user to adjust the mode of vacuuming while continuing to use the vacuum cleaner.

In accordance with this aspect, there is provided a surface cleaning apparatus comprising:

(a) a surface cleaning head comprising, a brush driven by a brush motor, a dirty air inlet and a cleaning head air outlet;

(b) an upper portion moveably mounted to the surface cleaning head between a storage position and a floor cleaning position;

(c) an air flow path extending from the cleaning head air outlet to a clean air outlet;

(d) an air treatment member and a suction motor provided in the air flow path;

(e) the air flow path comprising a flexible electrified air flow conduit wherein the brush motor is electrically connected to a power source by a circuit that includes the flexible electrified air flow conduit; and, (f) a handle assembly drivingly connected to the surface cleaning head and comprising a main power control and a brush control controllingly coupled to the brush motor.

In some embodiments the handle assembly comprises a handle useable by a hand of a user to direct the surface cleaning head and the brush control and the main power control are each operable by the hand while the user uses the hand to direct the surface cleaning head.

In some embodiments the handle assembly comprises a handle and the brush control and the main power control are each positioned proximate the handle.

In some embodiments the handle assembly comprises a handle and the brush control and the main power control are each positioned on the handle.

In some embodiments the brush control is adjustable such that the brush motor is operable in at least two different modes.

In some embodiments the brush control comprises a multi-position switch.

In some embodiments the upper portion comprises a rigid airflow conduit removably connectable to the cleaning head air outlet, the airflow conduit comprising a conduit air inlet and a conduit air outlet, the conduit air inlet having an associated multi-conductor connector mateable with a multi-conductor connector of the surface cleaning head.

In some embodiments the brush control is a multi-position control, the circuit comprises a handle control processor coupled to the multi-position control and a brush control processor, wherein the handle control processor is configured to transmit a brush control signal via a control conductor to the brush control processor based on a selected position of the multi-position control, and wherein the brush control processor is configured to sequentially select between at least two different brush power level outputs of the brush motor based on the brush control signal.

In some embodiments the main power control is provided in series with the control conductor and a hot conductor.

In some embodiments the upper portion comprises a rigid airflow conduit having a lower end that is removably connectable in air flow communication and electrically connectable to the surface cleaning head, and the handle assembly is removably connectable in air flow communication and electrically connectable to an upper end of the rigid airflow conduit.

In some embodiments the upper end of the rigid conduit is an outlet end and the flexible electrified air flow conduit is downstream of the upper end and is electrically connected to the rigid conduit via the handle assembly.

In some embodiments the upright surface cleaning apparatus further comprises a light source disposed on the handle assembly.

In some embodiments the light source is automatically powered when the handle assembly is electrically disconnected from the surface cleaning head.

In some embodiments the upright surface cleaning apparatus further comprises a surface cleaning unit removably mounted to the support structure, the surface cleaning unit comprising the suction motor and the air treatment member.

In a second aspect, there is provided a surface cleaning apparatus, such as an upright vacuum cleaner, which may be reconfigurable, wherein a light is provided on the handle assembly, and may be in front of the hand grip portion of the handle assembly. This provides a user with a light that may be used when the handle has an auxiliary cleaning tool, such as a crevice tool or mini cleaning head or a power tool attached thereto.

In accordance with this aspect, there is provided a surface cleaning apparatus comprising:

(a) a surface cleaning head comprising, a brush driven by a brush motor, a dirty air inlet and a cleaning head air outlet;

(b) an upper portion moveably mounted to the surface cleaning head between a storage position and a floor cleaning position;

(c) an air flow path extending from the cleaning head air outlet to a clean air outlet;

(d) an air treatment member and a suction motor provided in the air flow path;

(e) the air flow path comprising a flexible electrified air flow conduit wherein the brush motor is controllingly connected to a power source by a circuit that includes the flexible electrified air flow conduit; and, (f) a handle assembly drivingly connected to the surface cleaning head and a light source disposed on the handle assembly.

In some embodiments the light source is automatically powered when the handle assembly is electrically disconnected from the surface cleaning head.

In some embodiments the upright surface cleaning apparatus further comprises at least one of a main power control and a brush control controllingly coupled to the brush motor positioned proximate the handle assembly.

In some embodiments the handle assembly comprises a handle useable by a hand of a user to direct the surface cleaning head and the at least one of the brush control and the main power control are operable by the hand while the user uses the hand to direct the surface cleaning head.

In some embodiments the handle assembly comprises a handle and the at least one of the brush control and the main power control are positioned proximate the handle.

In some embodiments the handle assembly comprises a handle and the at least one of the brush control and the main power control are positioned on the handle.

In some embodiments wherein the upper portion comprises a rigid airflow conduit having a lower end that is removably connectable in air flow communication and electrically connectable to the surface cleaning head, and the handle assembly is removably connectable in air flow communication and electrically connectable to an upper end of the rigid airflow conduit.

In some embodiments the upright surface cleaning apparatus further comprises a surface cleaning unit removably mounted to the support structure, the surface cleaning unit comprising the suction motor and the air treatment member.

It will be appreciated by a person skilled in the art that a surface cleaning apparatus may embody any one or more of the features contained herein and that the features may be used in any particular combination or sub-combination.

The drawings included herewith are for illustrating various examples of articles, methods, and apparatuses of the teaching of the present specification and are not intended to limit the scope of what is taught in any way.

DRAWINGS

Figure 1:
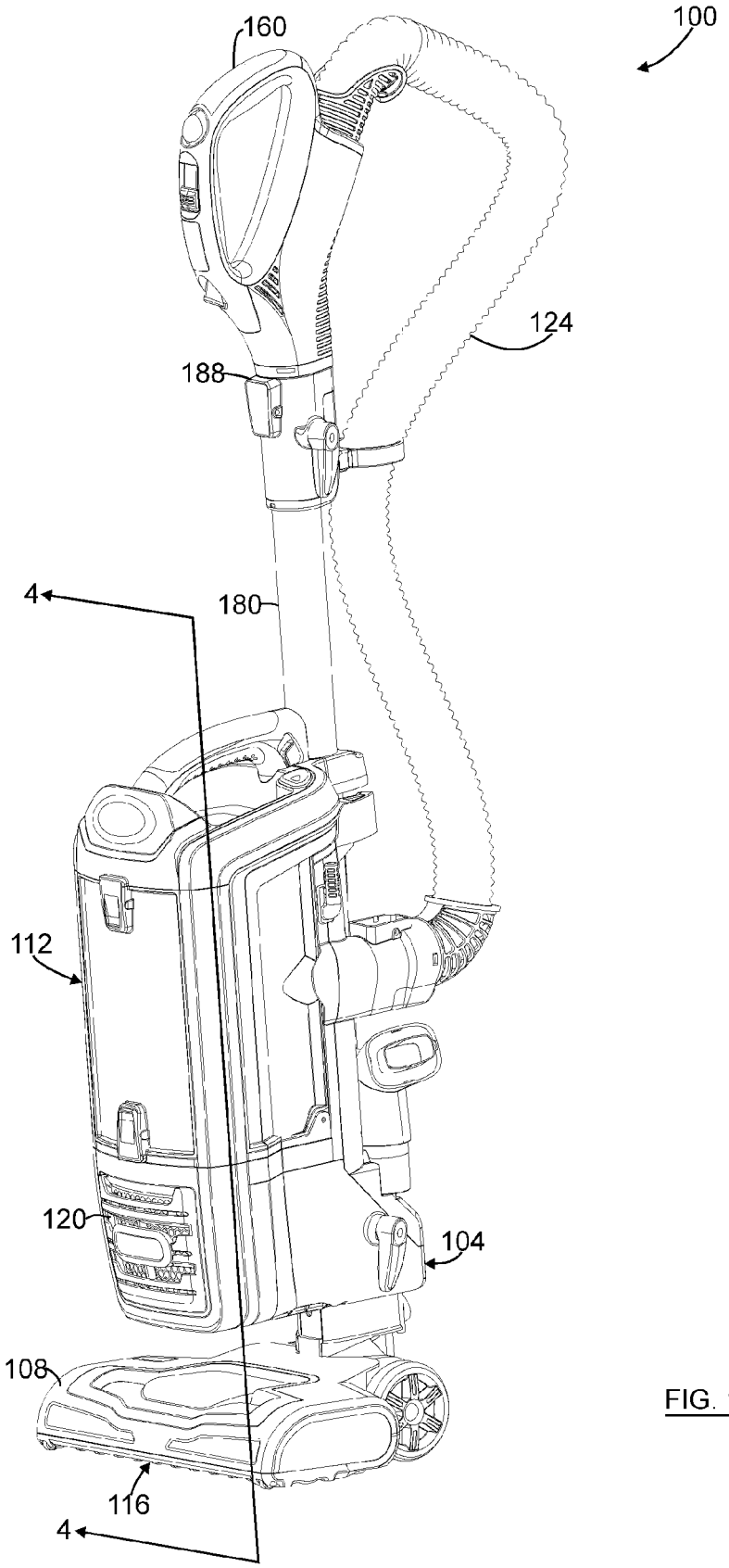
FIG. 1 is a front perspective view of a surface cleaning apparatus in a storage position.
Figure 3:
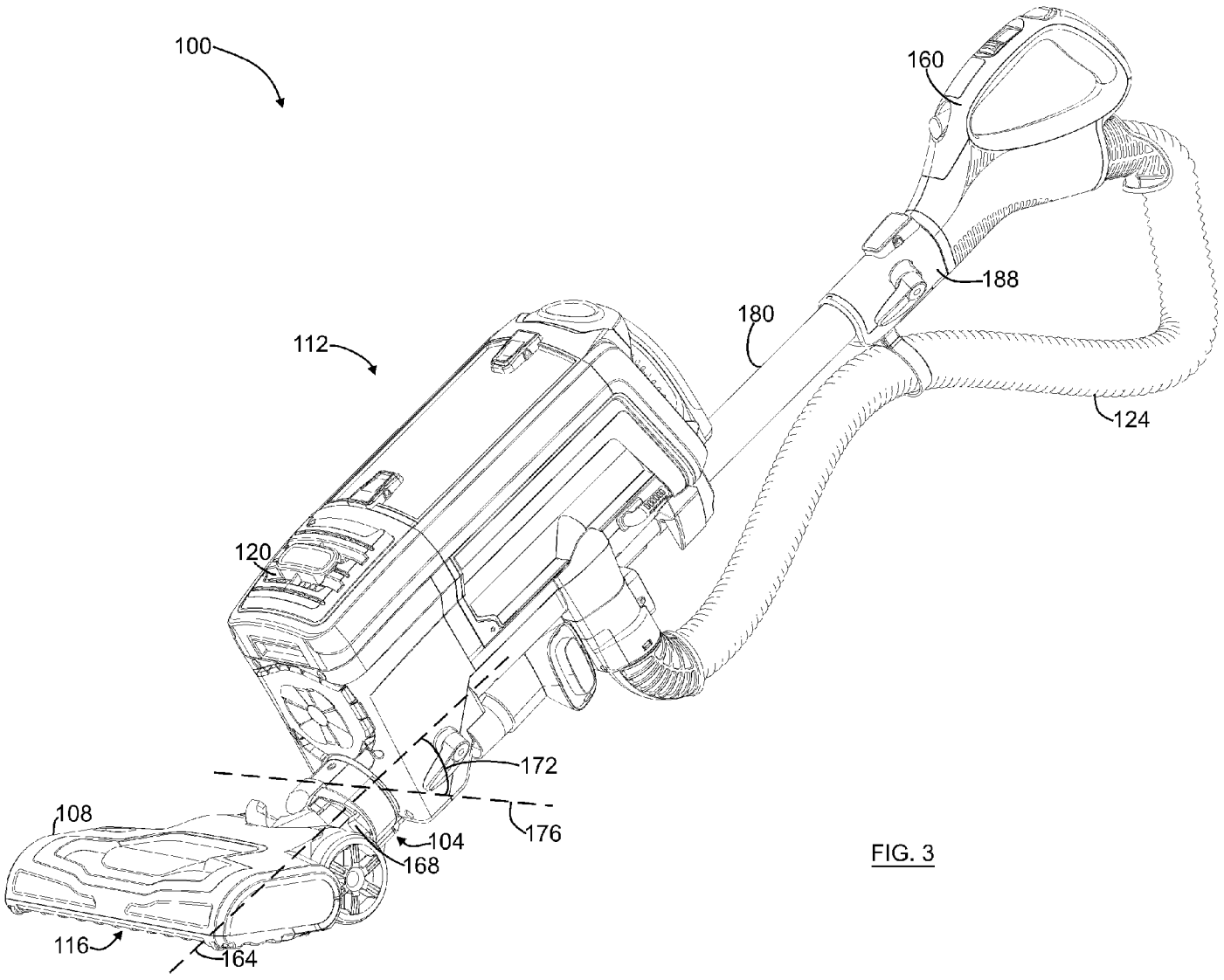
FIG. 3 is a front perspective view of the surface cleaning apparatus of FIG. 1, in a floor cleaning position.
Figure 3A:
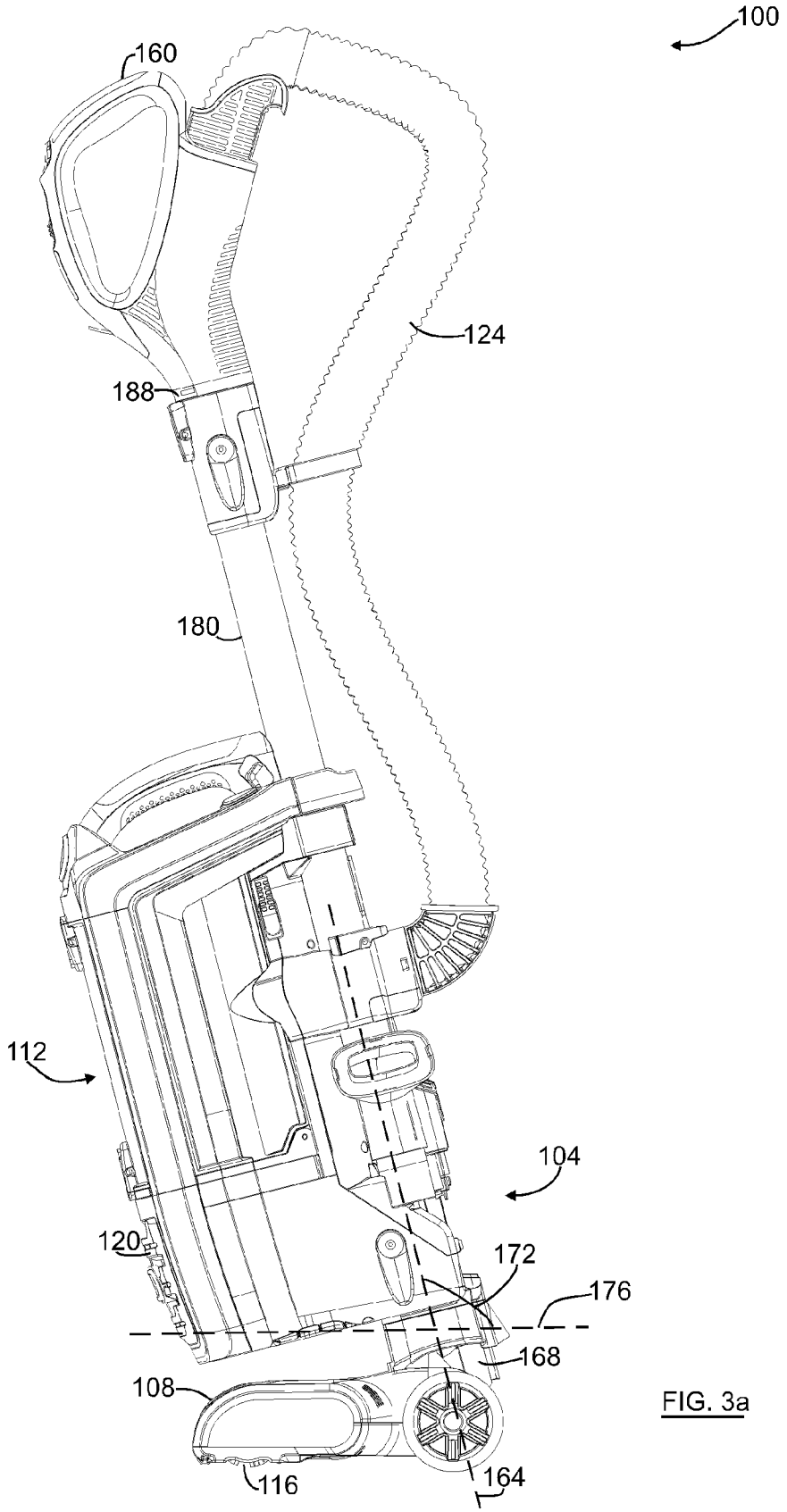
Figure 4:
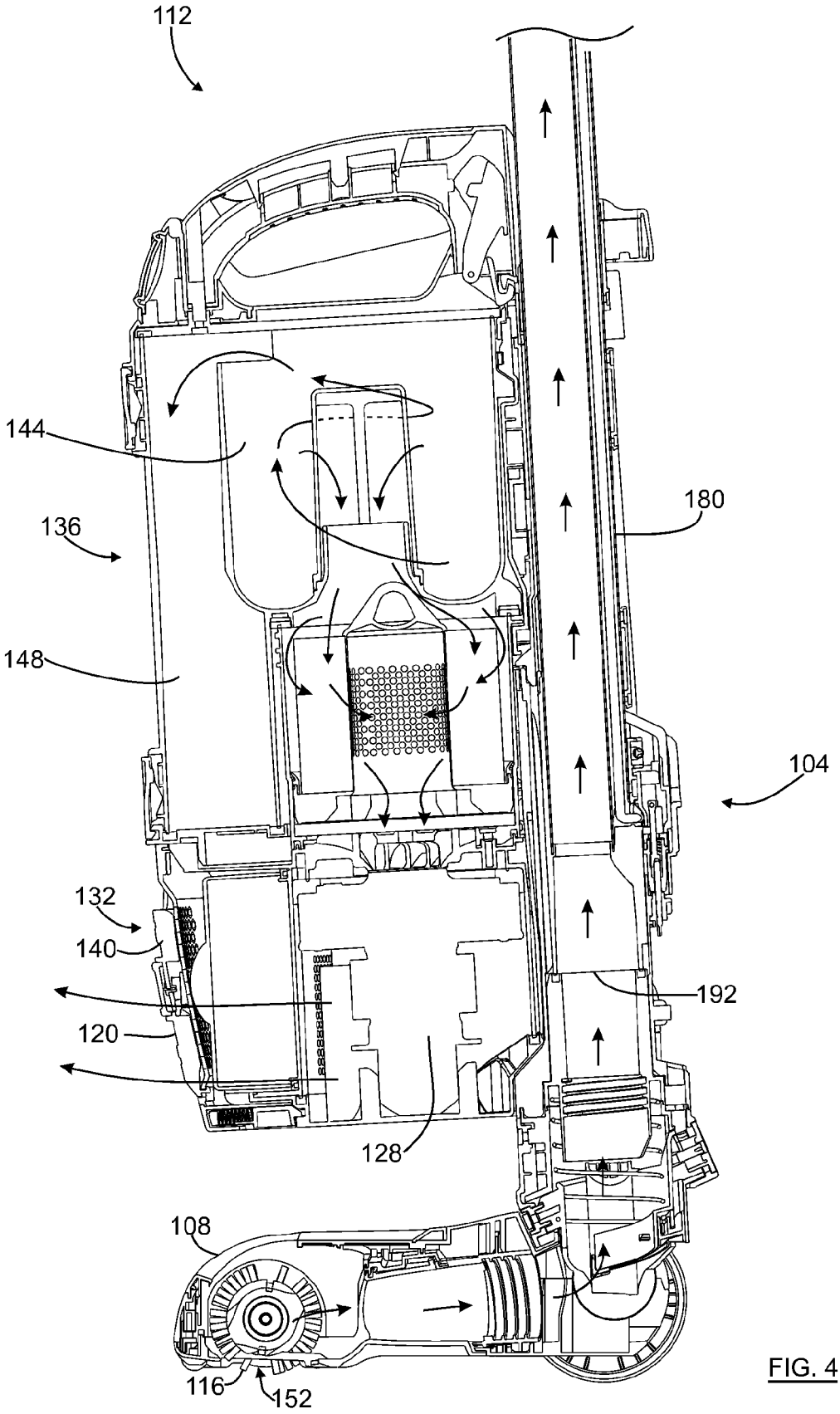
Figure 5:
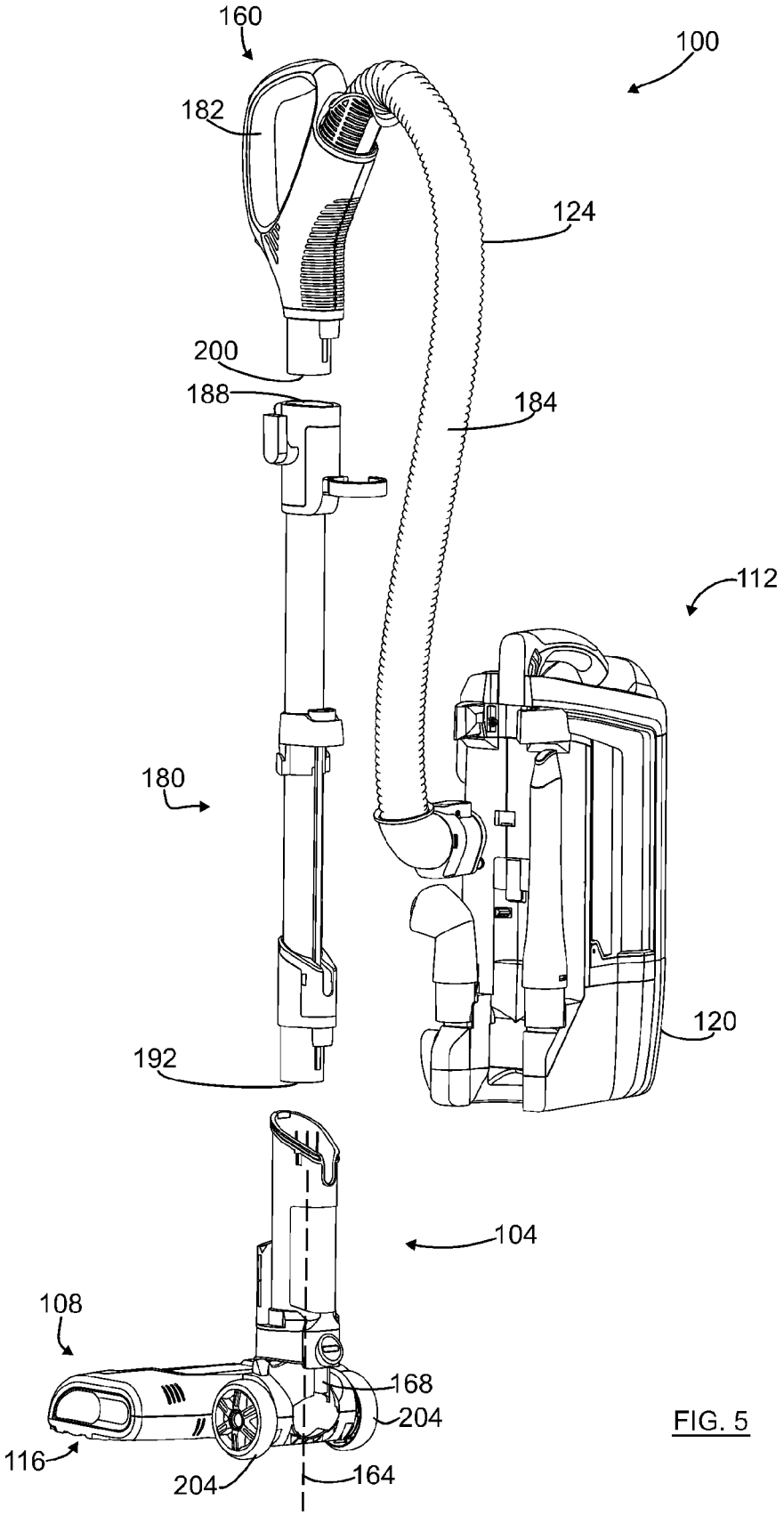
Figure 6:
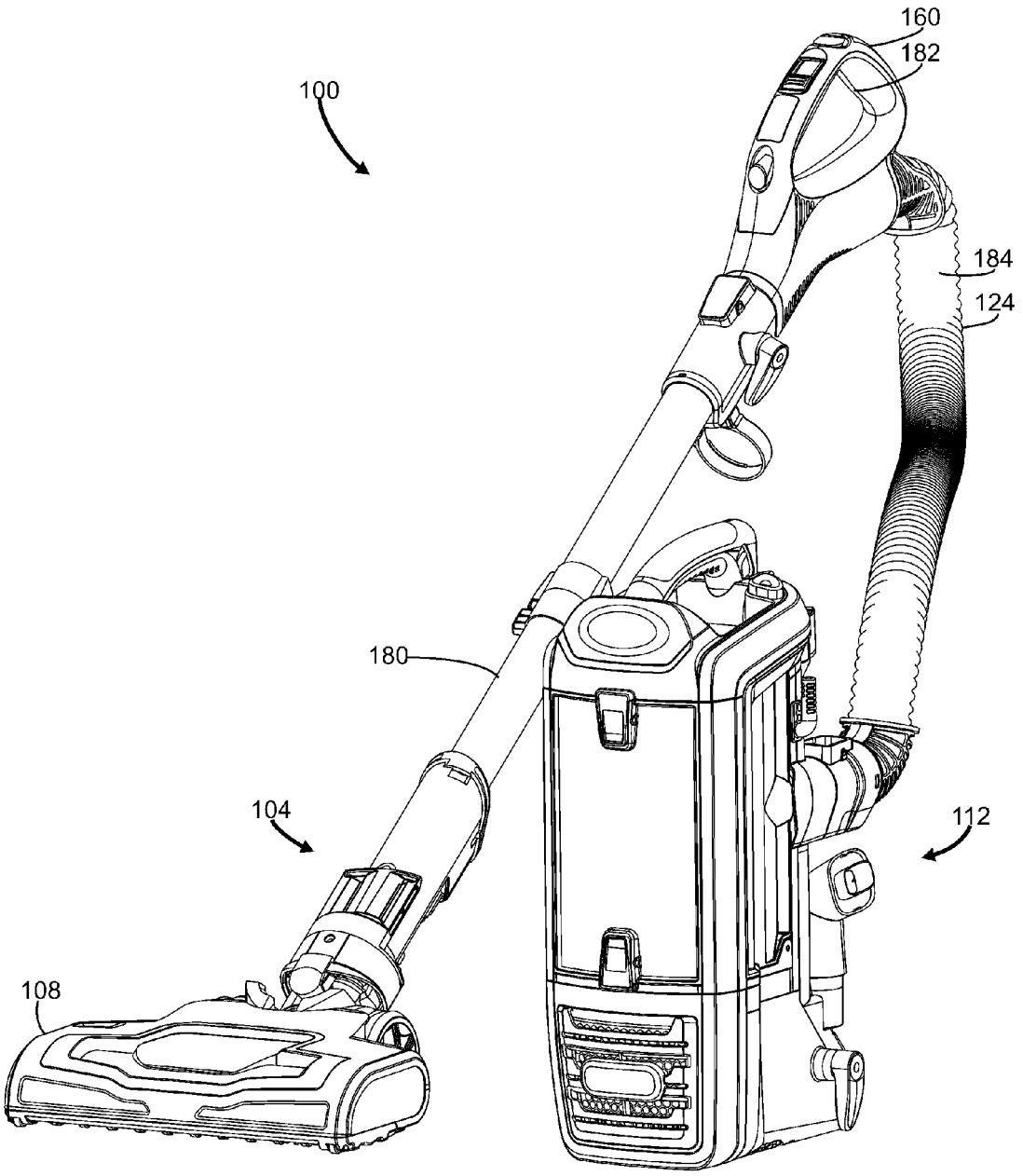
Figure 7:
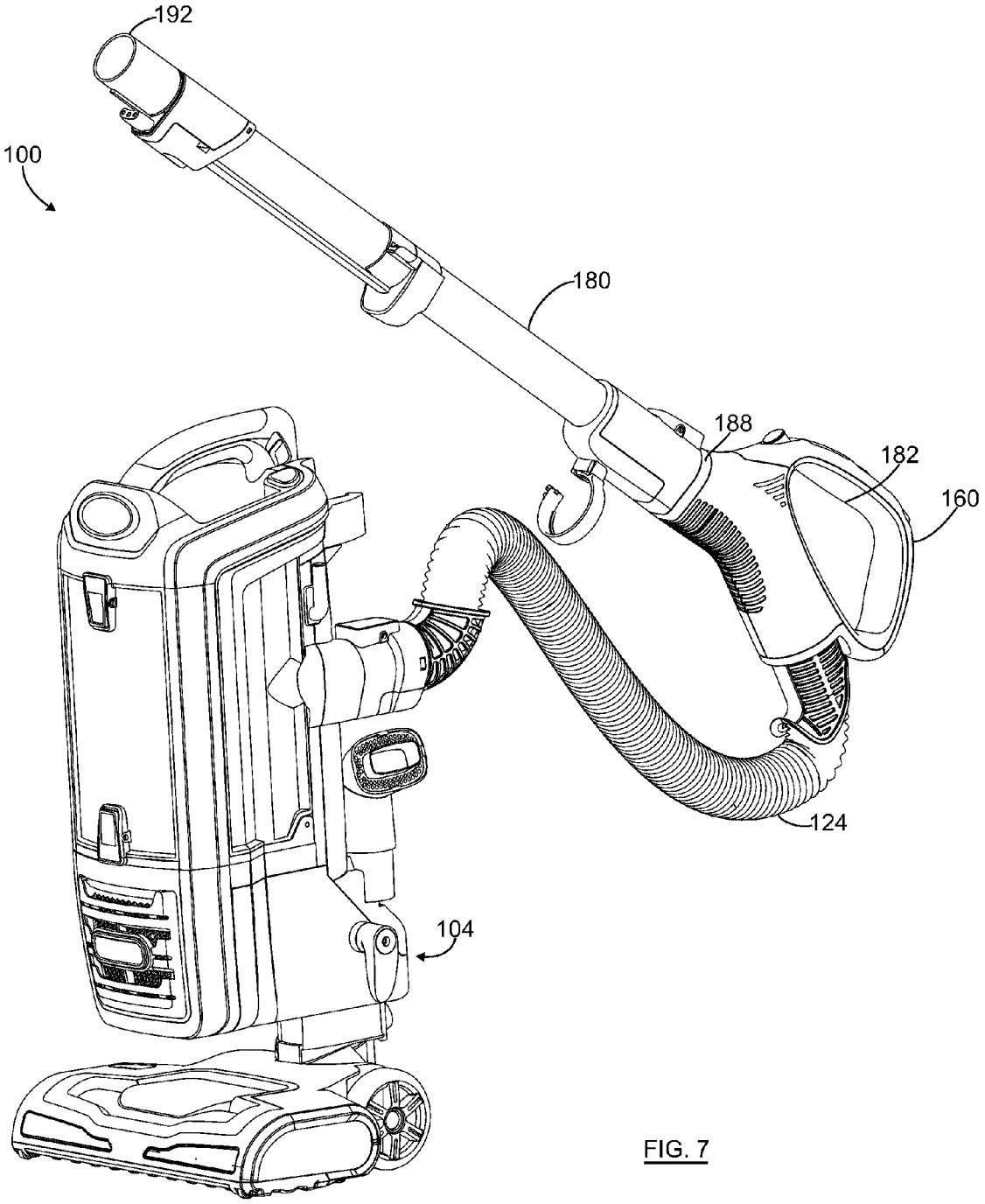
Figure 8:
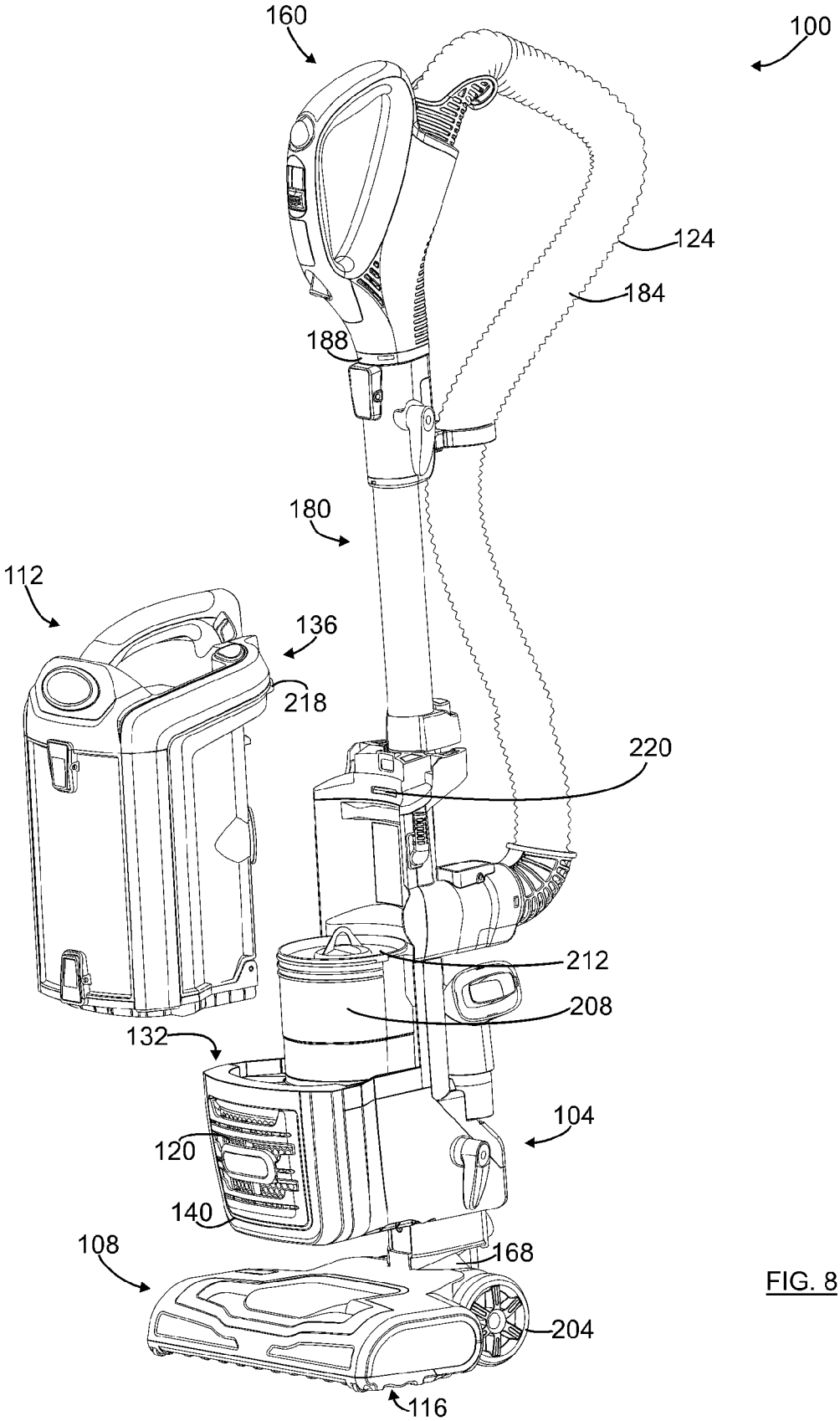
Figure 9:
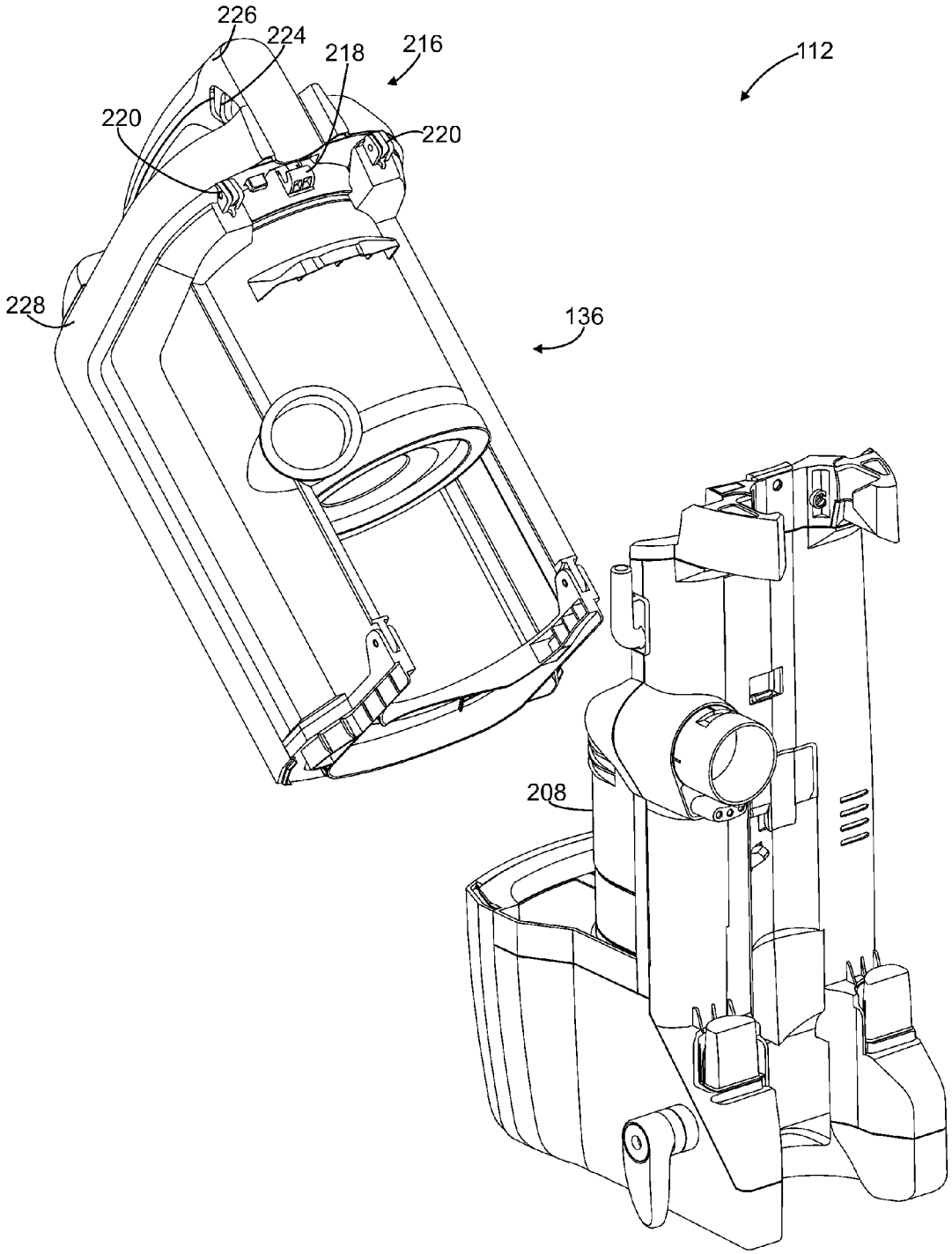
Figure 10:
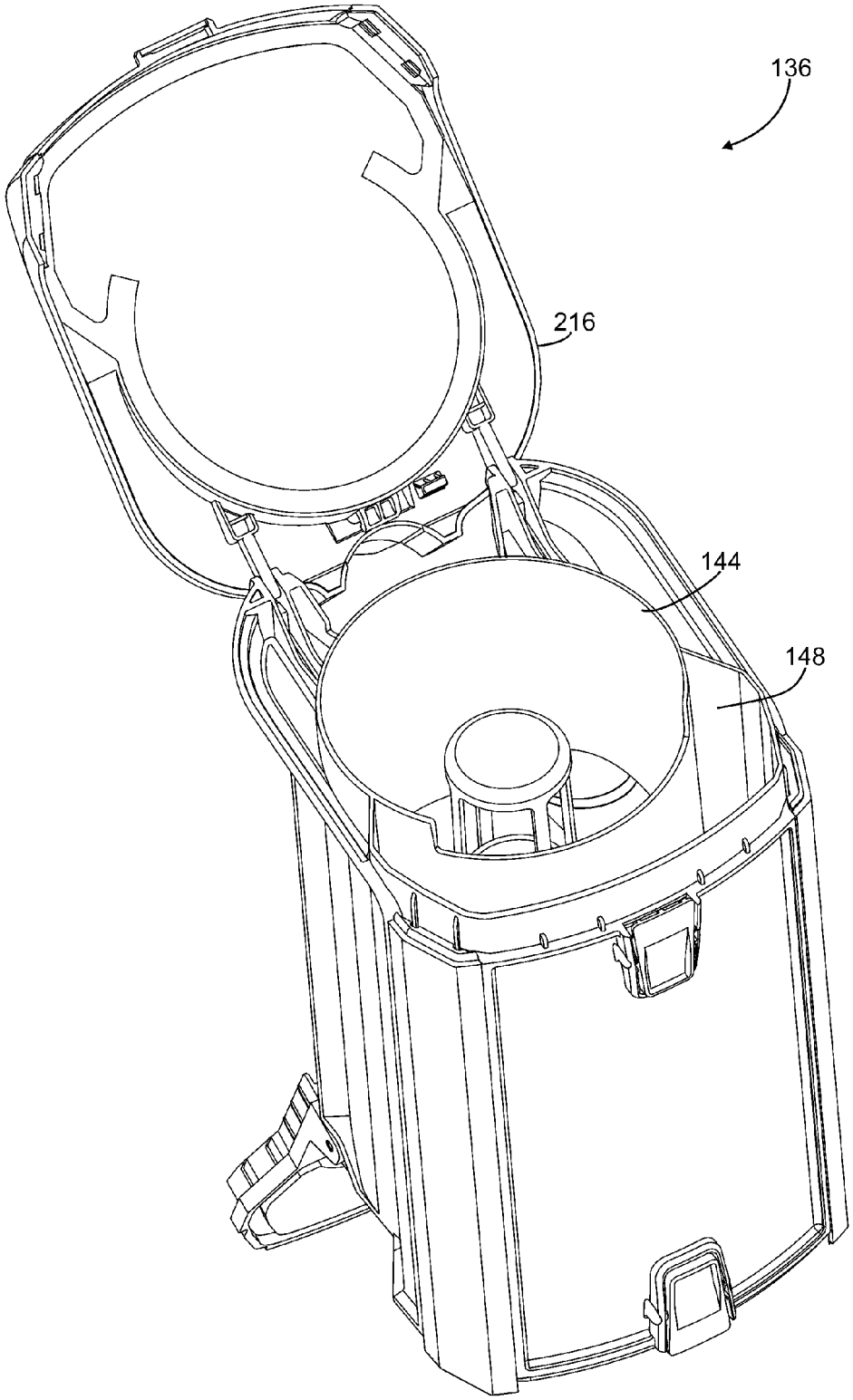
Figure 11:
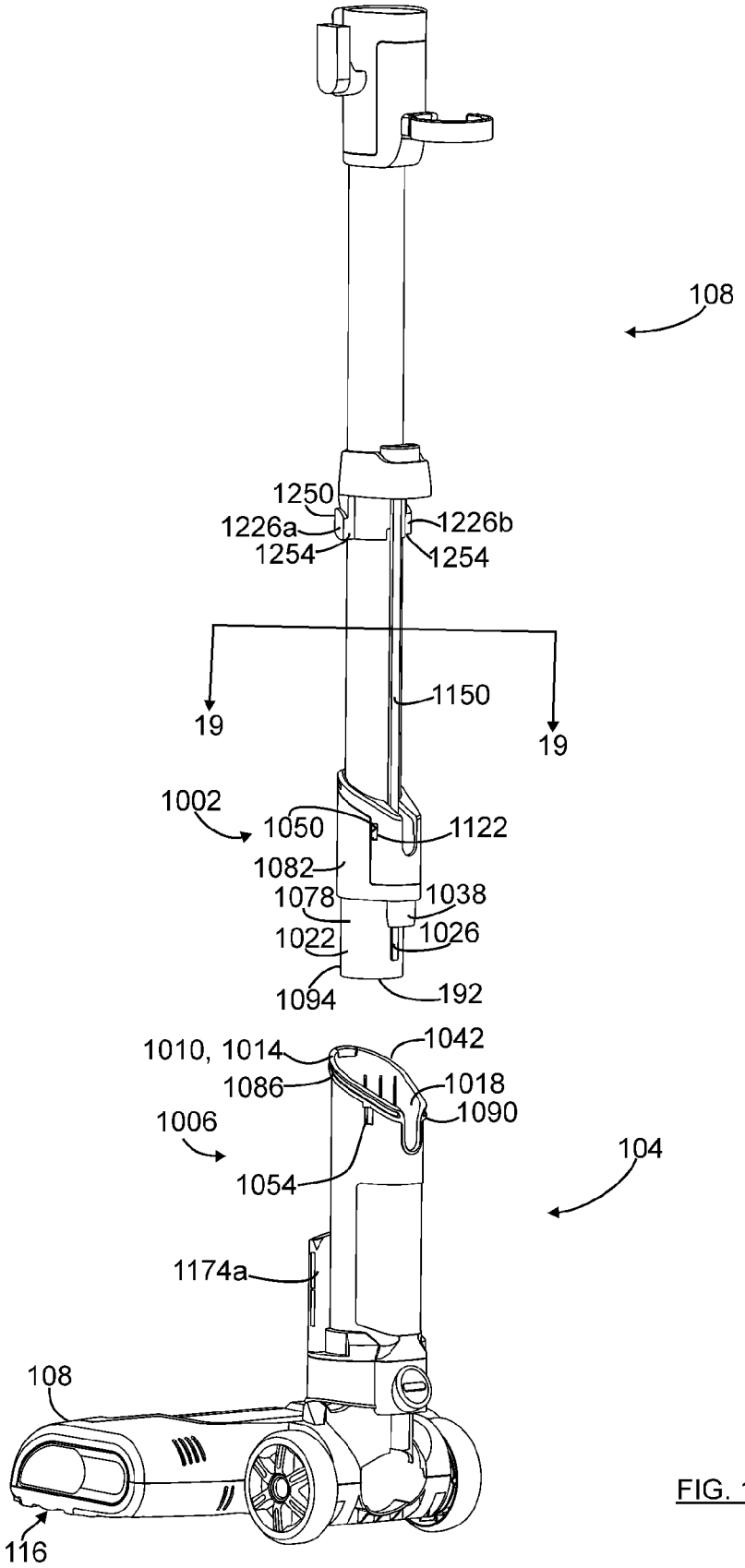
Figure 12:
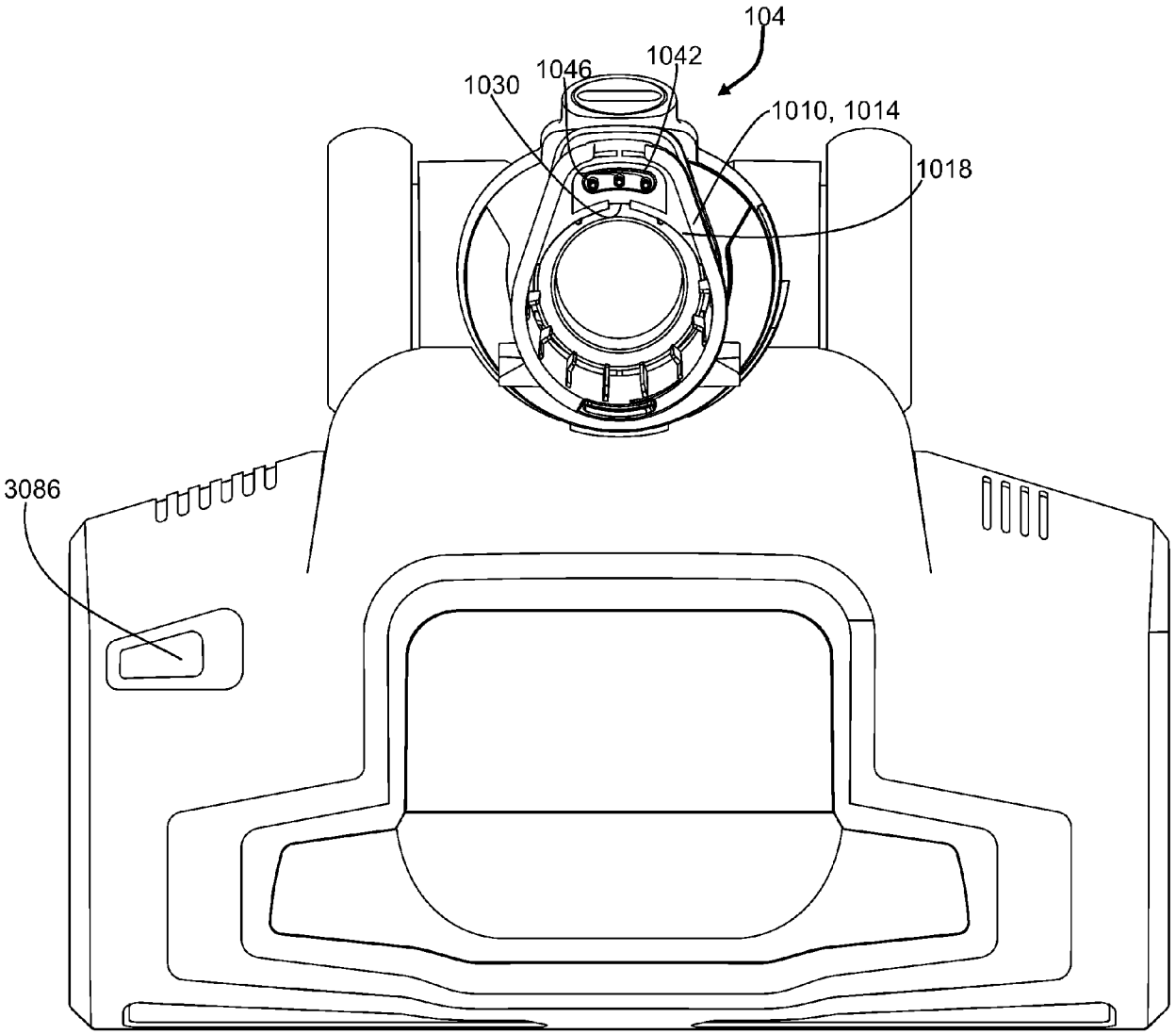
Figure 13:
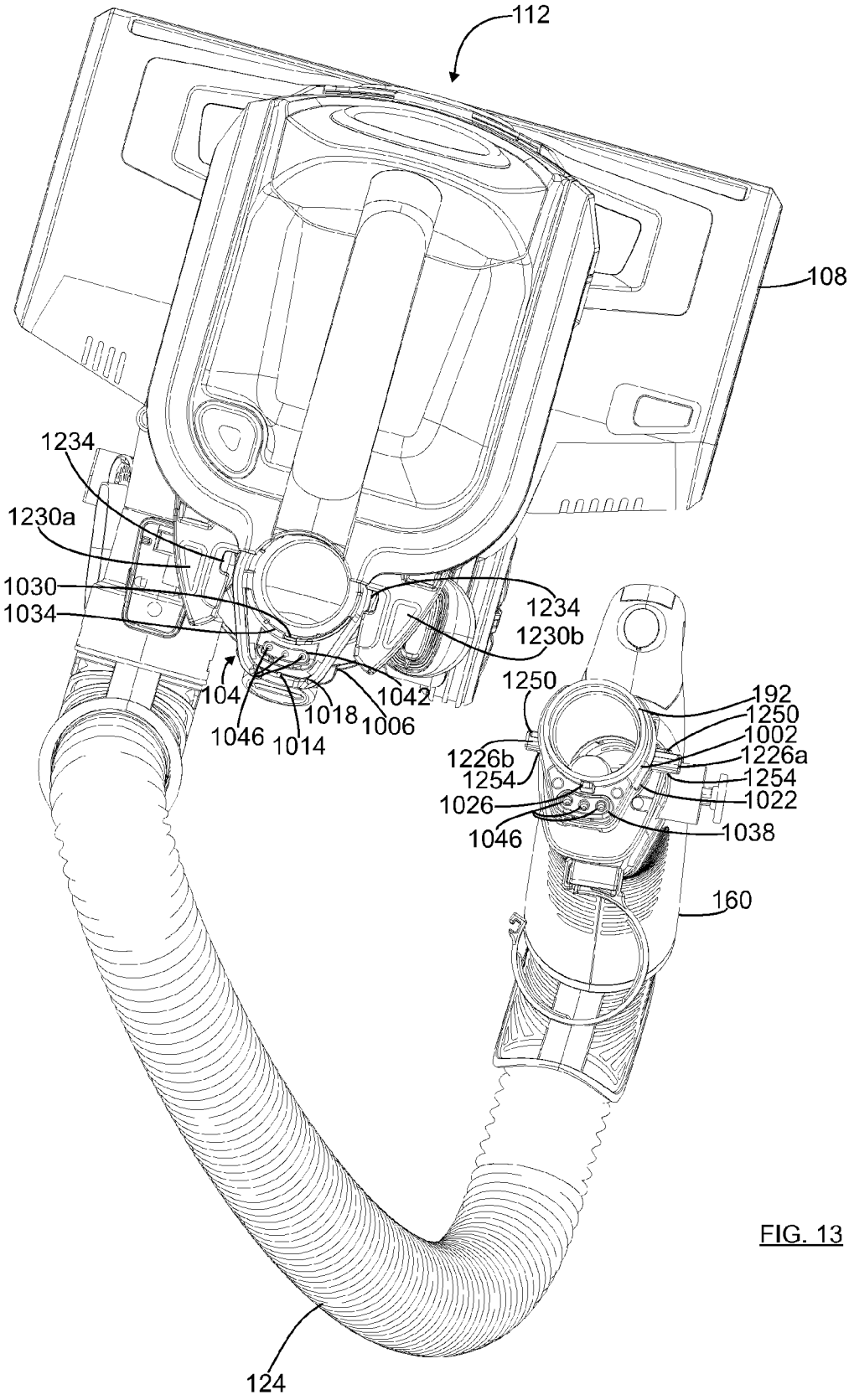
Figure 14:
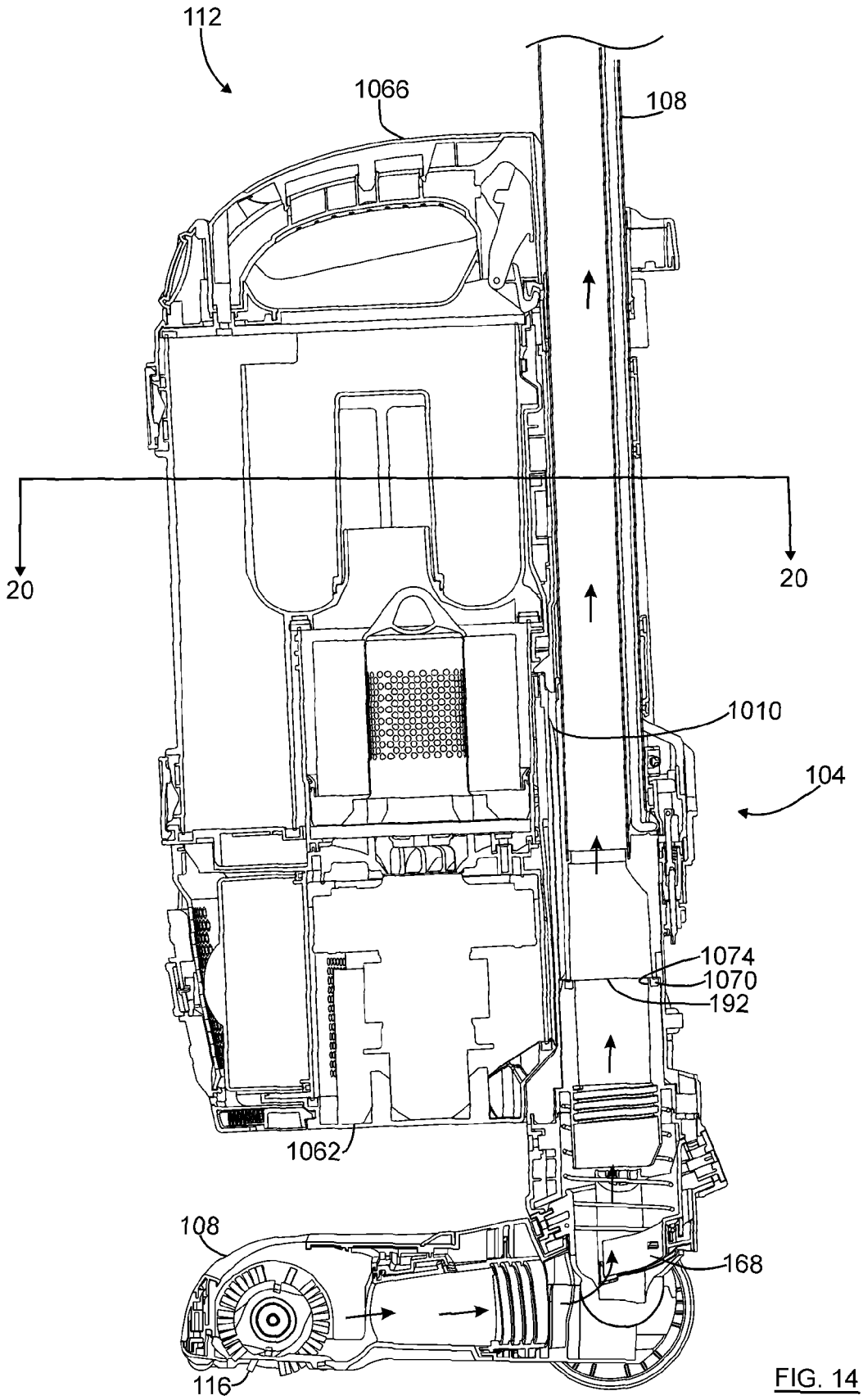
Figure 15:
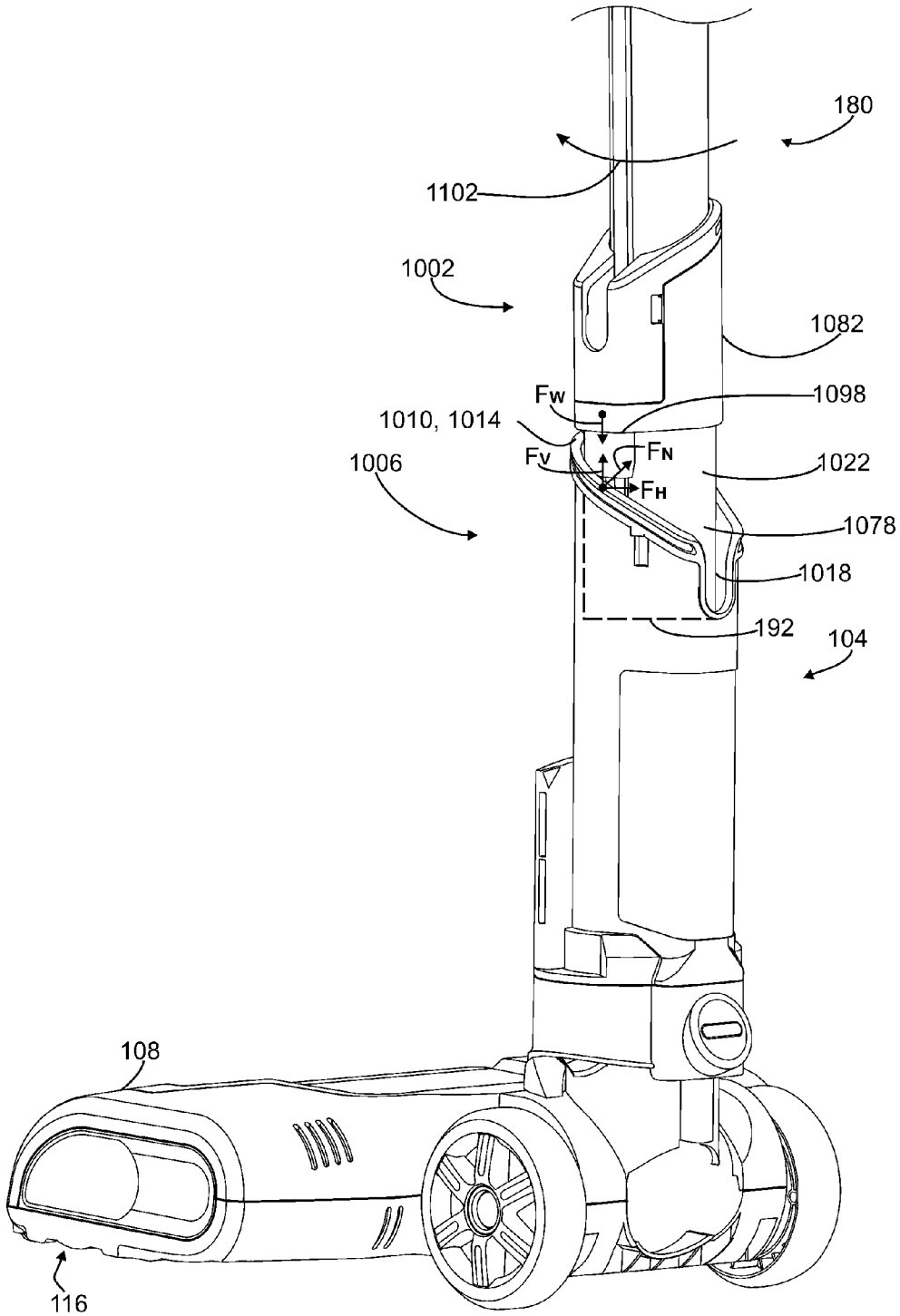
Figure 16:
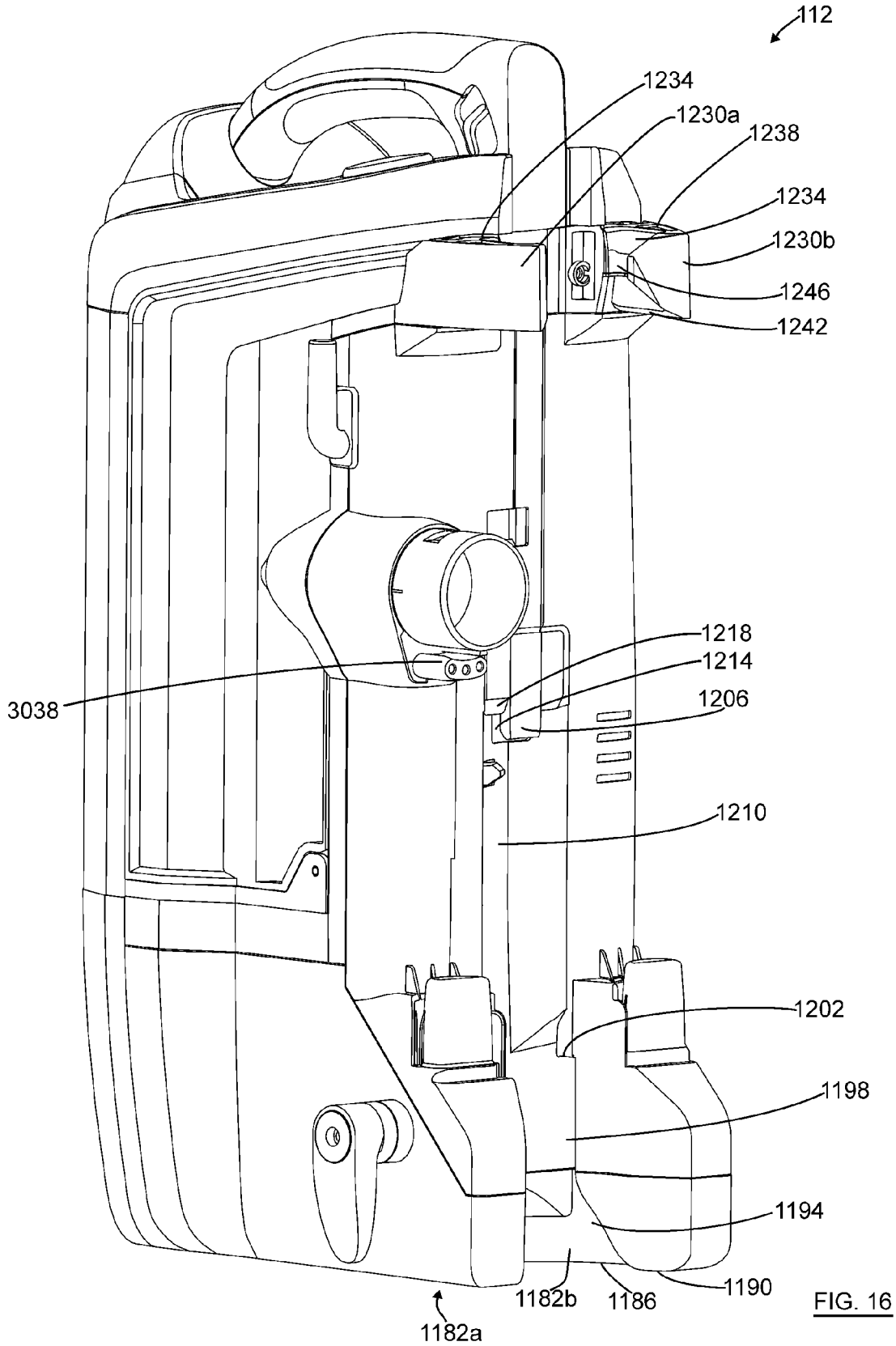
Figure 17:
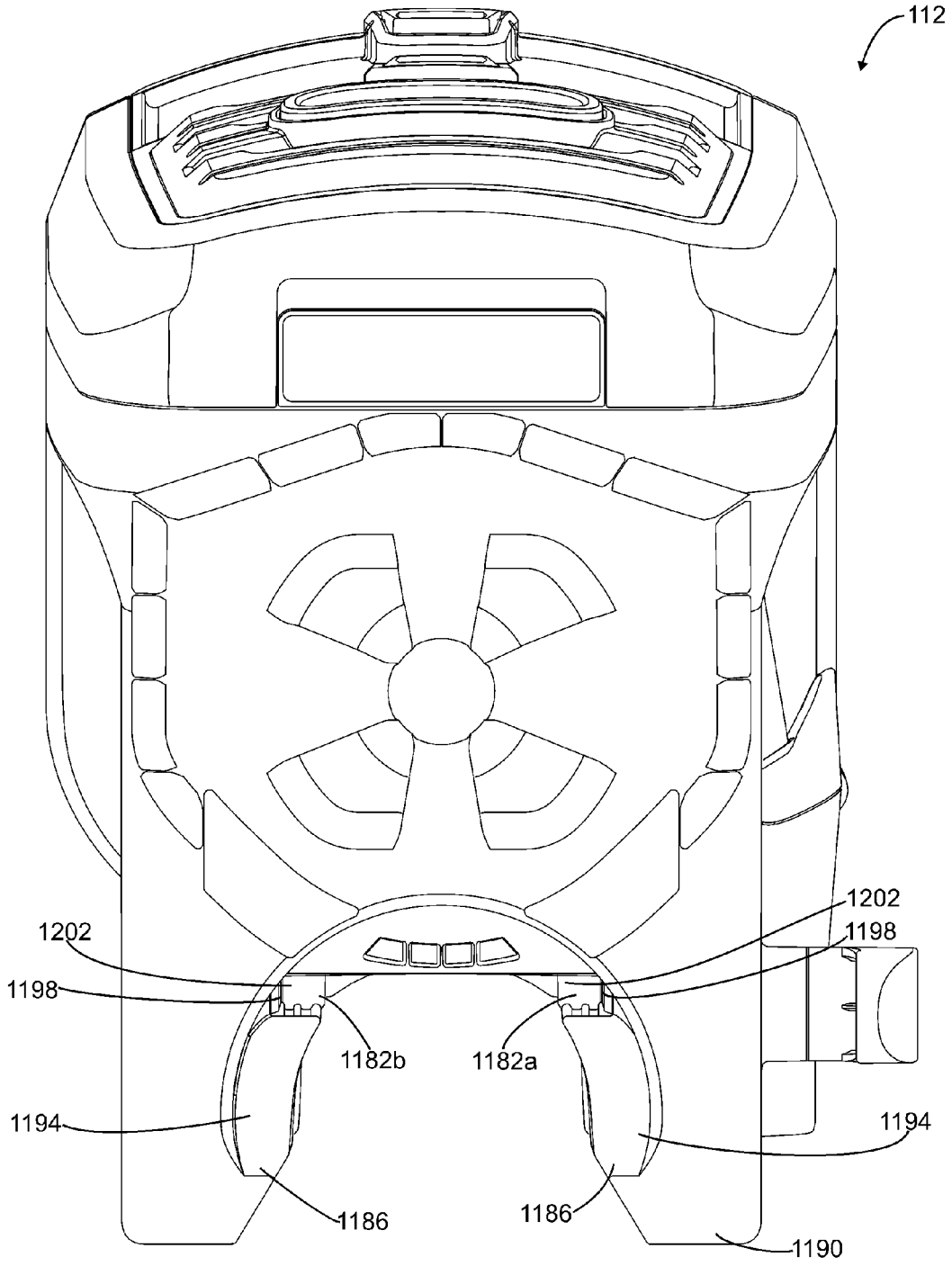
Figure 18:
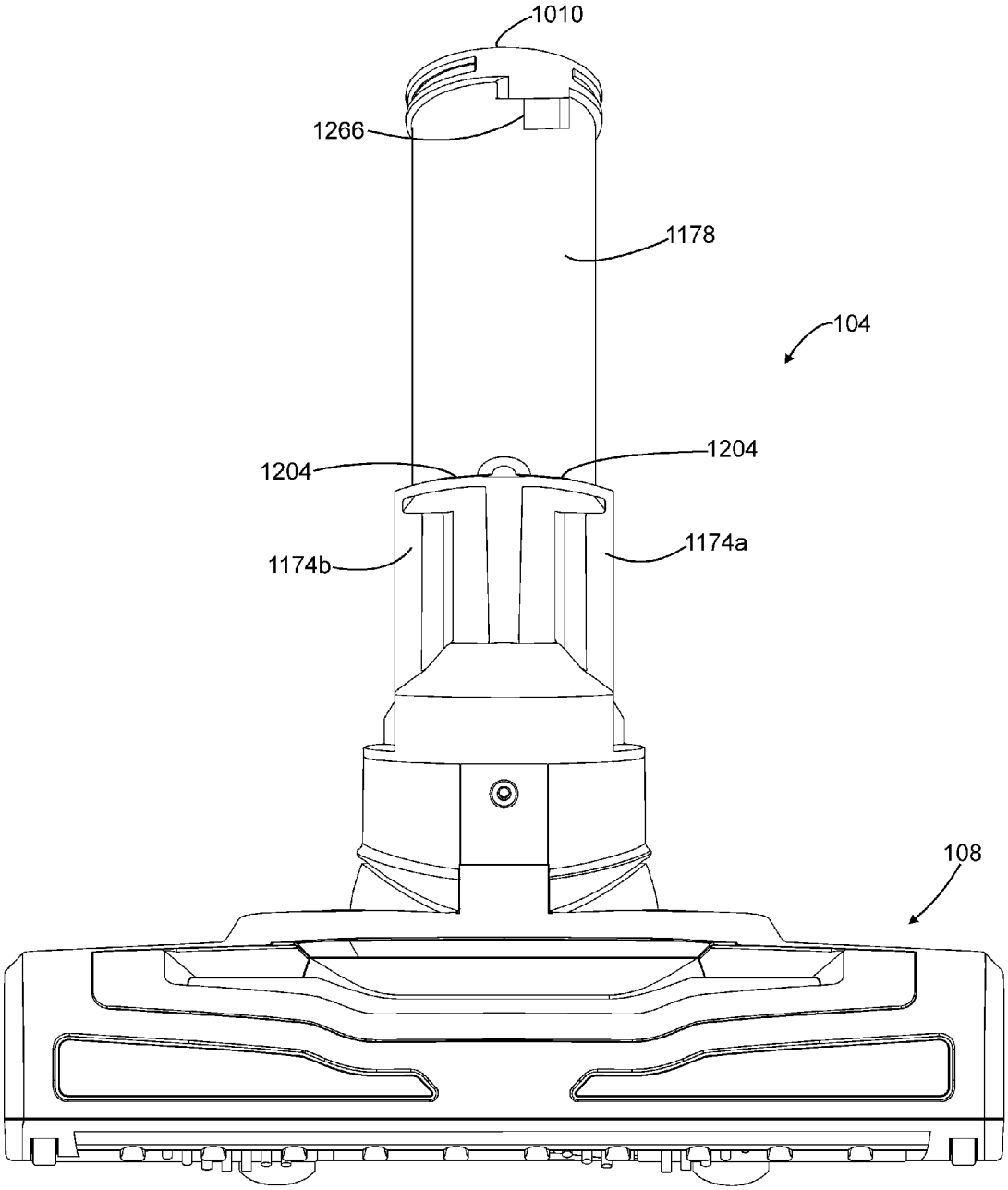
Figure 19:
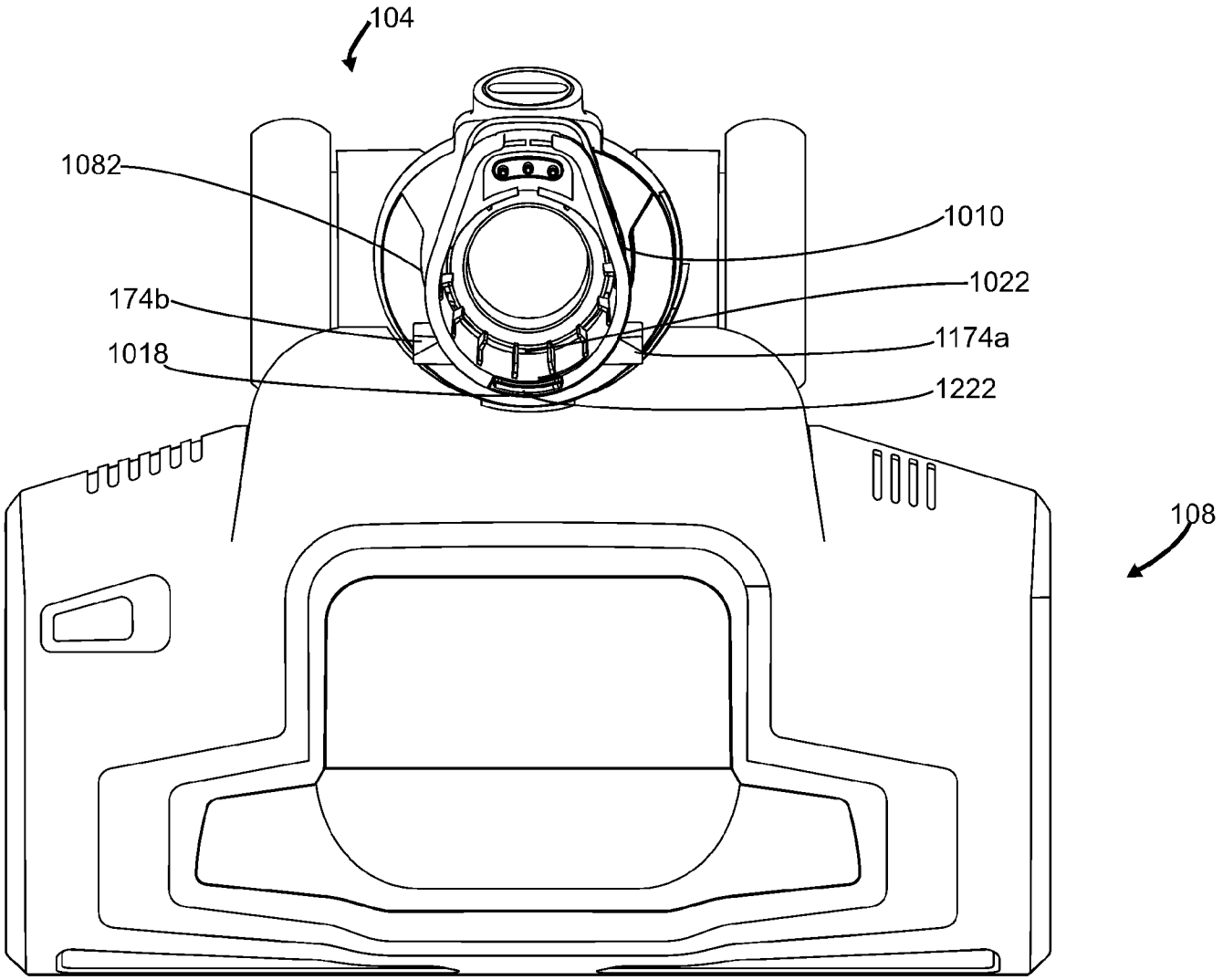
Figure 20:
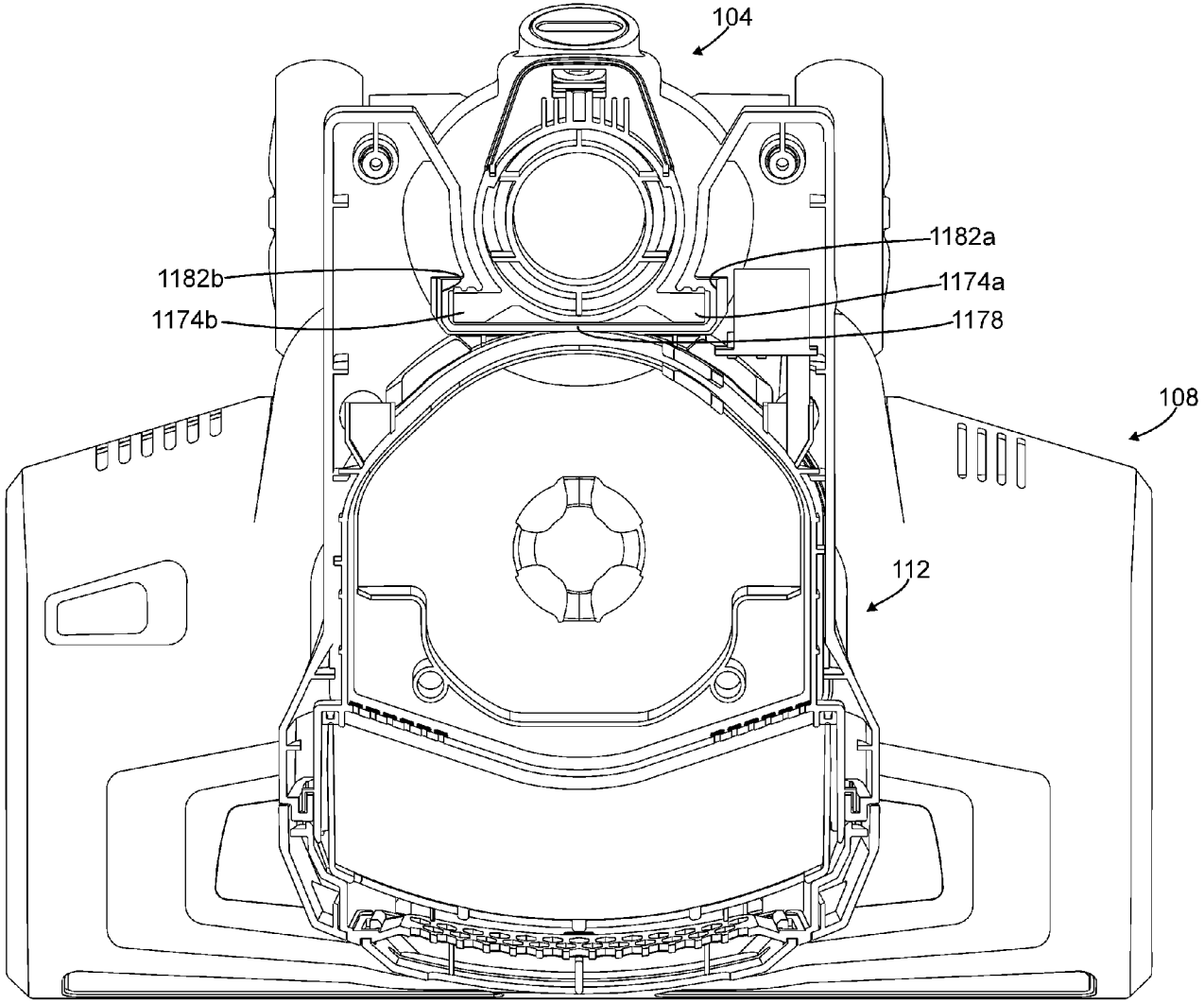
Figure 21:
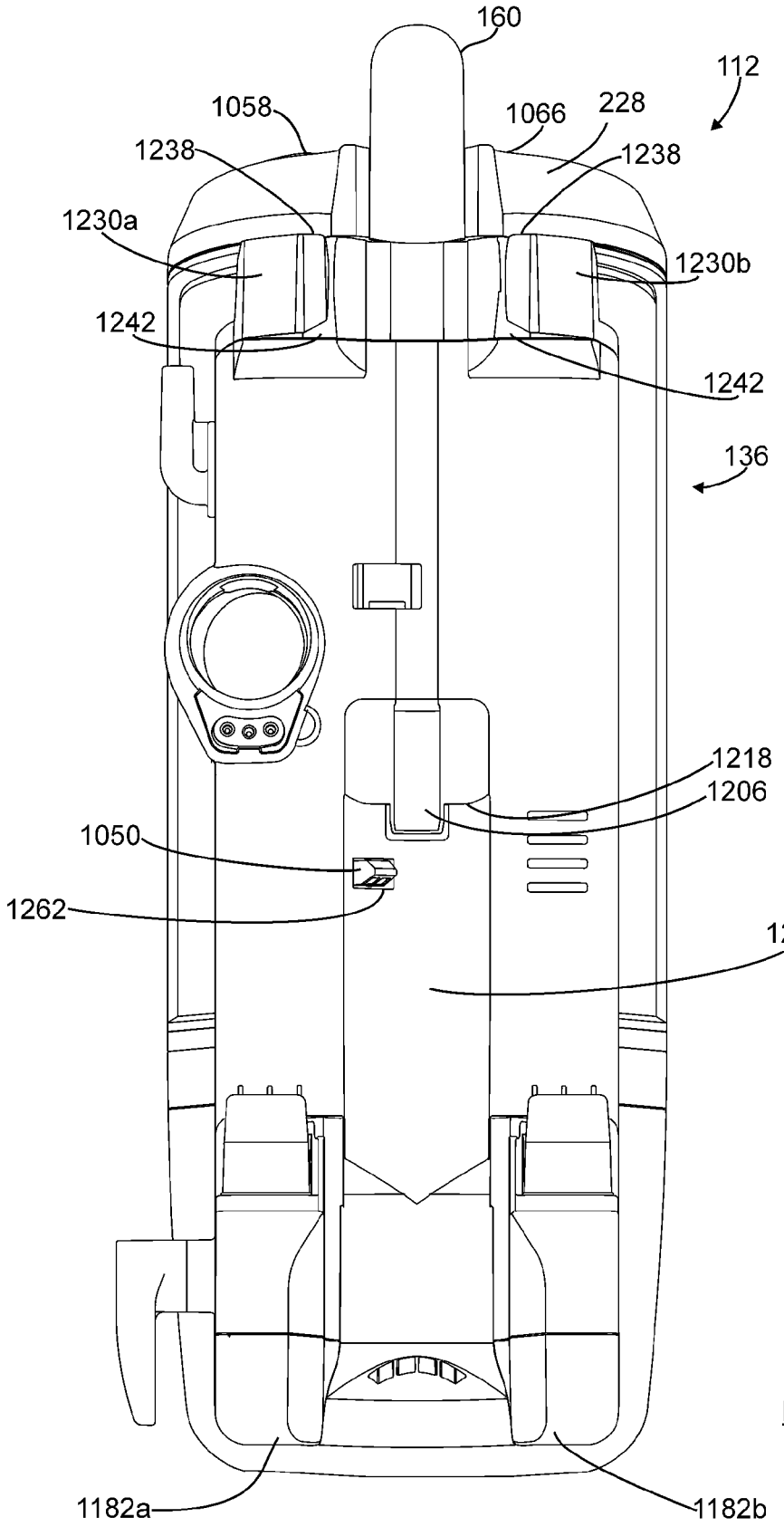
Figure 23:
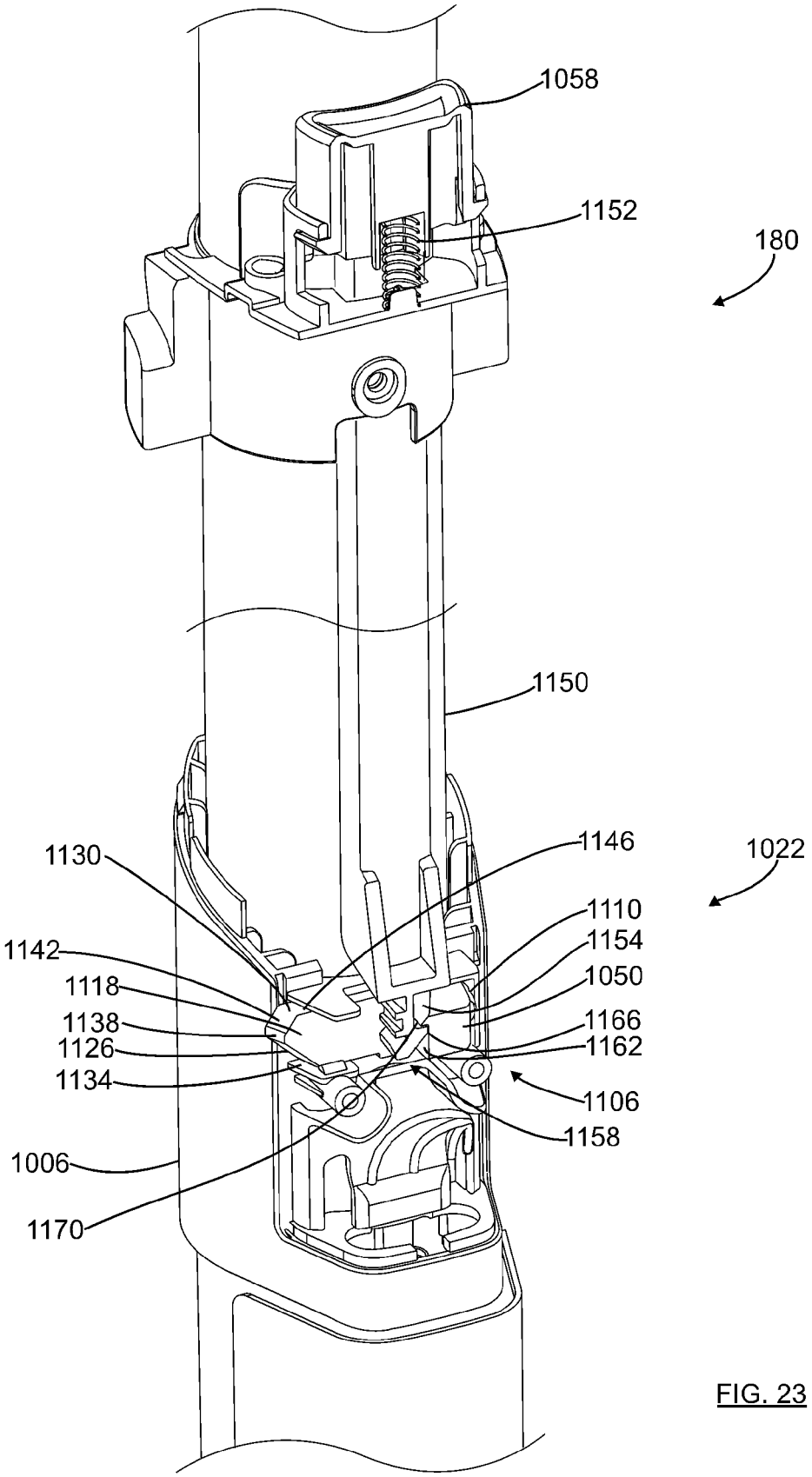
Figure 25:
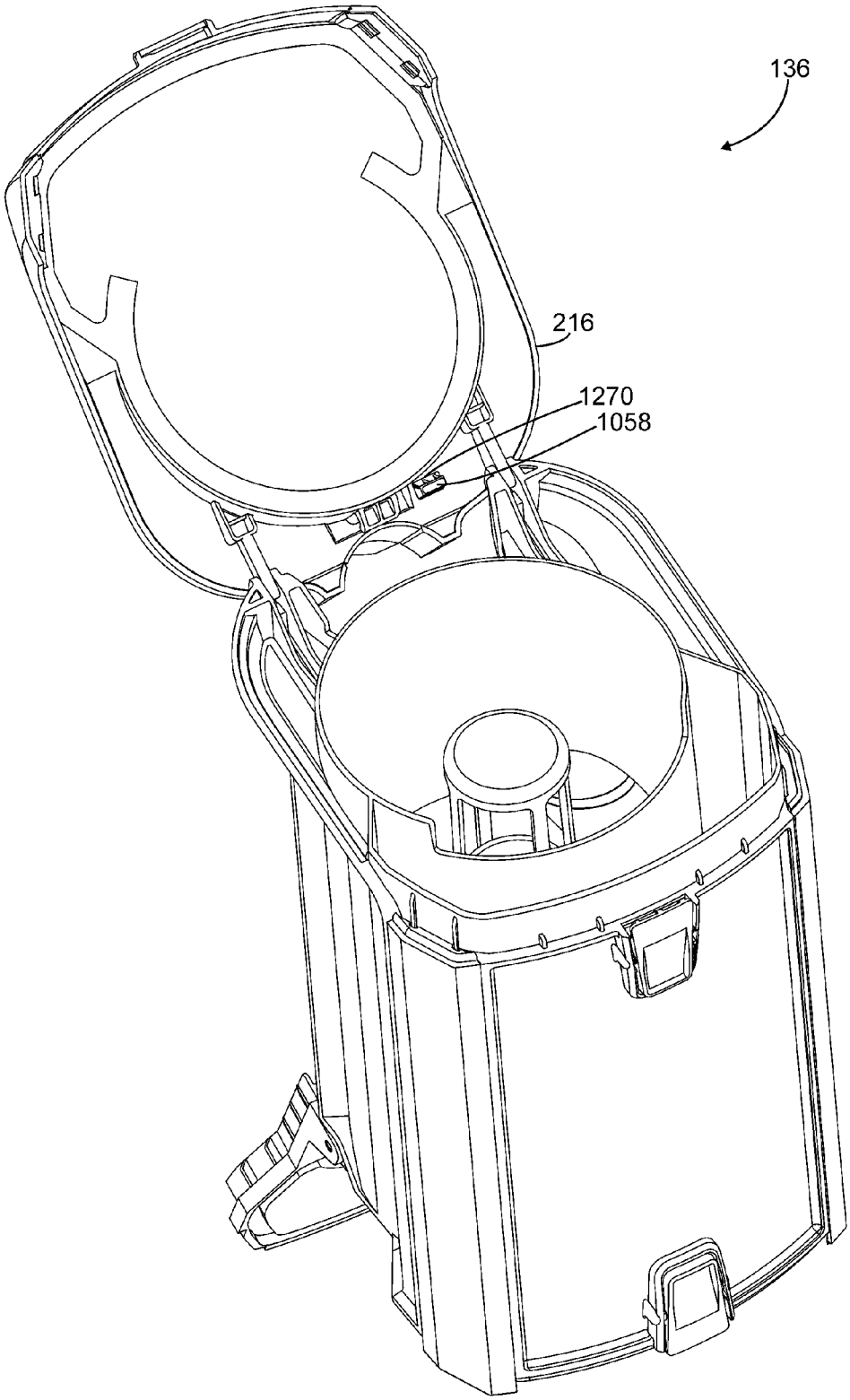
Figure 26:
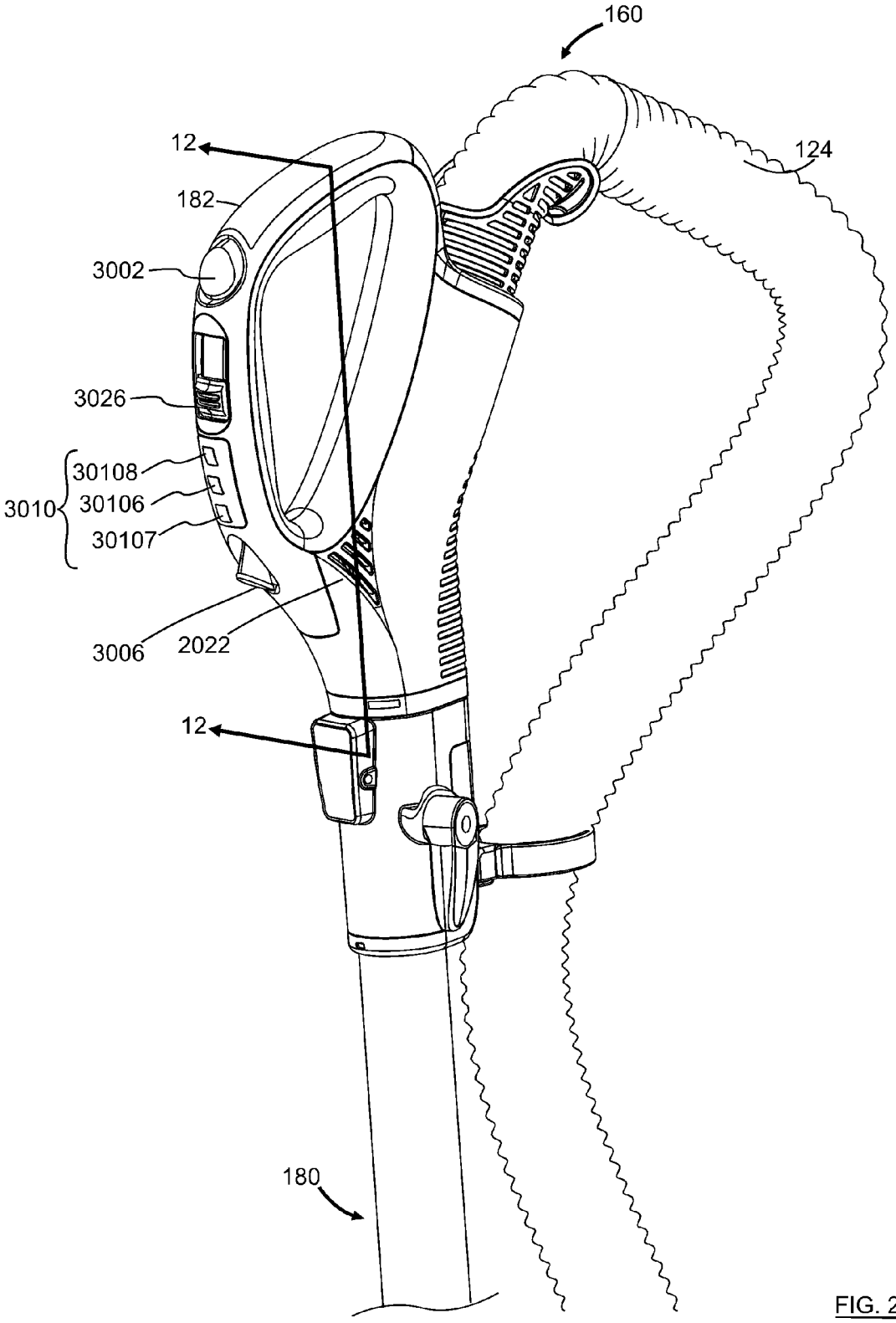
Figure 27B:
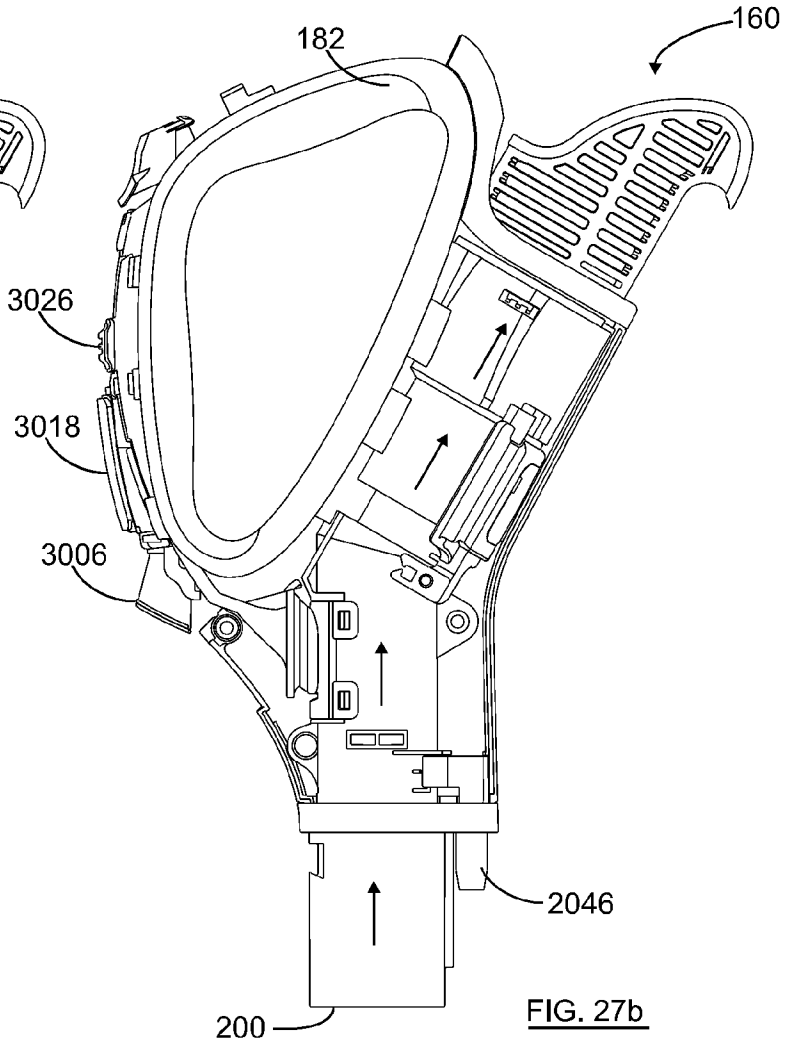
Figure 27A:
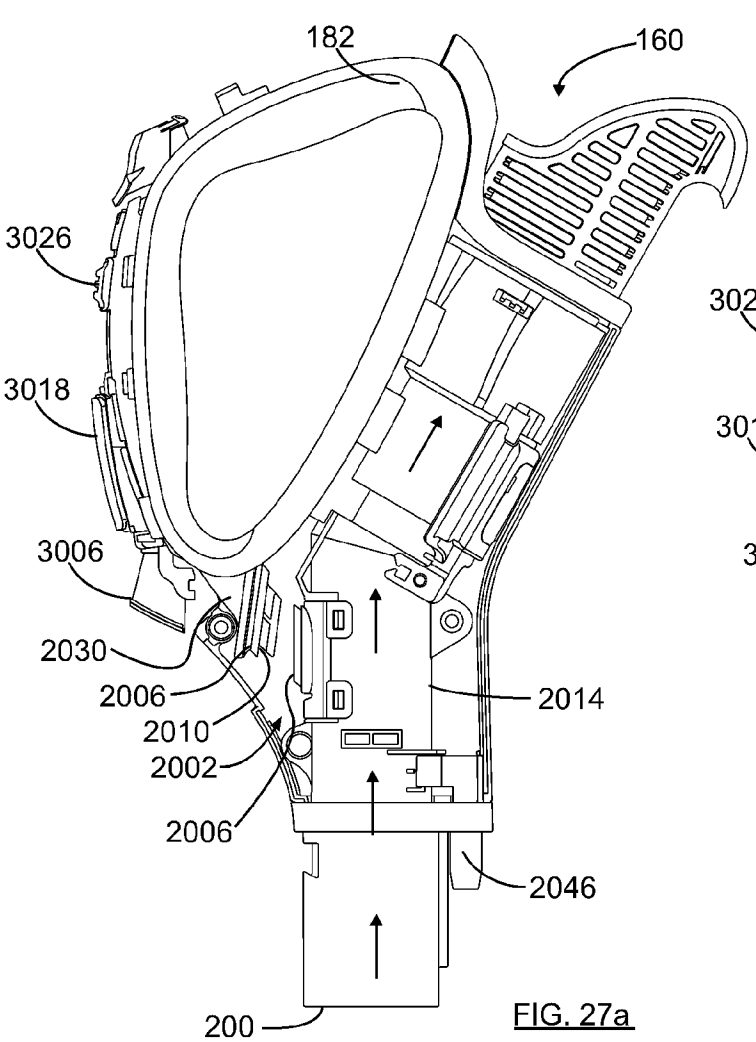
Figure 28:
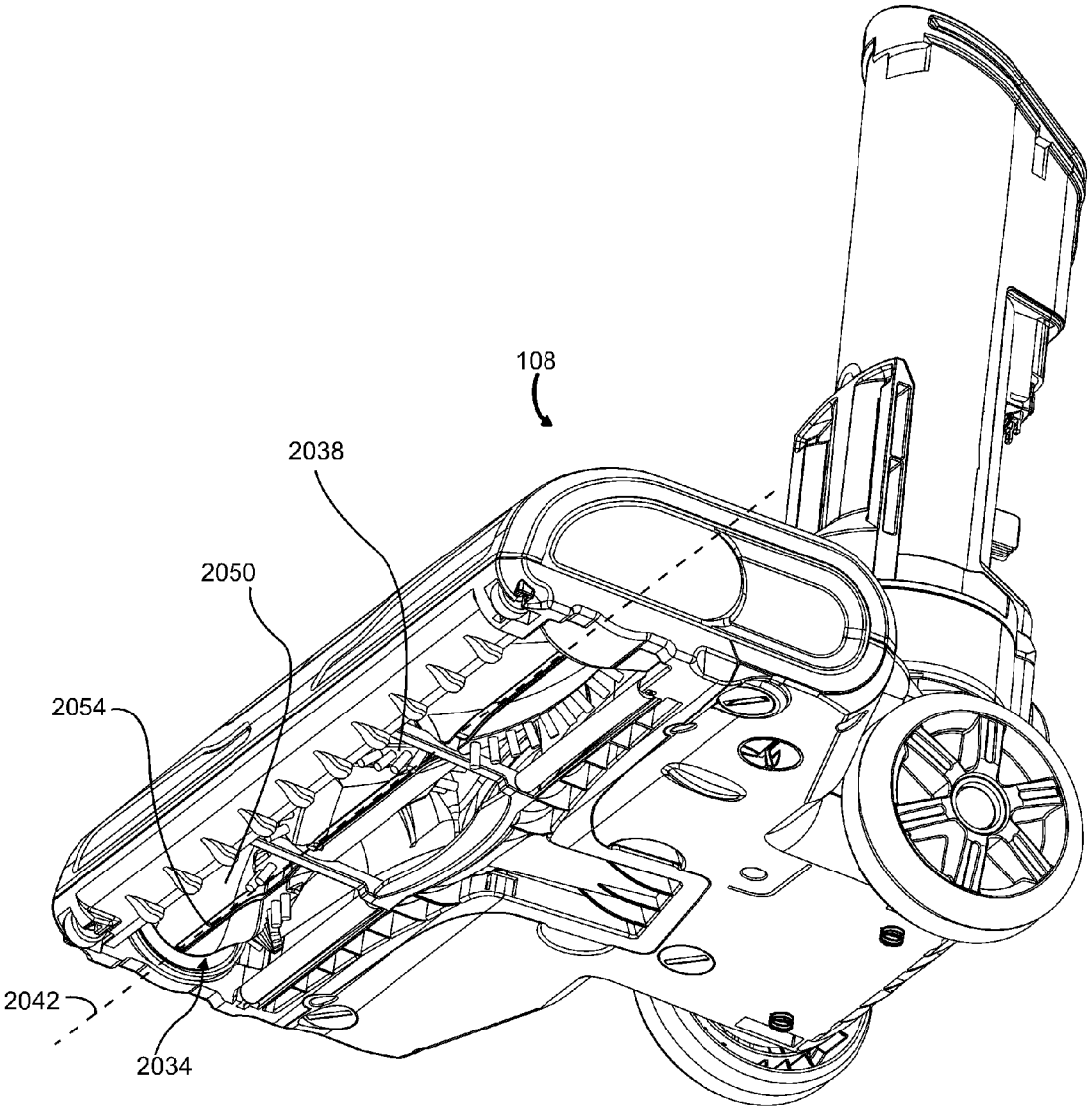
Figure 29:
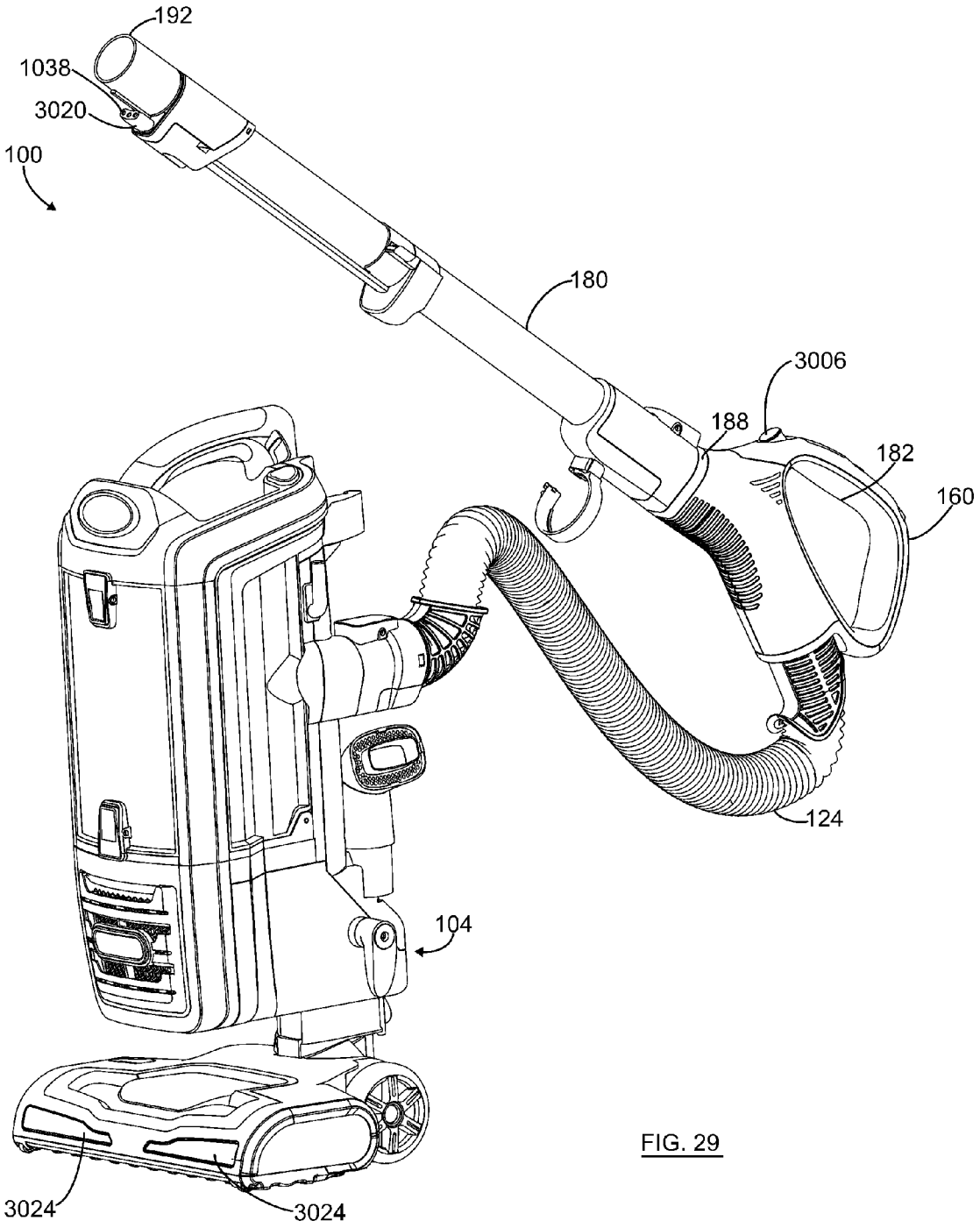
Figure 30:
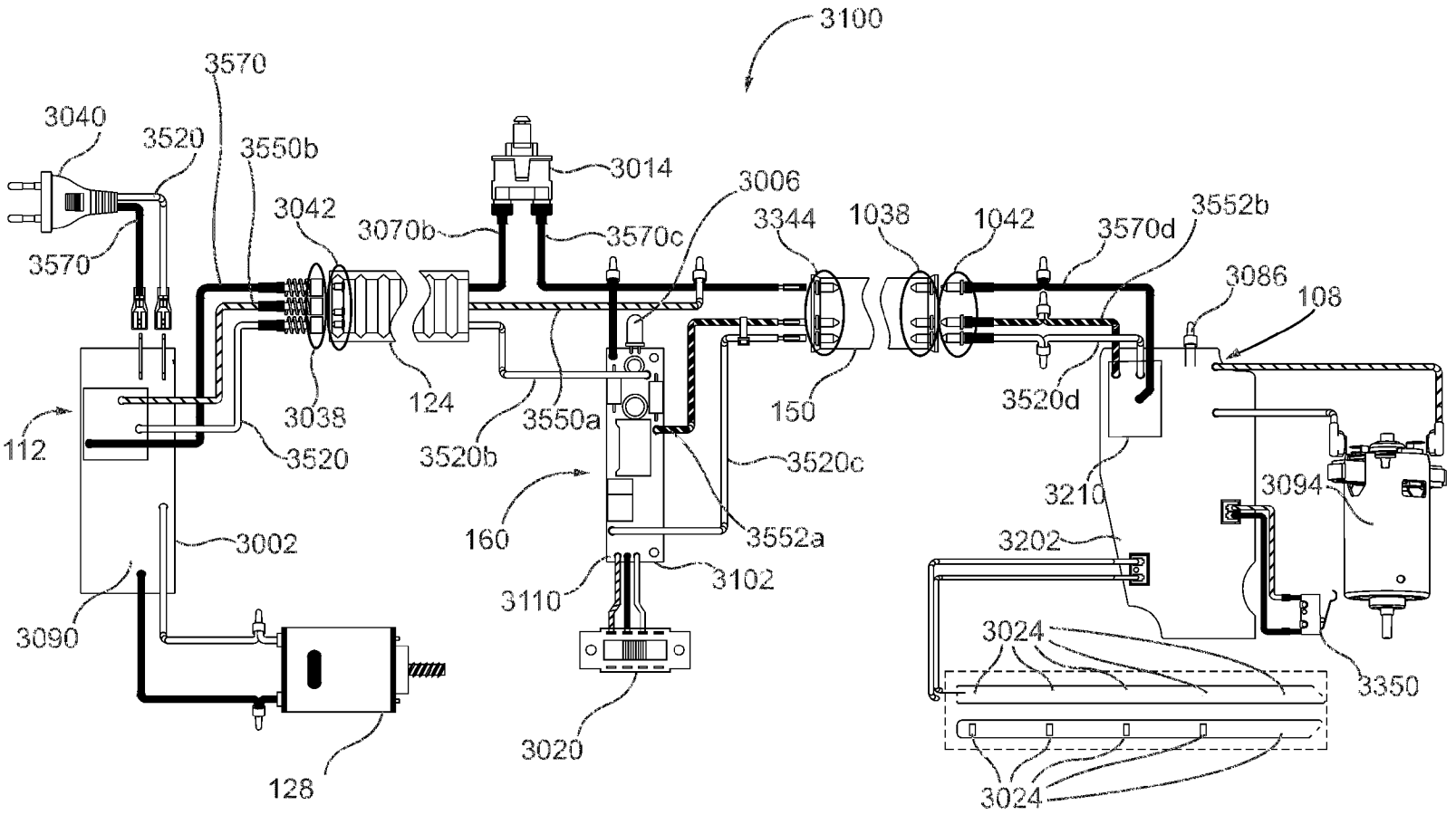
Figure 31:
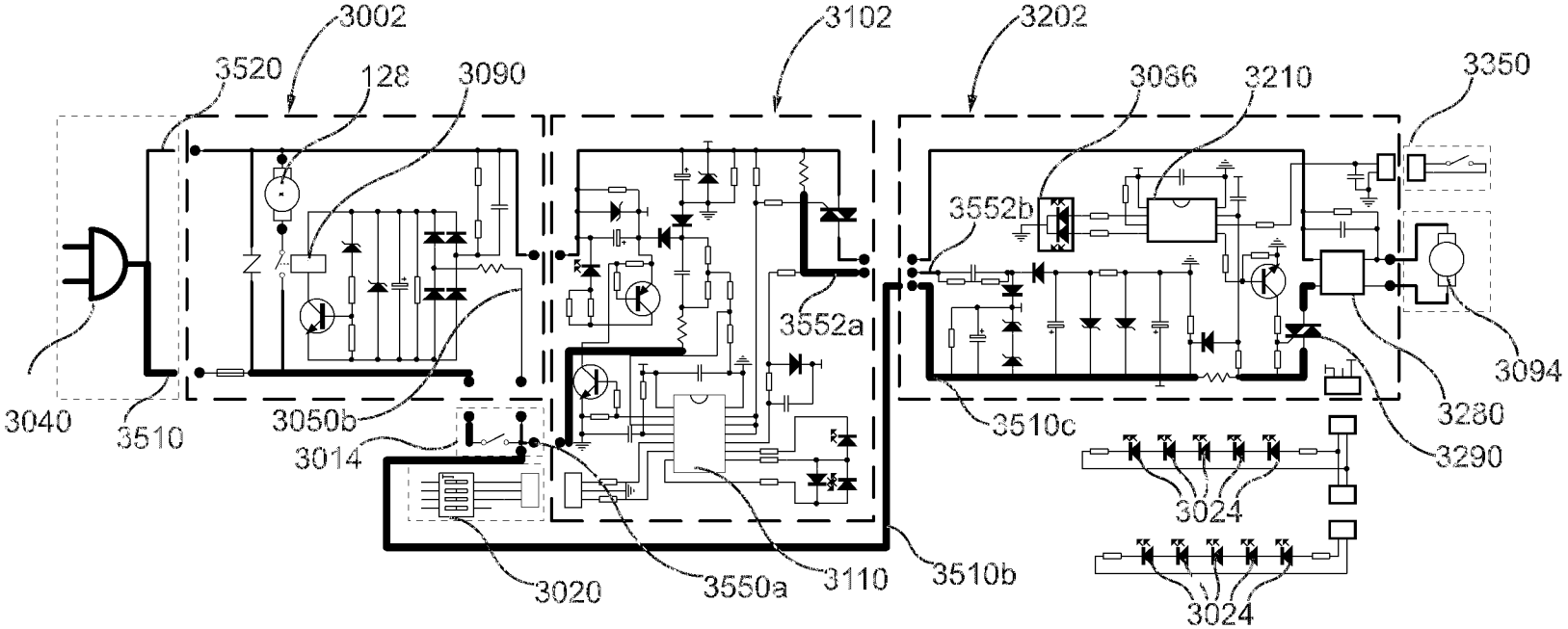
Figure 32:
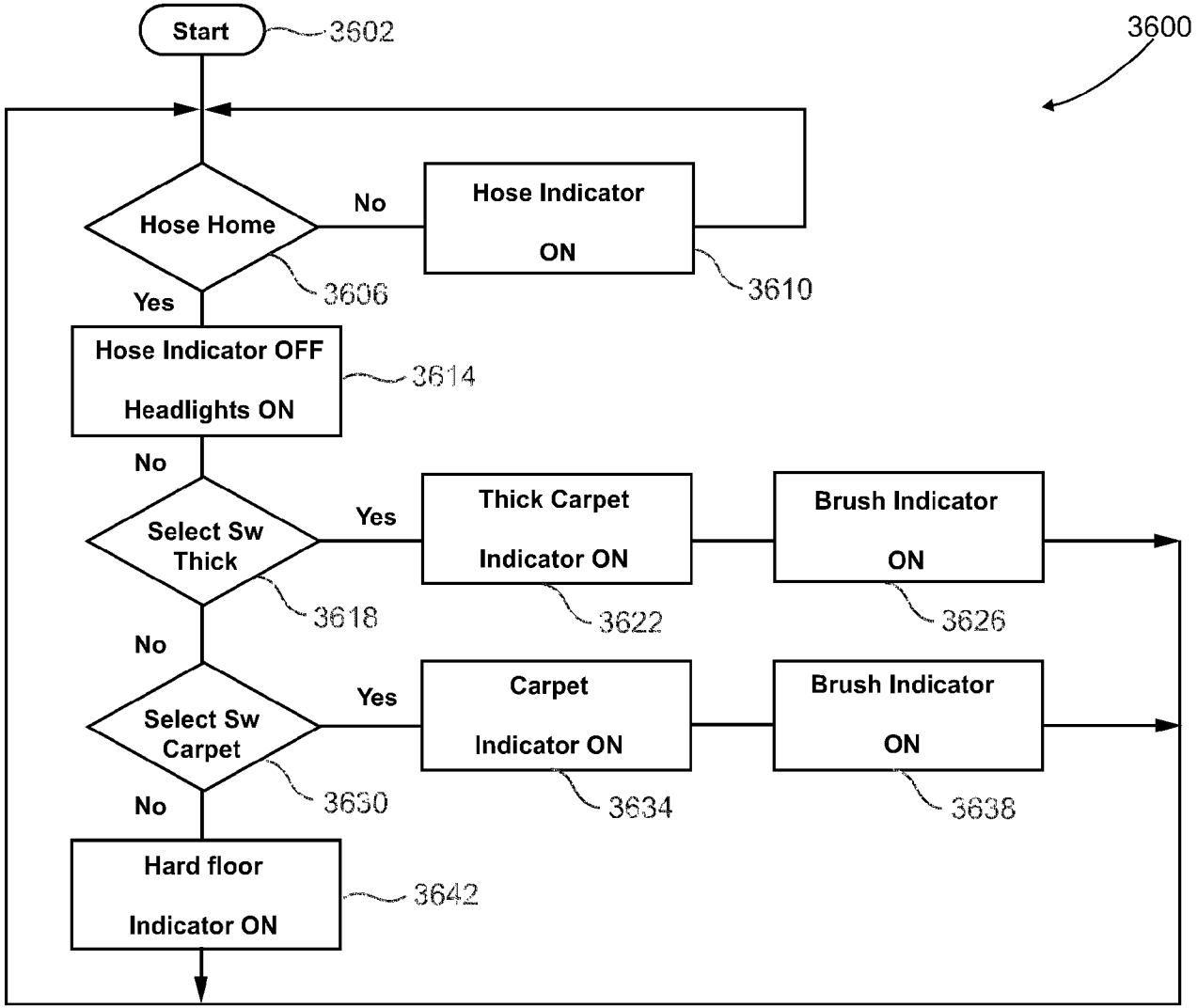

FIG. 3*a* is a side elevation view of the surface cleaning apparatus of FIG. 1, in a storage position;

FIG. 4 is a partial cross-sectional view taken along line 4-4 in FIG. 1;

FIG. 5 is a rear perspective view of the surface cleaning apparatus of FIG. 1, in a partially disassembled configuration;

FIG. 6 is a front perspective view of the surface cleaning apparatus of FIG. 1, with the pod removed but still in air flow communication with the surface cleaning head;

FIG. 7 is a front perspective view of the surface cleaning apparatus of FIG. 1, in an above-floor cleaning configuration;

FIG. 8 is a front perspective view of the surface cleaning apparatus of FIG. 1 wherein the cyclone bin assembly has been removed;

FIG. 9 is a rear perspective view of the portable surface cleaning unit with the cyclone bin assembly removed;

FIG. 10 is a front perspective view of the cyclone bin assembly of FIG. 1 with the lid in an open position;

FIG. 11 is a rear perspective view of the wand of FIG. 1 disconnected from the upper portion;

FIG. 12 is a top plan view of the upper portion and the surface cleaning head of FIG. 1;

FIG. 13 is a top plan view of the surface cleaning apparatus of FIG. 1, with the wand disconnected from the upper portion;

FIG. 14 is a partial cross-sectional view taken along line 4-4 in FIG. 1;

FIG. 15 is a partial rear perspective view of the wand of FIG. 1 disconnected from the upper portion;

FIG. 16 is a rear perspective view of the surface cleaning unit of FIG. 1;

FIG. 17 is a bottom plan view of the surface cleaning unit of FIG. 1;

FIG. 18 is a front elevation view of the upper portion and surface cleaning head of FIG. 1;

FIG. 19 is a cross-sectional view taken alone line 19-19 in FIG. 11;

FIG. 20 is a cross-sectional view taken alone line 20-20 in FIG. 14;

FIG. 21 is a rear elevation view of the surface cleaning unit of FIG. 1;

FIGS. 22*a*-22*d* are rear perspective views of the surface cleaning unit of FIG. 1 with a rear wall removed and the locking mechanism in different positions;

FIG. 23 is a partial rear perspective view of the wand of FIG. 11;

FIGS. 24*a*-24*d* are partial rear perspective views of the wand of FIG. 11 with an outer wall removed;

FIG. 25 is a front perspective view of the cyclone bin assembly of FIG. 1 with the lid in an open position; and FIG. 26 is a front perspective view of the handle of FIG. 1;

FIGS. 27*a* and 27*b* are cross sectional views taken along line 12-12 in FIG. 26 showing a brush control in different positions;

FIG. 28 is a bottom perspective view of the surface cleaning head and the upper portion of FIG. 1;

FIG. 29 is a front perspective view of the surface cleaning apparatus of FIG. 1, in an above-floor cleaning position;

FIG. 30 is an abstracted schematic diagram of the electric circuits and conductors of the surface cleaning apparatus of FIG. 1;

FIG. 31 is an example circuit diagram of the electric circuits and conductors of FIG. 30; and, FIG. 32 is an example logic flow diagram executed by one or more processors of the surface cleaning apparatus of FIG. 1.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

General Description of an Upright Vacuum Cleaner

Figure 2:
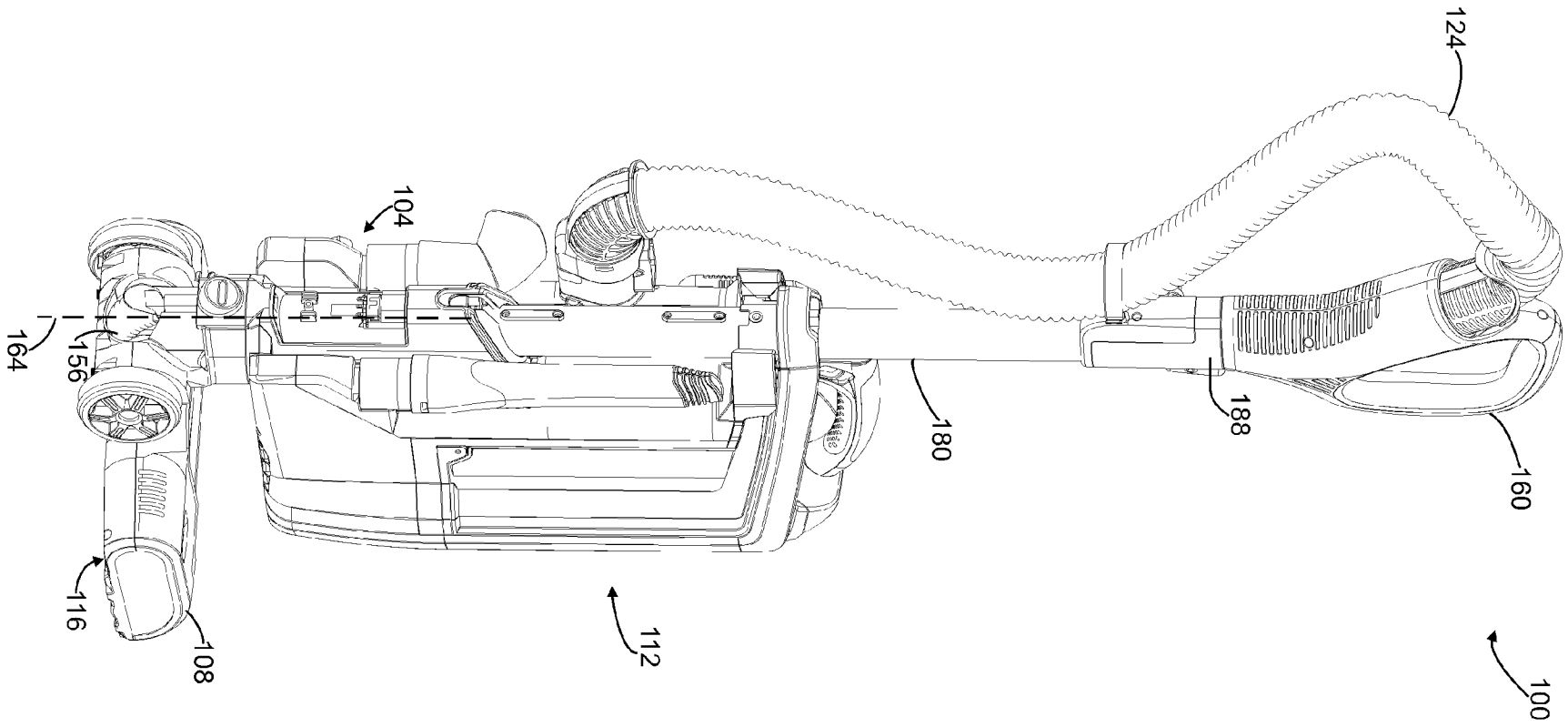
FIG. 2 is a rear perspective view of the surface cleaning apparatus of FIG. 1, in the storage position.

Referring to FIGS. 1-3, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor.

In the illustrated example, the surface cleaning apparatus 100 includes an upper portion or support structure 104 that is movably and drivingly connected to a surface cleaning head 108. A surface cleaning unit 112 is mounted on the upper portion 104. The surface cleaning apparatus 100 also has at least one dirty air inlet 116, at least one clean air outlet 120, and an air flow path or passage extending therebetween. In the illustrated example, the air flow path includes at least one flexible air flow conduit member (such as a hose 124 or other flexible conduit). Alternatively, the air flow path may be formed from rigid members.

At least one suction motor and at least one air treatment member are positioned in the air flow path to separate dirt and other debris from the airflow. The suction motor and the air treatment member may be provided in the upper portion and/or the surface cleaning head of an upright surface cleaning apparatus. Preferably, the suction motor and the air treatment member are provided in a removable surface cleaning unit. The air treatment member may be any suitable air treatment member, including, for example, one or more cyclones, filters, and bags, and preferably the at least one air treatment member is provided upstream from the suction motor. Preferably, as exemplified in FIG. 4, the portable surface cleaning unit 112 includes both the suction motor 128, which may be in a motor housing 132, and an air treatment member, which may be in the form of a cyclone bin assembly 136. Accordingly, surface cleaning unit 112 may be a hand vacuum cleaner, a pod or the like. The motor housing 132 can include at least one removable or openable door 140 which may allow a user to access the interior of the motor housing 132, for example to access the motor 128, a filter or any other component within the housing 132. The cyclone bin assembly 136 includes a cyclone chamber 144 and a dirt collection chamber 148.

In the embodiment shown, the surface cleaning head 108 includes the dirty air inlet 116 in the form of a slot or opening 152 (FIG. 4) formed in a generally downward facing surface of the surface cleaning head 108. From the dirty air inlet 116, the air flow path extends through the surface cleaning head 108, and through an up flow conduit 156 (FIG. 2) in the upper portion 104 to the surface cleaning unit 112. In the illustrated example, the clean air outlet 120 is provided in the front of the surface cleaning unit 112, and is configured to direct the clear air in a generally lateral direction, toward the front of the apparatus 100.

A handle or handle assembly 160 is drivingly connected to the upper portion 104 to allow a user to manipulate the surface cleaning apparatus 100. Referring to FIGS. 2, 3, and 3*a*, the upper portion extends along an upper axis 164 and is moveably mounted to the surface cleaning head 108. In the illustrated example, the upper portion 104 is pivotally mounted to the surface cleaning head via a pivot joint 168. The pivot joint 168 may be any suitable pivot joint. In this embodiment, the upper portion 104 is movable, relative to the surface cleaning head 108, between a storage position (FIG. 1), and a use or floor cleaning position (FIG. 3). In the floor cleaning position, the upper portion 104 may be inclined relative to the surface being cleaned, and an angle 172 between a plane 176 parallel to the surface and the upper axis 164 may be between about 20° and about 85°. In the storage position (FIG. 3*a*), the upper portion 104 may be inclined relative to the surface being cleaned, and the angle 172 between the plane 176 parallel to the surface and the upper axis 164 may be between about 85° and 135°.

Alternatively, or in addition to being pivotally coupled to the surface cleaning head 108, the upper portion 104 may also be rotatably mounted to surface cleaning head 108. In this configuration, the upper portion 104, and the surface cleaning unit 112 supported thereon, may be rotatable about the upper axis 164. In this configuration, rotation of the upper portion 104 about the upper axis 164 may help steer the surface cleaning head 108 across the floor (or other surface being cleaned). Alternately, the upper portion 104 may be pivotally mounted to the surface cleaning head about a second pivot axis, or otherwise moveable mounted with respect to the surface cleaning head, to provide steering.

It will be appreciated that the forgoing discussion is exemplary and that an upright vacuum cleaner may use a surface cleaning head, the surface cleaning unit and upper portion of any design and they may be moveably connected together by any means known in the art.

Cleaning Modes

The following is a description of the components of the surface cleaning apparatus that are configured to be disconnectable that may be used by itself in any surface cleaning apparatus or in any combination or sub-combination with any other feature or features disclosed herein.

Accordingly, in one aspect, the upright vacuum cleaner 100 may be operable in a variety of different functional configurations or operating modes. The versatility of operating in different operating modes may be achieved by permitting the surface cleaning unit 112 to be detachable, e.g., from the upper portion 104. Alternatively, or in addition, further versatility may be achieved by permitting portions of the vacuum cleaner (e.g., one or more of a surface cleaning head, an above floor cleaning wand, a handle assembly, a hose) to be detachable from each other at a plurality of locations, and re-connectable to each other in a variety of combinations and configurations.

In the examples illustrated, mounting the surface cleaning unit 112 on the upper portion 104 increases the weight of the upper portion 104 and can affect the maneuverability and ease of use of the surface cleaning apparatus 100. With the surface cleaning unit 112 attached, the vacuum cleaner 100 may be operated like a traditional upright style vacuum cleaner, as illustrated in FIGS. 1-3.

Alternatively, in some cleaning situations the user may preferably detach the surface cleaning unit 112 from the upper portion 104 and choose to carry the surface cleaning unit 112 (e.g. by hand or by a strap) separately from the upper portion 104, while still using the upper portion 104 to drivingly maneuver the surface cleaning head 108. When the surface cleaning unit 112 is detached, a user may more easily maneuver the surface cleaning head 108 around or under obstacles, like furniture and stairs.

To enable the vacuum suction generated by the surface cleaning unit 112 to remain in airflow communication with the surface cleaning head 108 when the surface cleaning unit 112 is detached from the support structure 104, the airflow connection between the surface cleaning head 108 and the cleaning unit 112 is preferably at least partially formed by a flexible conduit, such as flexible hose 124, which may be an electrified hose. Preferably, the hose 124 is extensible and more preferably is elastically or resiliently extensible. The use of a flexible conduit allows a user to detach the surface cleaning unit 112 and maintain a flow connection between the portable surface cleaning unit 112 and the surface cleaning head 108 without having to reconfigure or reconnect any portions of the airflow conduit 184 (FIG. 6).

In the example shown, the airflow path between the surface cleaning head 108 and the cleaning unit 112 further includes an above floor cleaning wand 180. Wand 180 may be positioned upstream of hose 124 and downstream of surface cleaning head 108. Preferably, wand 180 may be drivingly connected to upper portion 104 so that wand 108 may be used to direct surface cleaning head 108 (e.g., forwardly and rearwardly) and, optionally, for also steering surface cleaning head 108. Accordingly, wand 180 comprises a rigid airflow conduit having any suitable shape. For example, wand 180 may be straight as shown or it may be curved or bent. In some embodiments, wand 180 may be reconfigurable. For example, wand 108 may have upper and lower sections that are moveably mounted with respect to each other (e.g., pivotally connected) so that wand 180 may be converted from a straight configuration to a bent configuration. Further, wand 180 may have any suitable cross-sectional shape, such as a circular cross-section as shown, or another cross-sectional shape such as square, triangular, or another regular or irregular shape.

Wand 180 may be telescopic so that it is extendable.

In order to enable a user to use wand 180 to remotely maneuver surface cleaning head 108, wand 180 may be provided with a handle assembly. Preferably, handle assembly or handle 160 is positioned proximate an upper (i.e. downstream) end 188 of wand 180. For example, handle 160 may be connected to one or both of wand 180 and hose 124. Optionally, handle 160 may form part of the airflow path between wand 180 and hose 124. Alternatively, handle 160 may be peripherally attached to one or both of wand 180 and hose 124 without participating in the airflow communication between wand 180 and hose 124.

A user may grasp a hand grip portion 182 of handle 160 to manipulate wand 180 (e.g. for moving upper portion 104 and steering surface cleaning head 108). In alternative embodiments, surface cleaning apparatus 100 may not include a handle 160 and instead a user may grasp wand 180 directly.

Reference is now made to FIG. 5. As shown, upper portion 104 is moveably mounted with respect to surface cleaning head 108. Upper portion 104 may be connected to surface cleaning head 108 by any means known in the art, (e.g., it may be pivotally mounted, rotationally mounted or the like). As exemplified, pivot joint 168 permits upper portion 104 to tilt and/or pivot with respect to surface cleaning head 108.

One or both of wand 180 and surface cleaning unit 112 may be selectively attached or detached from upper portion 104. As exemplified, each of wand 180 and surface cleaning unit 112 is selectively attachable or detachable from upper portion 104. An advantage of this design is that a user may convert the vacuum cleaner to a surface cleaning mode by removing the wand without having to remove surface cleaning unit 112. Preferably, each of wand 180 and surface cleaning unit 112 may be selectively connected or disconnected from upper portion 104 independently of the other. For example, wand 180 and surface cleaning unit 112 may be connected or disconnected from upper portion 104 in any order, sequentially or simultaneously. This may simplify the reconfiguration of surface cleaning apparatus 100 into different cleaning modes without requiring disruption to the operation of surface cleaning apparatus 100.

As exemplified, when upstream end 192 of wand 180 is connected to upper portion 104, the surface cleaning head 108 participates in the airflow path in a floor cleaning mode, e.g., for cleaning floors, stairs, and the like. In such a case, the surface cleaning unit 112 may be mounted on upper portion 104, for supporting the weight of surface cleaning unit on upper portion 104 (e.g., as shown in FIG. 3 which exemplifies a traditional floor cleaning mode for an upright vacuum cleaner). Alternately, surface cleaning unit 112 may be dismounted from upper portion 104 and carried by hand, worn as a backpack, or placed on the floor for example while wand 180 is connected to surface cleaning head 108 (e.g., as shown in FIG. 6 which exemplifies an alternate floor cleaning mode for an upright vacuum cleaner).

As exemplified, wand 180 may be disconnected from upper portion 104 for use in an above-floor cleaning mode. In one embodiment, surface cleaning unit 112 may be mounted on upper portion 104, for supporting the weight of surface cleaning unit on upper portion 104 while wand 180 is used in the above floor cleaning mode (e.g., as shown in FIG. 7). Alternately, in another optional embodiment, surface cleaning unit 112 may also be dismounted from upper portion 104 and carried by hand, worn as a backpack, or placed on the floor for example while wand 180 is used in the above floor cleaning mode.

Wand 180 may be selectively connected or disconnected from the airflow path, such as when the extension in reach it provides is not required. For example, downstream end 188 of wand 180 may be separated from handle 160. The reduced reach provided by this configuration may be advantageous where the user may wish to manipulate the cleaning surface by hand (e.g. separate cushions in a couch) while cleaning, or where the user may require fine control (e.g. to avoid sucking up objects on the cleaning surface).

If Wand 180 and surface cleaning unit 112 are each individually removable, then they may each be independently mounted to upper portion 104. Wand 180 and surface cleaning unit 112 may connect to upper portion 104 in any suitable fashion. In the example shown, wand 180 is inserted into upper portion 104, and surface cleaning unit 112 is mounted to an exterior of upper portion 104. In such a case, upper portion 104 may provide part or all of the air flow path from surface cleaning head 108 to wand 180. In other embodiments, upper portion 104 need not be part of the air flow path. For example, wand 180 may be mounted to the exterior of upper portion 104 and the inlet end may seat on an outlet end of a duct provided on the outer surface of the upper portion 104.

Referring to FIG. 6, when the surface cleaning apparatus 100 is in use, a user may detach the surface cleaning unit 112 from the upper portion 104 without interrupting the airflow communication between the cleaning unit 112 and the surface cleaning head 108. This allows a user to selectively detach and re-attach the cleaning unit 112 to the support structure 104 during use without having to stop and reconfigure the connecting hose 124 or other portions of the airflow conduit 184. As exemplified, wand 180 is attached to upper portion 104 and surface cleaning unit 112 is detached from upper portion 104.

FIG. 6 illustrates a configuration in which the vacuum cleaner 100 can be operated with the surface cleaning unit 112 detached from the upper portion 104 and the air flow path between the surface cleaning unit 112 and the surface cleaning head 108 remains intact. In this configuration, upper portion 104 may provide a connection between wand 180 and surface cleaning head 108, which may permit surface cleaning head 108 to be driven by manipulating wand 180.

In addition to being operable to clean floors or surfaces, the vacuum cleaner may be operated in a variety of cleaning modes that do not include use of the surface cleaning head, and may be generally described as above floor cleaning modes. This can generally include cleaning furniture, walls, drapes and other objects as opposed to cleaning a large, planar surface.

In one example of an above floor cleaning mode, as exemplified in FIG. 7, the surface cleaning unit 112 can remain mounted on the upper portion 104. This eliminates the need for the user to separately support the weight of the surface cleaning unit 112 in an above floor cleaning mode. In the illustrated configuration, the surface cleaning unit 112 may remain mounted on the upper portion 104 and the wand 180 may be detached from upper portion 104 to provide an extended reach for above floor cleaning. Optionally, additional accessory tools may be coupled to the upstream end 192 of wand 180, including for example a crevice tool, a cleaning brush (optionally an electrically powered brush or an air driven turbo brush) and any other type of accessory including a power tool such as a sander.

Further, as illustrated in FIG. 5, the upstream end 200 of the handle 160 may be separated from the downstream end 188 of wand 180. In this configuration the upstream end 200 of the handle 160 can function as the dirty air inlet for the vacuum cleaner 100. Optionally, accessory tools, such as wands, crevasse tools, turbo brushes, hoses or other devices may be coupled to the upstream end 200 of the handle 160.

In another example of an above floor cleaning mode, as exemplified in FIG. 5, the surface cleaning unit 112 and wand 180 can both be detached from the upper portion 104. The upstream end 200 of handle 160 may be selectively connected or disconnected from downstream end 188 of wand 180 as desired. This configuration may be advantageous when surface cleaning unit 112 must be held above the floor (e.g. while the user is standing on a ladder). In this case, the upper portion 104 and surface cleaning head 108 may add unnecessary weight to the surface cleaning unit 112. This configuration may also be advantageous when the surface cleaning unit 112 is to be rested on a sloped surface. In this case, the rear wheels 204 and the front wheels or glides (not shown) of surface cleaning head 108 may allow surface cleaning unit 112 to roll away. By detaching surface cleaning unit 112 from surface cleaning head 108, surface cleaning unit 112 may be placed directly on the sloped surface. Optionally, additional accessory tools may be coupled to the upstream end 192 of the wand 180.

Optionally, one or more auxiliary support members, including for example a wheel and a roller, can be provided on the rear of the surface cleaning apparatus and/or the upper portion and configured to contact the floor (or other surface) when the upper portion is inclined or placed close to the surface. Providing an auxiliary support member may help carry some of the weight of the surface cleaning unit and/or upper portion when in a generally horizontal configuration. The auxiliary support member may also help the upper portion 104 and/or surface cleaning unit 112 to roll relatively easily over the floor when in a generally horizontal position. This may help a user to more easily maneuver the upper portion and/or surface cleaning unit under obstacles, such as a bed, cabinet or other piece of furniture.

Removable Cyclone

The following is a description of a removable cyclone that may be used by itself in any surface cleaning apparatus or in any combination or sub-combination with any other feature or features disclosed herein.

Reference is now made to FIGS. 8 and 9. Optionally, the cyclone bin assembly 136 may be detachable from the motor housing 132. Providing a detachable cyclone bin assembly 136 may allow a user to carry the cyclone bin assembly 136 to a garbage can for emptying, without needing to carry or move the rest of the surface cleaning apparatus 100 or the surface cleaning unit 112. Preferably, the cyclone bin assembly 136 can be separated from the motor housing 132 while the surface cleaning unit 112 is mounted on the upper portion 104 and also when the surface cleaning unit 112 is separated from the upper portion 104. FIG. 8 illustrates an embodiment where the cyclone bin assembly 136 is removable as a closed module, which may help prevent dirt and debris from spilling out of the cyclone bin assembly 136 during transport.

Optionally, as exemplified, removing the cyclone bin assembly 136 reveals a pre-motor filter chamber 208 that is positioned in the air flow path between the cyclone bin assembly 136 and the suction motor 128. One or more filters may be provided in the pre-motor filter chamber 208 to filter the air exiting the cyclone bin assembly 136 before it reaches the motor 128. In the illustrated example, the pre-motor filter includes at least a foam filter 212 positioned within the pre-motor filter chamber 208. Preferably, filter 212 is removable to allow a user to clean and/or replace the filter 212 when it is dirty. Optionally, part or all of the sidewalls of the pre-motor filter chamber or housing 208 can be at least partially transparent so that a user can visually inspect the condition of the filter 212 without having to remove the cyclone bin assembly 136.

In some embodiments, cyclone bin assembly 136 may extend below and partially surround pre-motor filter chamber 208. In the illustrated embodiment, cyclone bin assembly 136 includes a cyclone chamber 144 aligned above pre-motor filter chamber 208 and a dirt collection chamber 148 extending below and forward of pre-motor filter chamber 208. This may provide an enlarged dirt collection chamber 148 in a compact arrangement. In turn, the capacity of dirt collection chamber 148 may be increased which may permit surface cleaning apparatus 100 to be emptied less frequently. Still, in alternative embodiments, cyclone bin assembly 136 may be wholly positioned to one side of pre-motor filter chamber 208 (e.g. above pre-motor filter chamber 208).

Preferably, cyclone bin assembly 136 may be releasably connected to surface cleaning unit 112. For example, surface cleaning unit 112 may include a locking mechanism having a locked position, in which cyclone bin assembly 136 may be inhibited from separating from surface cleaning unit 112, and an unlocked position, in which cyclone bin assembly 136 may be freely removed from surface cleaning unit 112. As exemplified, cyclone bin assembly 136 includes a locking mechanism 216 for releasably securing cyclone bin assembly 136 to surface cleaning unit 112. In the example shown, locking mechanism 216 includes a locking member (or latch) 218 which may releasably engage a mating recess 220 in surface cleaning unit 112. Recess 220 may be sized and positioned to receive locking mechanism 216 when cyclone bin assembly 136 is positioned in place on surface cleaning unit 112. Locking mechanism 216 may interfere with the removal of cyclone bin assembly 136 from surface cleaning unit 112 by the interaction of locking member 218 with recess 220. For example, a groove provided on latch 218 may engage the wall in which recess 220 is located.

Locking mechanism 216 may also include a lock-release actuator 224 which may be activated to move locking mechanism 216 to the unlocked position. Preferably, lock-release actuator 224 may be located on or proximate to handle 226 of cyclone bin assembly 136 so it may be actuated by a user using the same had as is used to hold handle 226. This may permit a user to simultaneously grasp handle 226 and activate lock-release actuator 224. As exemplified, a rear portion of handle 226 includes a lock-release actuator 224. Activating lock-release actuator 224 may retract locking member 218 from recess 220 (e.g., by pivoting or rotating or translating latch 218 towards cyclone bin assembly 136) to place locking mechanism 216 in the unlocked position in which cyclone bin assembly 136 may be removed from surface cleaning unit 112.

Referring now to FIGS. 9 and 10, cyclone bin assembly 136 may include one or more of an openable lid or bottom. This may provide access to empty dirt collection chamber 148 and/or cyclone chamber 144. As exemplified, cyclone bin assembly 136 includes an openable lid 228. Lid 228 may be movable between a closed position (FIG. 9) in which lid 228 closes an upper end of cyclone bin assembly 136, and an open position (FIG. 10) in the upper end of cyclone bin assembly 136 is open.

Lid 228 of cyclone bin assembly 136 may be completely removed from cyclone bin assembly 136 in the open position. Alternatively, lid 228 may remain attached to cyclone bin assembly 136 in the open position. As exemplified, cyclone bin assembly 136 may include hinges 232 that pivotally connect lid 228 to cyclone bin assembly 136. This may permit lid 228 to pivot to an open position while conveniently remaining connected to cyclone bin assembly 136.

Wand Alignment

The following is a description of the wand alignment mechanism to assist in aligning the wand during insertion of the wand into the upper portion that may be used by itself in any surface cleaning apparatus or in any combination or sub-combination with any other feature or features disclosed herein.

Referring to FIG. 5, wand 180 may be removably mounted to upper portion 104 using any suitable mounting apparatus. Wand 180 and upper portion 104 may be configured to provide support and/or positioning or alignment of the wand 180 relative to the upper portion 104. When connected to upper portion 104, wand 180 may be stabilized to provide a driving connection between wand 180 and upper portion 104.

In the example shown, upper portion 104 may be configured to receive an upstream end of wand 180 to connect wand 180 to upper portion 104. When inserted, the outer wall of wand 180 and the inner wall of upper portion 104 may contact each other over a sufficient length to stabilize wand 180 so that upper portion 104 may provide a driving connection between wand 180 and surface cleaning head 108. This may permit upper portion 104 to transmit forces applied to wand 180 (e.g. via handle 160 or directly to wand 180) to surface cleaning head 108 by way of, e.g., pivot joint 168. For example, upper portion 104 may be rigidly connected to wand 180 to reduce or eliminate play between upper portion 104 and wand 180. This may improve the handling of surface cleaning head 108 and thereby improve the user experience of apparatus 100.

Reference is now to FIG. 11. As exemplified, wand 180 includes an upstream portion 1002 bordered by upstream end 192. Upstream end 192 may define a wand air inlet for receiving dirty air to be communicated downstream through wand 180 to downstream end 188 (FIG. 5). Further, upper portion 104 is shown including a downstream portion 1006 bordered by downstream end 1010. As shown, downstream portion 1006 may include or surround an air outlet for discharging air received from surface cleaning head 108, downstream (e.g. to wand 180). For example, downstream portion 1006 may comprise a cowl that surrounds and extends upwardly from the outlet of an air flow path extending through the surface cleaning head 108.

Wand 180 may be sized and shaped to be partially received inside upper portion 104. As exemplified, upstream portion 1002 of wand 180 may be removably receivable inside downstream portion 1006 of upper portion 104. Downstream end 1010 of upper portion 104 may define an opening 1014 for receiving upstream end 192 of wand 180.

When wand 180 is received inside upper portion 104, wand 180 and upper portion 104 may form a connection that provides stability to wand 180. For example, mating elements of upper portion 104 and wand 180 may engage upon reception of wand 180 inside upper portion 104, whether automatically (i.e. without user action) by the insertion of wand 180 into upper portion 104 or by manual user-actuation of a retention member. Referring now to FIGS. 11-13, downstream portion 1006 may include inner walls 1018 having a transverse profile that corresponds to the transverse profile of outer walls 1022 of the upstream portion 1002 of wand 180. For example, the transverse profile of inner walls 1018 may have a substantially similar size and shape as the transverse profile of the outer walls 1022. Preferably, the transverse profile of outer walls 1022 is slightly smaller than the transverse profile of inner walls 1018 to provide a sufficient clearance to permit insertion and removal of wand 180 without play when want 180 is inserted into upper portion 104. This may permit upstream portion 1002 to be easily inserted into downstream portion 1006.

The transverse profile of inner walls 1018 and outer walls 1022 may have any suitable shape. For example, the transverse profiles may be circular, triangular, square or another regular or irregular shape. Preferably, the transverse profiles have a non-circular or irregular shape such that outer walls 1022 may fit between inner walls 1018 in only one orientation. This may force wand 180 to be specifically oriented with respect to upper portion 104 (e.g. to provide an intended orientation of handle 160 to surface cleaning head 108). In the example shown, the transverse profiles of inner walls 1018 and outer walls 1022 may be described as "egg-shaped". That is, the transverse profiles are generally rounded and taper in width from one side to the other.

Alternatively, or in addition to the correspondence in transverse profiles of inner and outer walls 1018 and 1022, wand 180 and upper portion 104 may include mating elements that limit the number of orientations in which upstream portion 1002 may be received in downstream portion 1006. For example, wand 180 and upper portion 104 may collectively include one or more mating protrusions and recesses.

In the example shown, wand 180 includes a protrusion (or key) 1026 in upstream portion 1002 that protrudes outwardly along outer wall 1022. Protrusion 1026 is configured to mate with (i.e. insert into) recess (or slot) 1030 formed in a lip 1034 of inner walls 1018 when upstream portion 1002 is received in downstream portion 1006. When wand 180 is correctly oriented with respect to upper portion 104, key 1026 will align with slot 1030 to allow upstream portion 1002 to be inserted into downstream portion 1006. However, lip 1034 of downstream portion 1006 will interfere with key 1026 if attempting to insert upstream portion 1002 into downstream portion 1006 while wand 180 is incorrectly oriented with respect to upper portion 104 such that key 1026 is misaligned with slot 1030.

Connecting wand 180 to upper portion 104 extends the airflow pathway from wand 180 upstream through surface cleaning head 108. The connection may also connect one or more other mechanical elements, such as locking members or linkages, and/or electrical elements, such as electrical power connectors. In this case, there may be limited relative orientations between wand 180 and upper portion 104 which completes the airflow, mechanical and/or electrical connections. For this reason, it may be advantageous to limit the orientations in which the upstream portion 1002 can be received in downstream portion 1006, preferably to a single orientation.

In the example shown, hose 124 is electrified and comprises part of a circuit extending from surface cleaning unit 112 to surface cleaning head. Accordingly, surface cleaning unit 112 may be provided with the electrical cord or an on board power source and an electrical component in the surface cleaning head 108 may be powered via the hose 124 and wand 180. Accordingly, wand 180 may provide an electrified air flow conduit for conducting electricity along the length of wand 180. As exemplified, upstream portion 1002 of wand 180 includes an electrical connector 1038, and downstream portion 1006 of upper portion 104 includes a mating electrical connector 1042. Electrical connectors 1038 and 1042 may be any suitable mating electrical connectors, such as for example a male connector (or plug) and a female connector (or jack). Further, electrical connectors 1038 and 1042 may connect any number of electrical conductors (e.g. from 1 to 100 conductors). As exemplified, each of connectors 1038 and 1042 connects three electrical conductors 1046. Upstream and downstream portions 1002 and 1006 may each include any number of mating electrical connectors, each of which may connect different electrical conductors.

In some cases, electrical connectors 1038 and 1042 may be somewhat fragile. For example, electrical connectors 1038 and 1042 may suffer damage if subjected to certain stresses. In one aspect, the stability provided by upper portion 104 to wand 180 may advantageously reduce stresses on electrical connectors 1038 and 1042. For example, mating elements of upper portion 104 and wand 180, other than electrical connectors 1038 and 1042 (such as key 1026 and slot 1030, and/or the corresponding transverse profiles of walls 1018 and 1022) may provide stability (such as resistance to relative rotational movement between wand 180 and upper portion 104) which might otherwise be borne by electrical connectors 1042 and 1046.

Preferably, once wand 180 is connected to upper portion 104, wand 180 remains connected to upper portion 104 until wand 180 is selectively disconnected from upper portion 104. For example, the connection between wand 180 and upper portion 104 may be maintained by friction which may be overcome by sufficient force, or may be maintained by one or more retentive elements which may be selectively disengaged. Wand 180 may include a locking mechanism that automatically engages downstream portion 1006 when upstream portion 1002 is inserted into downstream portion 1006. When the locking mechanism is engaged with downstream portion 1006, upstream portion 1002 cannot be withdrawn from downstream portion 1006 unless the locking mechanism is unlocked. This may prevent the wand from 180 from disconnecting from upper portion 104 while wand is used to maneuver surface cleaning head 108, for example.

Reference is now made to FIG. 11. As exemplified, wand 180 includes a locking member 1050 and upper portion 104 includes an opening 1054. Locking member 1050 may be sized and positioned to automatically project through opening 1054 after upstream portion 1002 is properly inserted into downstream portion 1006. Thereafter, upstream portion 1002 cannot be disconnected from downstream portion 1006 without withdrawing locking member 1050 from opening 1054. An actuator, e.g. button 1058, is provided to selectively withdraw locking member 1050 from opening 1054, and permit upstream portion 1002 to be freely separated from downstream portion 1006.

Optionally, wand 180 may remain connected with upper portion 104 even while the connection is unlocked. For example, if upstream portion 1002 is received in downstream portion 1006, then the contact between wand 180 and upper portion 104 may retain wand 180 in upper portion 104 even while the locking mechanism for locking the connection is unlocked. In this circumstance, upper portion 104 may be configured to support wand 180 in an upright position. This may permit a user to release control of wand 180 while unlocking the locking mechanism, without the risk of wand 180 toppling over. As exemplified, downstream portion 1006 of upper portion 104 surrounds upstream portion 1002 of wand 180 when upstream portion 1002 is received in downstream portion 1006. Preferably, upper portion 104 surrounds a sufficient height of wand 180 to provide support to wand 180 to rest in the upright position. For example, upper portion 104 may surround any portion of the wand and may surround the entire wand. As exemplified, upper portion may surround between 10 percent and 30 percent of the total height of wand 180 (measured from upstream end 192 to downstream end 188), and more preferably about 20 percent of the total height of wand 180.

Referring now to FIG. 4, wand 180 and surface cleaning unit 112 are shown connected to upper portion 104. As shown, downstream end 1010 of upper portion 104 extends well above upstream end 192 of wand 180. As exemplified, upstream end 192 is positioned proximate a lower end 1062 of surface cleaning unit 112 and well below upper end 1066 of surface cleaning unit 112 (when both surface cleaning unit 112 and wand 180 are connected to upper portion 104). It will be appreciated that upstream end 192 may seat against or in the outlet end of pivot joint 168.

When wand 180 is connected to upper portion 104, the airflow pathway may extend from dirty air inlet 116 through surface cleaning head 108, through pivot joint 168, optionally through upper portion 104 if upstream end 192 is positioned above the outlet end of pivot joint 168, and into wand 180. Preferably, at least the portion of the airflow pathway extending between surface cleaning head 108 and wand 180 is substantially air-tight to preserve the suction generated by suction motor 128. Optionally, a bleed valve (not shown) may be provided to reduce suction for cleaning certain cleaning surfaces. In some embodiments, wand 180 may form an air-tight seal with the airflow passage when connected to upper portion 104. As exemplified, upstream end 192 of wand 180 may be urged against a seal 1070 (e.g. O-ring) surrounding air outlet 1074 of upper portion 104 when wand 180 is connected to upper portion 104. Seal 1070 may prevent entry or escape of air through the interface between wand 180 and upper portion 104.

Reference is now made to FIG. 11. As exemplified, lower portion 1002 of wand 180 has a transverse cross-section that is sized and shaped to form a tight fit inside downstream portion 1006 of upper portion 104. In some cases, it may be difficult for a user to insert one element into another where the fit between those elements is tight. For example, precise alignment requiring fine motor skills may be required for those elements to be connected. In some embodiments, wand 180 and/or upper portion 104 may be configured to make inserting wand 180 into upper portion 104 easier and faster.

In the example shown, upstream portion 1002 of wand 180 includes a lower section 1078, and an upper section 1082. Lower section 1078 is bordered by upstream end 192, and upper section 1082 is downstream of lower section 1078. The transverse section of upper section 1082 may be sized and shaped to provide a tight fit with downstream portion 1006 of upper portion 104. At the same time, lower section 1078 may have a substantially smaller transverse section, which may provide a greater margin for alignment error when firstly inserting lower section 1078 into opening 1014. Accordingly, a user may insert upstream end 192 into upper portion 104. This is facilitated by the clearance between the facing walls of upstream end 192 and upper portion 104. Some or all of the weight of the wand 18-0 may then be supported by upper portion 104. The user may then rotate wand 180 to the required insertion orientation and complete the insertion of wand 180 into upper portion 104 by inserting part or all of upper section 1082. The stepwise insertion of a narrower lower section 1078 into upper portion 104 followed by a wider upper section 1082 may make inserting upstream portion 1002 into upper portion 104 easier for a user. Once lower section 1078 is inserted into opening 1014, lateral movements of wand 180 are substantially constrained, by the interaction of lower section 1078 with inner walls 1018, to positions that are in close proximity to the comparatively narrower range of positions that will allow upper section 1082 to pass through opening 1014 into downstream portion 1006. Such constraint may make finding the correct position faster and easier for a user because the constraint increases the proportion of available positions that will allow upper section 1082 to enter downstream portion 1006.

Alternatively, or in addition to a narrower lower section 1078, downstream end 1010 of upper portion 104 at opening 1014 may be transversely inclined (or "sloped"). As shown, a front side 1086 of opening 1014 extends higher (i.e. further downstream) than the rear side 1090. This may permit a user to more easily locate upstream portion 1002 into opening 1014. In use, the user may simply move front side 1094 of upstream portion 1002 against front side 1086 of opening 1014 to align upstream portion 1002 with opening 1014, and then move upstream portion 1002 downwardly through the remainder of opening 1014. In this way, front side 1086 of opening 1014 may act as a guide for directing upstream portion 1002 downwardly into the remainder of opening 1014. This may be easier to perform than having to maneuver upstream portion 1002 through a transversely uninclined (i.e. horizontal) opening, since such an opening forms a complete periphery at its uppermost edge. If upstream portion 1002 includes a narrower lower section 1078, then preferably, lower and upper sections 1078 and 1082 may be flush along front side 1094 to permit upstream portion 1002 to slide downwardly through opening 1014, as described above, without interference by an overhanging lip of upper section 1082.

Reference is now made to FIG. 14. Alternately, or in addition, sloped opening 1014 may help to correct for rotational misalignment of wand 180 with respect to upper portion 104. After at least partially inserting lower section 1078 of upstream portion 1002 of wand 180 through opening 1014 of upper portion 104, if wand 180 is not properly oriented in rotation (i.e. rotationally misaligned) with opening 1014, then a lip 1098 of upper section 1082 may contact downstream end 1010 at opening 1014. In this case, the downward force $F_w$ of wand 180, whether gravity or user applied to the point of contact between lip 1098 and downstream end 1010, is met with a reactionary force $F_N$ by sloped downstream end 1010. As shown, reactionary force $F_N$ includes a vertical component of force $F_V$ in opposition to downward for $F_W$ in addition to a horizontal component of force $F_H$. The horizontal component of force $F_H$ urges the wand 180 to rotate back into alignment. For example, if wand 180 is rotated out of alignment in the clockwise direction 1102 then the component of force $F_H$ urges the wand 180 to rotate counter-clockwise into alignment. In this way, sloped opening 1014 interacts with upper section 1082 of upstream portion 1002 to urge wand 180 into proper alignment for insertion into opening 1014.

Wand Locking Mechanism

The following is a description of the wand locking mechanism that may be used by itself in any surface cleaning apparatus or in any combination or sub-combination with any other feature or features disclosed herein.

Reference is now made to FIG. 11. Preferably, once wand 180 is connected to upper portion 104, wand 180 remains connected to upper portion 104 until wand 180 is selectively disconnected from upper portion 104. The connection between wand 180 and upper portion 104 may be maintained by one or more retentive elements of a locking mechanism, which may be selectively disengaged. When the locking mechanism is engaged, upstream portion 1002 cannot be withdrawn from downstream portion 1006 unless the locking mechanism is unlocked. This may prevent the wand from 180 from disconnecting from upper portion 104 while wand 180 is used to maneuver surface cleaning head 108, for example.

Reference is now made to FIGS. 11 and 23. FIG. 23 shows a partial view of wand 180 including upstream portion 1002 with outer wall 1022 removed to expose the inner locking mechanism (or "wand lock") 1106. Wand lock 1106 may include a locking member that releasably engages upper portion 104 to selectively secure wand 180 to upper portion 104 in a locked position. As exemplified, wand lock 1106 includes a plunger 1050 which may extend through opening 1054 of downstream portion 1006 to obstruct the withdrawal of upstream portion 1002 from downstream portion 1006. Further, plunger 1050 may be retractable to withdraw from opening 1054 and cease obstructing the withdrawal of upstream portion 1002 from downstream portion 1006.

As exemplified, plunger 1050 is positioned in a slot 1110 for translation between an extended position (shown), and a retracted position. A resilient member, such as spring 1114 (FIG. 24*a*) may act upon plunger 1050 to bias plunger 1050 toward the extended position. In the extended position, an end portion 1118 of plunger 1050 protrudes from slot 1110 through an opening 1122 in outer wall 1022. In the retracted position, end portion 1118 of plunger 1050 is at least partially withdrawn back into slot 1110.

Preferably, wand lock 1106 is configured to automatically lock wand 180 to upper portion 104, upon insertion of wand 180 into upper portion 104. For example, the locking member of wand lock 1106 may automatically engage upper portion 104 upon the insertion of upstream portion 1002 into downstream portion 1006, thereby securing wand 180 to upper portion 104. In some cases, the locking member may translate laterally (i.e. substantially perpendicularly to the airflow path) to releasably engage the upper portion 104. As exemplified, plunger 1050 may automatically translate (or "extend") laterally outwardly through opening 1054 in downstream portion 1006 upon the insertion of upstream portion 1002 into downstream portion 1006, without requiring further user action.

In the example shown, end portion 1118 of plunger 1050 includes a lower side 1126 and an opposite upper side 1130. Lower side 1126 includes a sloped face 1134. First, plunger 1050 may be in the extended position while upstream portion 1002 is withdrawn from downstream portion 1006. In the extended position, end portion 1118 including sloped face 1134 of lower side 1126 may protrude through opening 1122. When inserting upstream portion 1002 into downstream portion 1006, sloped face 1134 of lower side 1126 may make contact with downstream end 1010 at opening 1014 during insertion. For example, there may be less space between outer and inner walls 1022 and 1018 than the distance by which end portion 1118 protrudes through opening 1122 in the extended position. Downstream end 1010 may cam along sloped face 1134 forcing plunger 1050 to retract against the bias of spring 1114 until tip 1138 of plunger 1050 meets inner walls 1018. Upon further insertion, plunger 1050 may align with opening 1054 and translate laterally under the bias of spring 1114 through opening 1054.

When plunger 1050 is in the extended position and extending through opening 1054, wand 180 may not be withdrawn from upper portion 104 without first at least partially retracting plunger 1050. As exemplified, plunger 1050 includes an upper side 1130. Upper side 1130 is shown including a sloped outboard face 1142 bordered by tip 1138, and an unsloped (or less sloped) inboard face 1146 inboard of outboard face 1142. Preferably, at least a portion of inboard face 1146 projects through opening 1054 in the extended position. In this case, inboard face 1146 may contact an upper wall of opening 1054 if upstream portion 1002 is attempted to be withdrawn from downstream portion 1006 without first retracting plunger 1050. In turn, the slope of inboard face 1146 (or lack thereof) may be insufficient for the upper wall of opening 1054 to cam along inboard face 1146 to withdraw plunger 1050. Accordingly, upstream portion 1002 cannot be withdrawn from downstream portion 1006; wand lock 1106 is in the locked (or "engaged") position.

Wand lock 1106 may be unlocked by a mechanical, electrical, or electromechanical device in response to a user action. For example, wand lock 1106 may include a wand release actuator which operates to unlock wand lock 1106. When wand lock 1106 is in the unlocked position, wand 180 may be freely removable from upper portion 104.

As exemplified, upper portion 104 may terminate well below waist height. For example, upper portion may be 12-14 inches tall. An advantage of a shorter upper member is that it facilitates the insertion of wand 180 into upper portion 104. In order to avoid a user having to bend over to release wand 180 while enabling wand 180 to be locked to upper portion 104, an actuator 1058 may be provided at a height which may be actuated by a user while standing upright. An actuator, such as button 1058, may be drivingly connected to lock 1106 by a longitudinally extending member, such as shaft 1150. The actuator and shaft, as well as the linking member, may be provided as part of, and removable with, wand 180. Accordingly, by incorporating the lock and actuator into wand 180, upper portion 104 may be shorter.

As exemplified, wand lock 1106 includes a longitudinally extending transmission member that drivingly connects the wand release actuator and the locking member. For example, the transmission member may be translatable downwardly to move the wand lock 1106 into the unlocked position. Moving the transmission member downwardly may cause the locking member to move laterally to a disengaged position, and set the wand lock 1106 in the unlocked position.

Figure 24A:
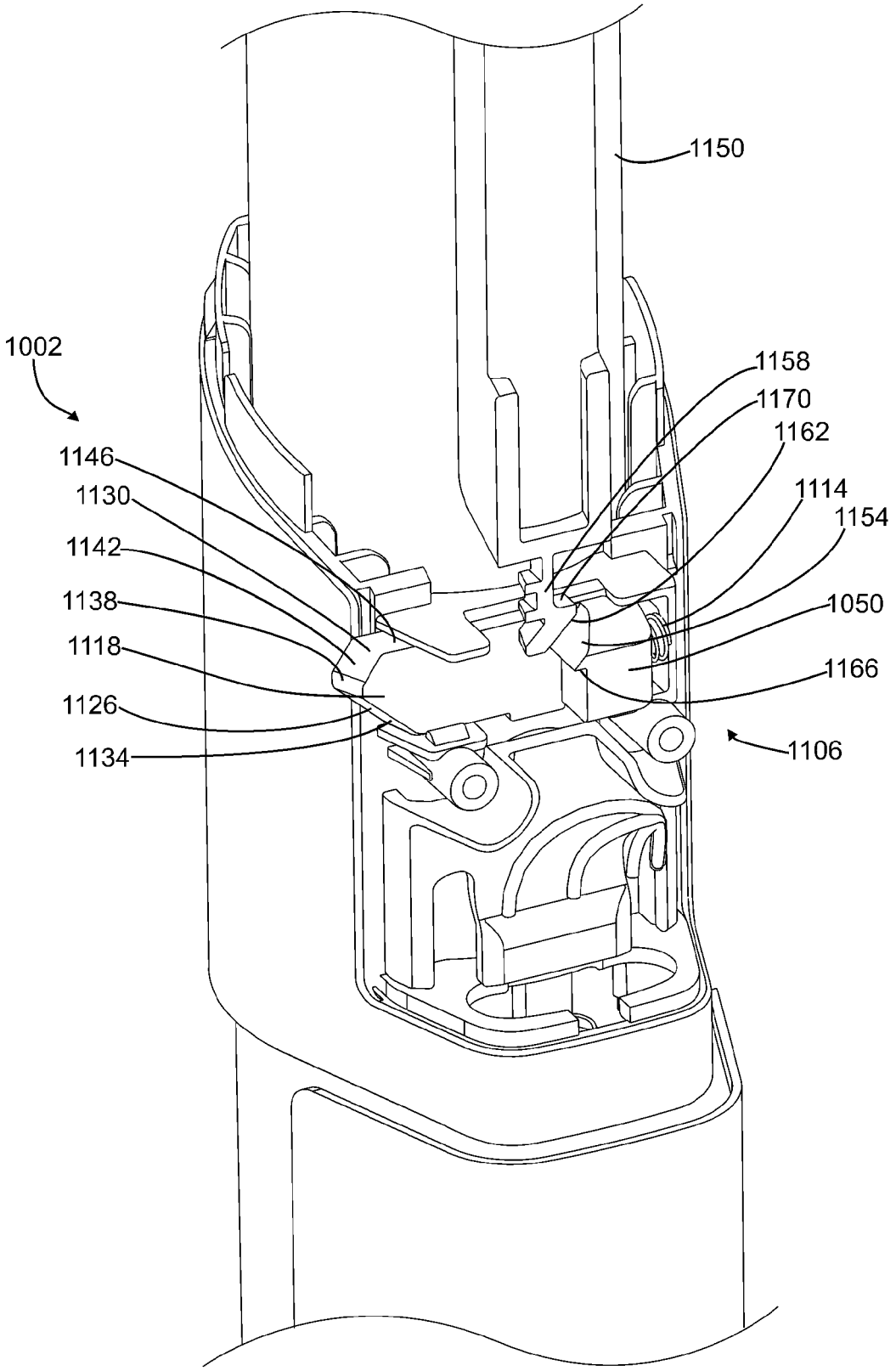
Figure 24B:
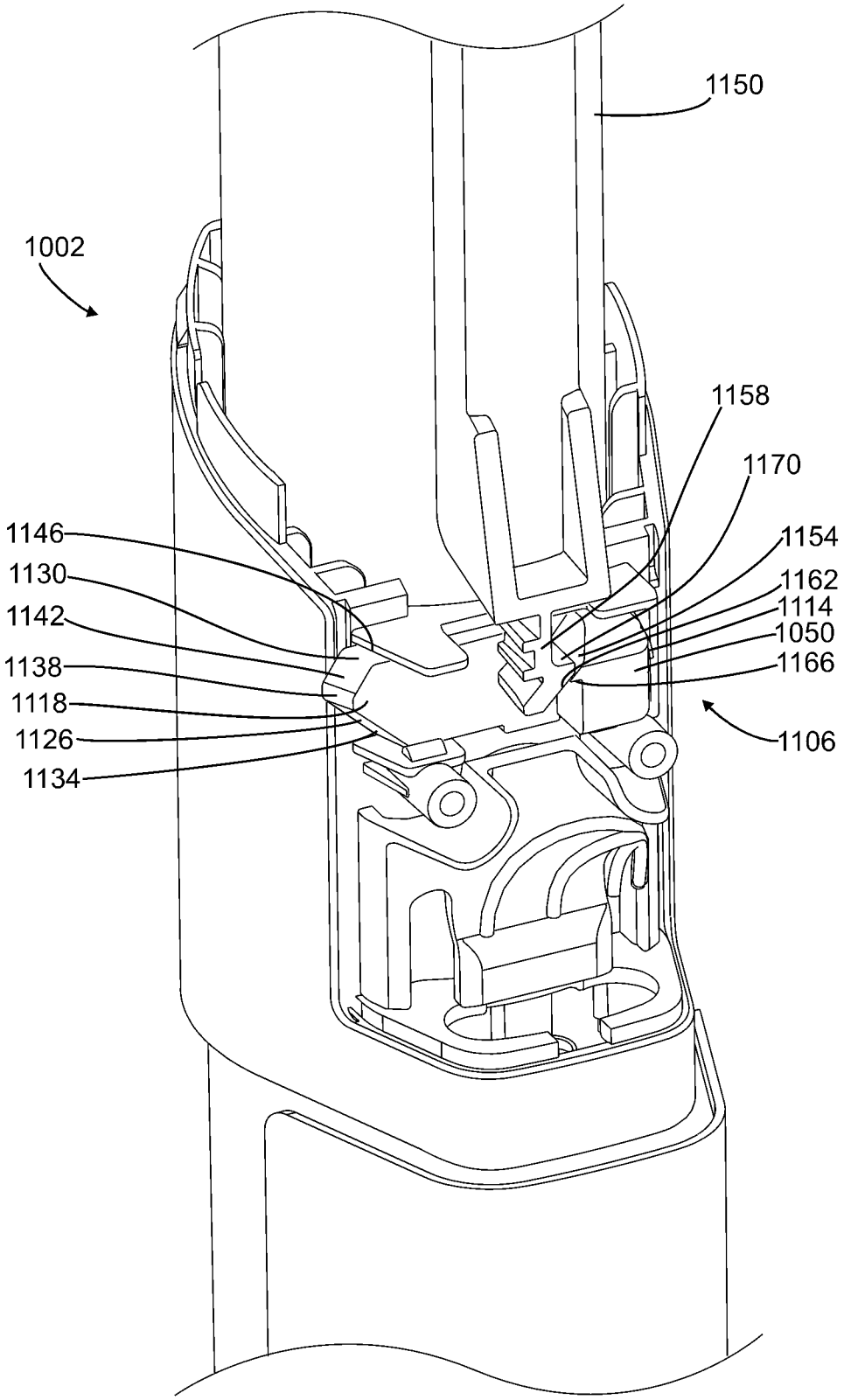

In the example shown, a button 1058 is mounted to wand 180 that drives a shaft 1150 to translate toward plunger 1050. A biasing member, such as spring 1152 may bias shaft 1150 upwardly into a retracted position. Shaft 1150 may interact with plunger 1050 to move plunger 1050 into a retracted position, and thereby permit the upper wall of opening 1054 to clear at least inboard face 1146 (i.e. to engage with sloped outboard face 1142 instead, or to clear plunger 1050 altogether). As exemplified, plunger 1050 includes an upwardly-facing face 1154, and shaft 1150 includes a lower portion 1158 including a downwardly-facing face 1162. Faces 1154 and 1162 may be positioned to meet when shaft 1150 is translated downwardly toward plunger 1050 (as shown in FIG. 24*b* when button is partially pressed to move the lock to the unlocked position). Faces 1154 and 1162 may be shaped to provide a camming action that retracts plunger 1050 against the bias of spring 1114 as shaft 1150 is further translated toward plunger 1050. In the example shown, each of faces 1154 and 1162 are correspondingly sloped. As shaft 1150 is translated downwardly, face 1158 of shaft 1150 cams along face 1154 of plunger 1050 causing plunger 1050 to retract to the retracted position. In the retracted position, the upstream portion 1002 may be withdrawn from downstream portion 1006; the wand lock is unlocked (or "disengaged"). The upper wall of opening 1054 may be able to clear at least inboard face 1146 which was preventing the withdrawal in the locked condition.

Figure 24C:
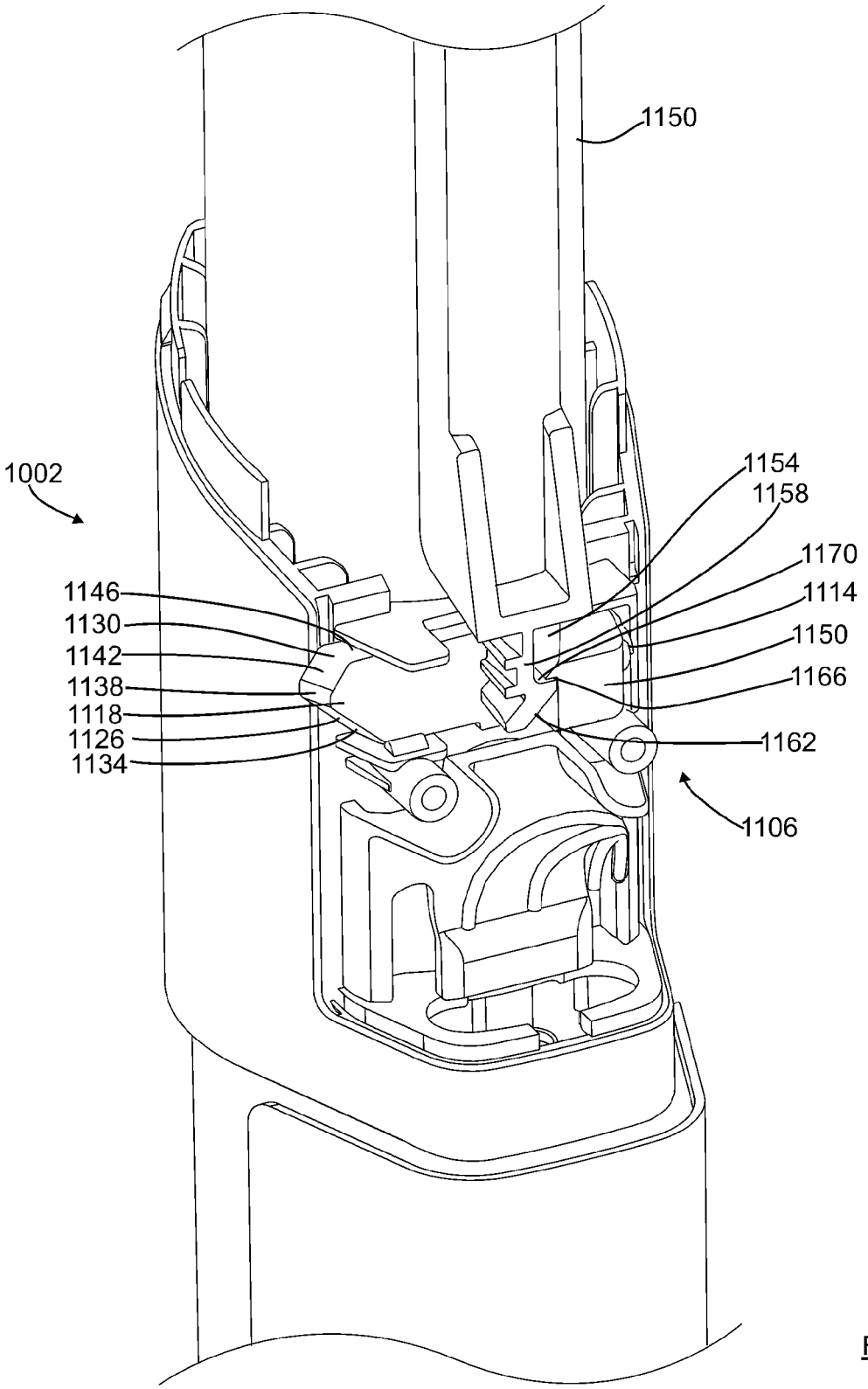

Preferably, wand lock 1106 may remain in the unlocked (or "disengaged") position after button 1058 is released. This may permit a user to use the same hand to activate button 1058 (unlocking wand 180) and to subsequently remove wand 180 from upper portion 104. In the example shown, shaft 1150 may be biased (e.g. by a resilient element such as spring 1152) upwardly. When plunger 1050 is in the retracted position, shaft 1150 may obstruct plunger 1050 from extending under the bias of spring 1114, and plunger 1050 may obstruct shaft 1150 from retracting upwardly. As exemplified, plunger 1050 includes a lip 1166 below face 1154, and shaft 1150 includes a lip 1170 above face 1162. Further, lower face 1162 may move past upper face 1154 during downward translation of shaft 1150. When this occurs, plunger 1050 translates laterally outwardly a short distance moving lips 1166 and 1170 into contact. The contact between lips 1166 and 1170 prevents shaft 1150 from withdrawing upwardly. Further, the position of lower portion 1158 in front of plunger 1050 obstructs plunger 1050 (as shown in FIG. 24*c*) from further translation toward the extended position. Accordingly, the lock is maintained in the unlocked position.

Figure 24D:
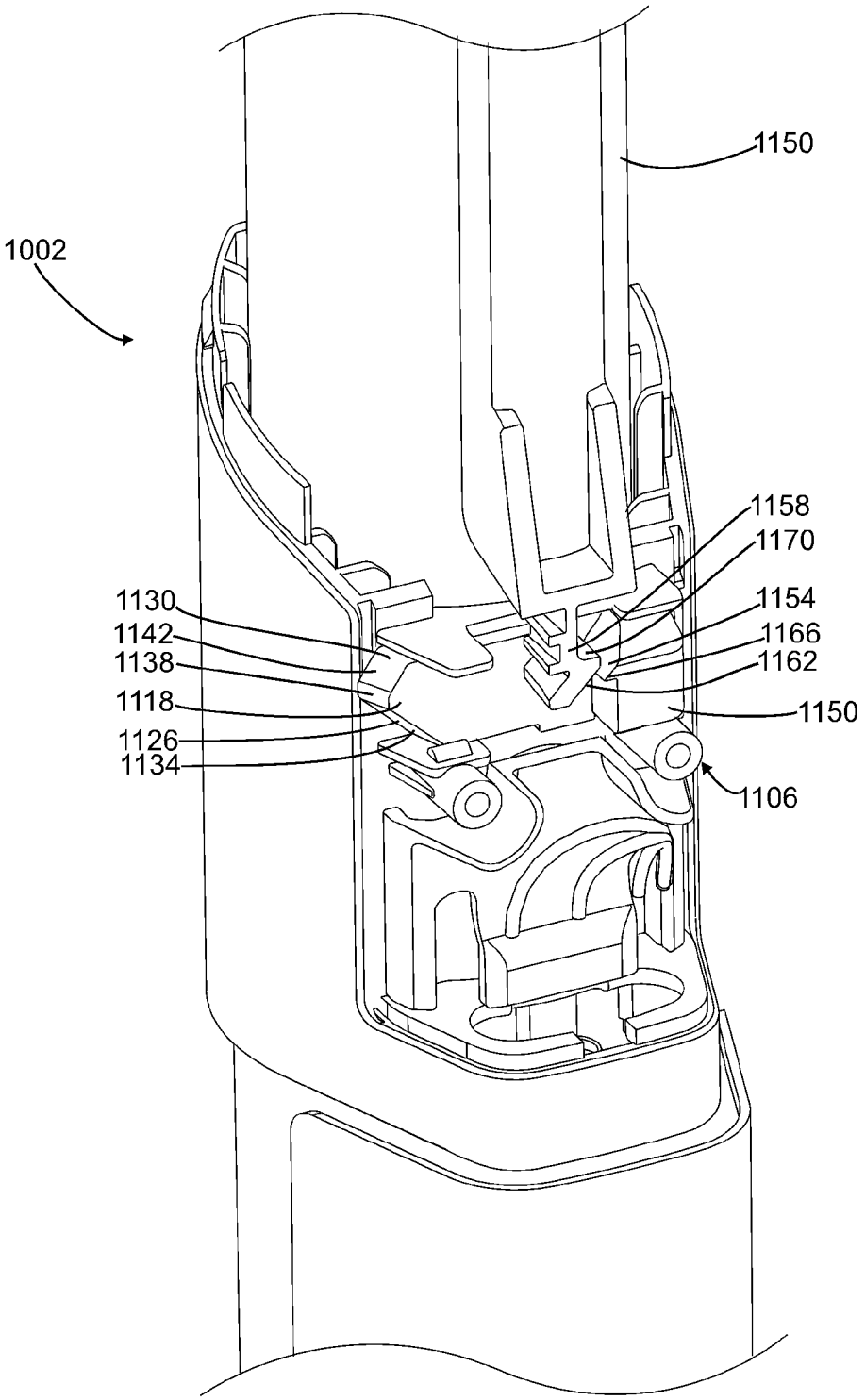

Preferably, wand lock 1106 may be freed from maintaining the unlocked position upon removing and/or reinserting wand 180 into upper portion 104. For example, shaft 1150 and plunger 1050 may be disentangled upon the withdrawal or reinsertion of upstream portion 1002 out of or into downstream portion 1006. As exemplified, sloped outboard face 1142 and a portion of sloped lower face 1134 of plunger 1050 may protrude outwardly through opening 1122 in upstream portion 1002, when plunger 1050 is in the retracted position. This may permit the upper wall of opening 1054 to cam sloped outboard face 1142 during withdrawal of upstream portion 1002 from downstream portion 1006 to further retract plunger 1050. This moves lip 1166 of plunger 1050 out of contact with lip 1170 of shaft 1150 (as shown in FIG. 24*d*), allowing shaft 1150 to retract upwardly. After plunger 1050 clears the downstream end 1010 of upper portion 104, plunger 1050 may extend under the bias of spring 1114 to the extended position.

Wand lock 1106 may also be maintained in the unlocked position while wand 180 is removed from upper portion 104. For example, button 1058 may be depressed to retract plunger 1050 and entangle shaft 1150 with plunger 1050 while wand 180 is removed from upper portion 104. In this case, reinserting wand 180 into upper portion 104 may release wand lock from the unlocked position. As exemplified, a portion of sloped lower face 1134 of plunger 1050 may protrude outwardly through opening 1122 in upstream portion 1002, when plunger 1050 is in the retracted position. This may permit the downstream end 1010 at opening 1014 to cam sloped lower face 1134 during insertion of upstream portion 1002 into downstream portion 1006 to further retract plunger 1050. This moves lip 1166 of plunger 1050 out of contact with lip 1170 of shaft 1150 (as shown in FIG. 24*d*), allowing shaft 1150 to retract upwardly. Once plunger 1050 aligns with opening 1054 in downstream portion 1006, plunger 1050 may translate laterally outwardly under the bias of spring 1114 to the extended position.

Wand Lock Release Actuator

The following is a description of the wand lock release actuator that may be used by itself in any surface cleaning apparatus or in any combination or sub-combination with any other feature or features disclosed herein.

In some embodiments, the locking mechanism (e.g. wand lock 1106) that prevents wand 180 from being separated from upper portion 104 after they are connected, may be released by a wand lock release actuator. The actuator may have a mechanical, electrical, or electromechanical connection to the wand lock. Preferably, the actuator may be positioned remotely from upper portion 104 at a position above upper portion 104 toward handle 160 (FIG. 5). For example, the actuator may be positioned above upper portion 104 on wand 180 or on handle 160. In some cases, the actuator may be positioned between a user's knee height and chest height, and more preferably between a user's thigh height and waist height. This may reduce or eliminate the need for a user to bend over to activate the actuator to release the wand lock and separate the wand 180 from the upper portion 104 (e.g. to use the surface cleaning apparatus 100 in an above-floor cleaning mode).

Referring to FIGS. 11 and 23, as exemplified, a button 1058 is positioned at approximately a midpoint along the length of wand 180. Button 1058 is an example of a lock release actuator. This may generally correspond to a height of a user's thighs. As shown, button 1058 may be substantially parallel with an upper end 1066 of surface cleaning unit 112. Button 1058 is drivingly connected to the plunger 1050 by shaft 1150.

The lock release actuator may be connected to wand 180, and removable from upper portion 104 and surface cleaning unit 102 when wand 180 is separated from upper portion 104 and surface cleaning unit 102 (e.g. for use in an above-floor cleaning mode). Similarly, a longitudinally extending transmission member drivingly connecting the lock release actuator to the locking member of wand lock 1106 may be mounted to wand 180 and removable from upper portion 104 and surface cleaning unit 102 when wand 180 is separated from upper portion 104 and surface cleaning unit 102. For example, wand lock 1106 in its entirety may be mounted to wand 180 and removable from upper portion 104 and surface cleaning unit 102 when wand 180 is separated from upper portion 104 and surface cleaning unit 102. This may advantageously allow surface cleaning apparatus 100 to be easily reconfigured into different modes of operation. For example, when surface cleaning unit 102 is unmounted from upper portion 104, the wand lock 1106 may remain with wand 180 to allow wand 180 to remain releasably connected to upper portion 104.

In the example shown, wand lock 1106 including button 1058, shaft 1150, and plunger 1050 are all connected to wand 180 independent of surface cleaning unit 112 and upper portion 104, and remain so connected after surface cleaning unit 112 and upper portion 104 are separated from wand 180.

Surface Cleaning Unit Mounting Structure

The following is a description of the surface cleaning unit mounting structure that may be used by itself in any surface cleaning apparatus or in any combination or sub-combination with any other feature or features disclosed herein.

Reference is now made to FIG. 5. Surface cleaning unit 112 may be removably mountable to one or more of upper portion 104 and wand 180. Preferably, surface cleaning unit 112 may be mounted to upper portion 104 independent of wand 180, such that surface cleaning unit 112 may be mounted and dismounted from upper portion 104 without adjusting the position of wand 180 or removing wand 180. Accordingly, for example, wand 180 may remain in upper portion 104 while surface cleaning unit 112 is mounted to or removed from upper portion 104.

Alternately, or in addition, when surface cleaning unit 112 is mounted to upper portion 104, upper portion 104 may stabilize surface cleaning unit 112 (e.g. surface cleaning unit 112 may remain in a fixed position on upper portion 104 as upper portion 104 is manipulated to maneuver surface cleaning head 108). For example, upper portion 104 may inhibit translational movement of surface cleaning unit 112 along upper axis 164 (FIG. 1) toward surface cleaning head 108, and/or may inhibit rotational movement of surface cleaning unit 112 around upper axis 164.

Accordingly, surface cleaning unit 112 may be mounted on the exterior of upper portion 112 by two mounting members wherein the mounting members are provided a two longitudinally (e.g., along axis 164) spaced apart locations wherein at least one of the two mounting members provides lateral stability as upper portion 104 is manipulated to maneuver surface cleaning head 108. It will be appreciated that more than two mounting members may be provided.

Surface cleaning unit 112 may be slidably receivable on one or both of the mounting members. For example, surface cleaning unit 112 may have one or more recess to receive one of the mounting members therein. Accordingly, if one of the mounting members comprises a pair of laterally extending portions (e.g., left and right laterally extending wings that extend outwardly from opposed sides of the upper portion, or a mounting member provided on the front or rear of the exterior of the upper portion which has left and right laterally extending wings), then the surface cleaning unit 112 may have one or two groves in which the laterally extending position may be received.

One of the mounting members may have a sufficient height such that surface cleaning unit remains in a fixed position if wand 180 is removed and/or surface cleaning unit 112 is unlocked for removal from upper portion. For example, if the mounting member comprises laterally extending portions that are received in a recess, groove or the like then the engagement between abutting surfaces of the laterally extending portions and the recess, groove or the likes may dimensionally stabilize surface cleaning unit 112 in position in the unlocked position and with the wand removed.

Referring to FIGS. 16-19, surface cleaning unit 112 and upper portion 104 may include one or more mounting elements or members for connecting surface cleaning unit 112 to upper portion 104. For example, the mounting elements may include outwardly projecting mounting members or wings and corresponding mounting recesses for receiving those mounting members.

As exemplified, upper portion 104 includes outwardly projecting wings 1174*a* and 1174*b*. Wings 1174 are examples of mounting members. As shown, wings 1174 may extend laterally from a front side 1178 of upper portion 104. Although upper portion 104 is shown including two mounting members, in alternative embodiments, upper portion 104 may include any suitable number of mounting members. For example, upper portion 104 may include between one wing 1174 and ten wings 1174, which may extend in any number of directions. Further, wings 1174 may each be discrete elements, or they may be integrally formed as are 1174*a* and 1174*b* in the example shown.

As exemplified, surface cleaning unit 112 includes recesses 1182*a* and 1182*b*. Each recess 1182 may include an opening 1186 in a bottom surface 1190 of surface cleaning unit 112. Recesses 1182 may be sized and positioned to receive wings 1174. For example, surface cleaning unit 112 may be positioned above upper portion 104 and lowered to slide wings 1174 into recesses 1182. Thereafter, surface cleaning unit 112 may be separated from upper portion 104 by moving surface cleaning unit 112 vertically away from upper portion 104 to remove wings 1174 from recesses 1182.

Although surface cleaning unit 112 is shown including two recesses 1182, in alternative embodiments, surface cleaning unit 112 may include any suitable number of recesses for receiving some or all of the mounting members of upper portion 104. Further, the arrangement of recesses and protruding mounting members may be reversed. Each of surface cleaning apparatus 112 and upper portion 104 may include one or more recesses and mounting members sized and positioned to mate with one another.

Optionally, openings 1186 to recesses 1182 may be shaped to make it easier for a user to insert wings 1174 into recesses 1182. In some cases, mating recesses 1182 over wings 1174 may include lowering surface cleaning unit 112 onto upper portion 104. The openings 1186 to recesses 1182 on the bottom surface 1190 of surface cleaning unit 112 may be well below a user's eye-level and obscured from view. This may make aligning openings 1186 with recesses 1182 more difficult.

As exemplified, each recess 1182 may be flared in a lower portion 1194 of the recess 1182 to provide an enlarged opening 1186. Enlarged openings 1186 may make aligning openings 1186 over wings 1174 less difficult. Once wings 1174 enter the enlarged openings 1186, surface cleaning unit 112 may self-align as surface cleaning unit 112 is lowered further and wings 1174 enter the narrower upper portions 1198 of recesses 1182.

In the example shown, at least upper portion 1198 of each recess 1182 has a sectional profile that closely corresponds to the sectional profile of respective mating wings 1174. This may provide a tight interface between recesses 1182 and wings 1174 for stabilizing surface cleaning unit 112 on upper portion 104.

The fit between wings 1174 and recesses 1182 may stabilize surface cleaning unit 112 from rotating in all directions. This may prevent surface cleaning unit 112 from tipping over, e.g. when upper portion 104 is manipulated to maneuver surface cleaning head 108. Further, wings 1174 may support surface cleaning unit 112 from translating toward surface cleaning head 108. For example, one or more of recesses 1182 may include an end wall 1202 bordering upper portion 1198. Wings 1174 may insert far enough into recesses 1182 that an upper surface 1204 of at least one of wings 1174 contacts an end wall 1202. This contact may inhibit further translation of surface cleaning unit 112 toward surface cleaning head 108. Accordingly, for example, if wand 180 is removed and/or surface cleaning unit 112 is unlocked for removal from upper portion, then surface cleaning unit 112 may remain in position on upper portion 104.

In alternative embodiments, different mounting element(s) inhibit movement of surface cleaning unit 112 toward surface cleaning head 108. In this case, recesses 1182 may be open ended (i.e. without end walls 1202), wings 1174 may not reach an end wall 1202, or both. Instead the different mounting element(s) may inhibit movement of surface cleaning unit 112 toward surface cleaning head 108.

Reference is now made to FIGS. 16, 18, and 21. In addition to, or instead of wings 1174 and recesses 1182, surface cleaning unit 112 may include a different mounting member that engages downstream end 1010 of upper portion 104. As exemplified, surface cleaning unit 112 includes a clip 1206. Clip 1206 is an example of a mounting member. Clip 1206 may extend downwardly in spaced apart relation from a rear surface 1210 of surface cleaning unit 112 forming a slot 1214 for receiving a portion of downstream end 1010 of upper portion 104.

In use, surface cleaning unit 112 may be lowered onto upper portion 104 such that a front side 1178 of downstream portion 1006 enters slot 1214, and clip 1206 enters upper portion 104. Clip 1206 may grasp front side 1178 of upper portion 104 to inhibit surface cleaning unit 112 from rotating forwardly, over surface cleaning head 108, or rearwardly. In some cases, upper portion 104 may abut upper end 1218 of slot 1214 such that the weight of surface cleaning unit 112 may be supported on downstream end 1010 of upper portion 104. Clip 1206 may be disconnected from upper portion 104 by raising surface cleaning unit 112 vertically away from upper portion 104. Accordingly, upper portion 104 provides a support on which the surface cleaning unit 112 (clip 1206) seats when mounted to upper portion 104.

As shown in FIG. 18, a clearance 1222 may be provided between inner wall 1018 of upper portion 104 and outer wall 1022 of wand 180, toward the front side 1178 of upper portion 104, when wand 180 is inserted into upper portion 104. Clearance 1222 may provide space for clip 1206 to be received in upper portion 104 simultaneously with wand 180. Further, either of clip 1206 or wand 180 may be removed from upper portion 104 while the other remains inserted in upper portion 104. This may make reconfiguring surface cleaning apparatus 100 into different cleaning modes quick and easy.

Reference is now made to FIGS. 11, 13, 16, and 21. Alternatively, or in addition to wings 1174, recesses 1182, and clip 1206, wand 180 may include mounting members for supporting surface cleaning unit 112 and or dynamically stabilizing or assisting in dynamically stabilizing surface cleaning unit 112 on upper portion 1104. Accordingly, for example, the mounting members of wand 180 enhance stability of surface cleaning unit 112 when both wand 180 and surface cleaning unit 112 are connected to upper portion 104. For example, mounting members of wand 180 may inhibit the rotation and/or the translation forward of surface cleaning unit 112, e.g. when upper portion 104 and/or wand 180 are manipulated to maneuver surface cleaning head 108.

As exemplified, wand 180 may include wings 1226*a* and 1226*b*. Wings 1226 are examples of mounting members. Further, surface cleaning unit 112 may include arms 1230*a* and 1230*b* for at least partially surrounding wings 1226. As shown, each arm 1230 may define a slot 1234 for receiving a wing 1226. Preferably, slots 1234 are open ended. This may permit wings 1226 to be received from above or below slots 1234. For example, if surface cleaning unit 112 is connected to upper portion 104, then wings 1226 may enter and exit slots 1234 through the open upper end 1238 of slots 1234, as wand 180 is lowered into upper portion 104 or raised away from upper portion 104. Further, if wand 180 is connected to upper portion 104, then wings 1226 may enter and exit through slots 1234 through the open bottom end 1242 of slots 1234, as surface cleaning unit 112 is lowered onto upper portion 104 or raised away from upper portion 104.

Slots 1234 may be shaped to make aligning wings 1226 with slots 1234 easier. As exemplified, each end 1238 and 1242 of slots 1234 may be flared to provide a widened opening for easier alignment with wings 1226. Further, each slot 1234 may include a narrow region 1246 between upper and lower ends 1238 and 1242. Preferably, narrow region 1246 may make contact with wings 1226 when wings 1226 are received in slots 1234. As exemplified, each of wings 1226 includes a front surface 1250 that faces forward toward surface cleaning unit 112 (when surface cleaning unit 112 and wand 180 are connected to upper portion 104), and an opposite rear face 1254. In use, when wings 1226 are received in slots 1234, slots 1234 may contact at least a portion of rear faces 1254 of wings 1226. This may permit arms 1230 to inhibiting surface cleaning unit 112 from tilting forwardly over surface cleaning head 108.

Alternatively, or in addition to providing support for surface cleaning unit 112, the interaction between wings 1226 and arms 1230 may help to support wand 180 in an upright position. Wand 180 may be releasably securable to upper portion 104. For example, a wand lock may be releasably engaged to secure wand 180 to upper portion 104. However, in some embodiments, after the wand lock is disengaged, upper portion 104 may not provide good support to maintain wand 180 in position. For example, wand 180 may tip over after the wand lock is disengaged if no further support is provided. This may be exacerbated where the wand lock remains disengaged after a user ceases interaction with a wand lock release actuator. In this case, when a user activates the wand lock release actuator, the user may release control of wand 180, such that wand 180 may fall over if no further support is provided to keep wand 180 in position. Such further support may be provided by arms 1230 which may receive wings 1226 to support wand 180 in an upright position, e.g. when wand lock is unlocked. This may provide a user with time to develop a proper grip on wand 180 after unlocking the wand lock.

In operation, a user may position surface cleaning unit 112 adjacent upper portion 104 and above upper wings 1226 and above lower wings 1174. Slots 1234 may be generally aligned with upper wings 1226 and recesses 1182 may be generally aligned with lower wings 1174. This is the position shown in FIG. 31. Surface cleaning unit 112 may then be lowered. As surface cleaning unit 112 is lowered, arms 1230 extend to surround upper wings 1226 and lower wings 1174 commence to be received in recesses 1182. This is the position shown in FIG. 32. Continual lowering of surface cleaning unit to the mounted position shown in FIG. 33 results in surface cleaning unit being seated on lower wings 1174, clip 1206 being received in upper portion 104 and arms 1230 of the surface cleaning unit surrounding upper wings 1226 of the wand 180.

Surface Cleaning Unit Locking Mechanism

The following is a description of the surface cleaning unit locking mechanism that may be used by itself in any surface cleaning apparatus or in any combination or sub-combination with any other feature or features disclosed herein.

Preferably, once surface cleaning unit 112 is connected to upper portion 104, surface cleaning unit 112 remains connected to upper portion 104 until surface cleaning unit 112 is selectively disconnected from upper portion 104. The connection between surface cleaning unit 112 and upper portion 104 may be maintained by one or more retentive elements of a locking mechanism, which may be selectively disengaged. When the locking mechanism is engaged, surface cleaning unit 112 may not be separable from upper portion 104 unless the locking mechanism is unlocked. This may prevent the upper portion 104 from disconnecting from upper portion 104, e.g. while upper portion 104 is used to maneuver surface cleaning head 108 or if surface cleaning apparatus 100 is carried by grasping surface cleaning unit 112.

As discussed previously, upper portion 104 may terminate well below waist height. An advantage of a shorter upper member is that it facilitates the insertion of wand 180 into upper portion 104. In order to avoid a user having to bend over to release surface cleaning unit 112 while enabling surface cleaning unit 112 to be locked to upper portion 104, an actuator may be provided at a height which may be actuated by a user while standing upright. The actuator may be drivingly connected to lock by a longitudinally extending member, such as shaft. The actuator and shaft, as well as any linking member, may be provided as part of, and removable with, surface cleaning unit 112. Accordingly, by incorporating the lock and actuator into surface cleaning unit 112, upper portion 104 may be shorter.

Reference is made to 18, 21, and 22*a*-*d*, where like part numbers refer to like parts in the other figures. As exemplified, surface cleaning unit 112 may include a locking mechanism 1258 that is substantially similar to wand lock 1106 describe above. Accordingly, the description below of locking mechanism 1258 is abbreviated so as not to unnecessarily repeat details and variants already described above.

Figure 22A:
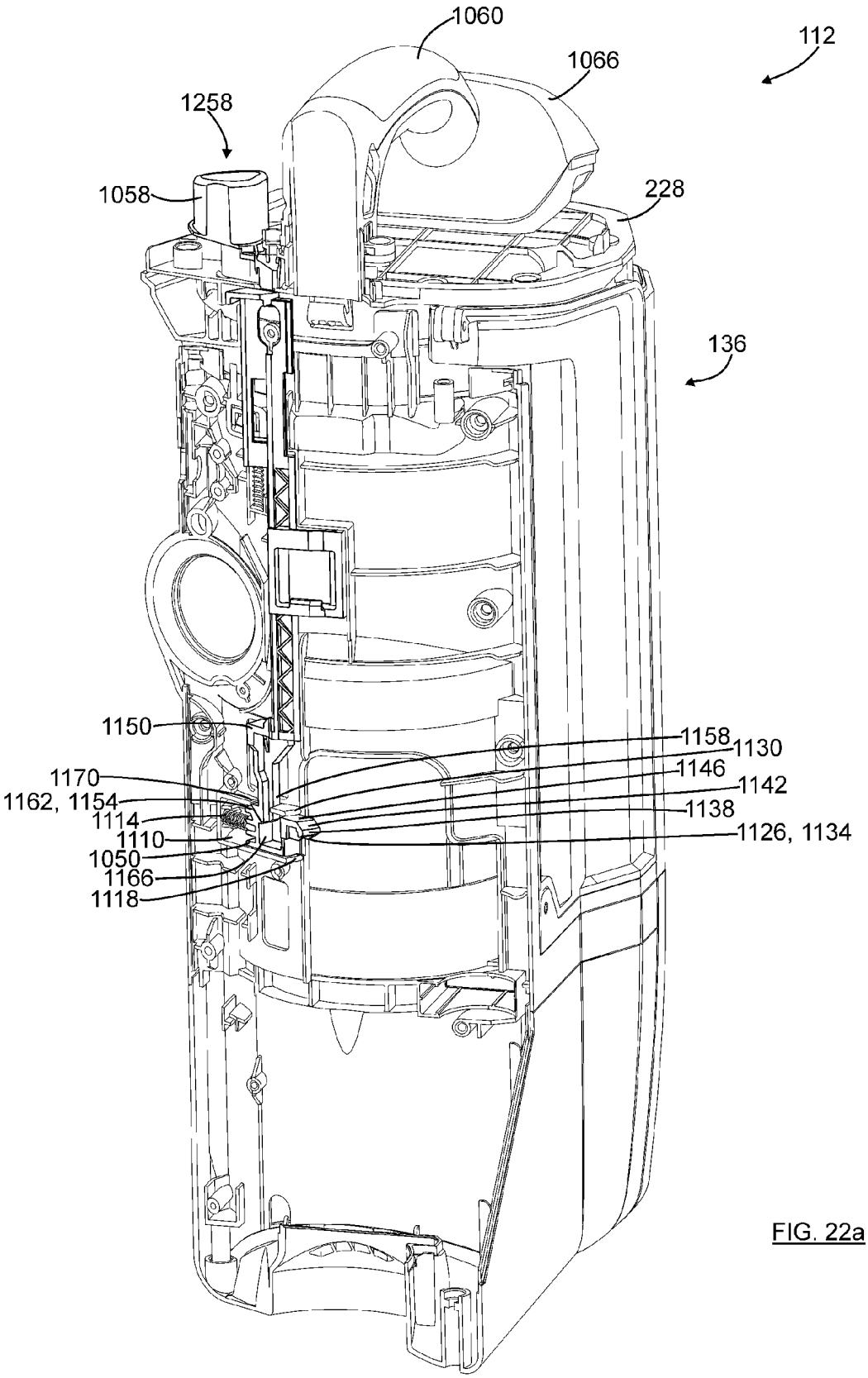
Figure 22B:
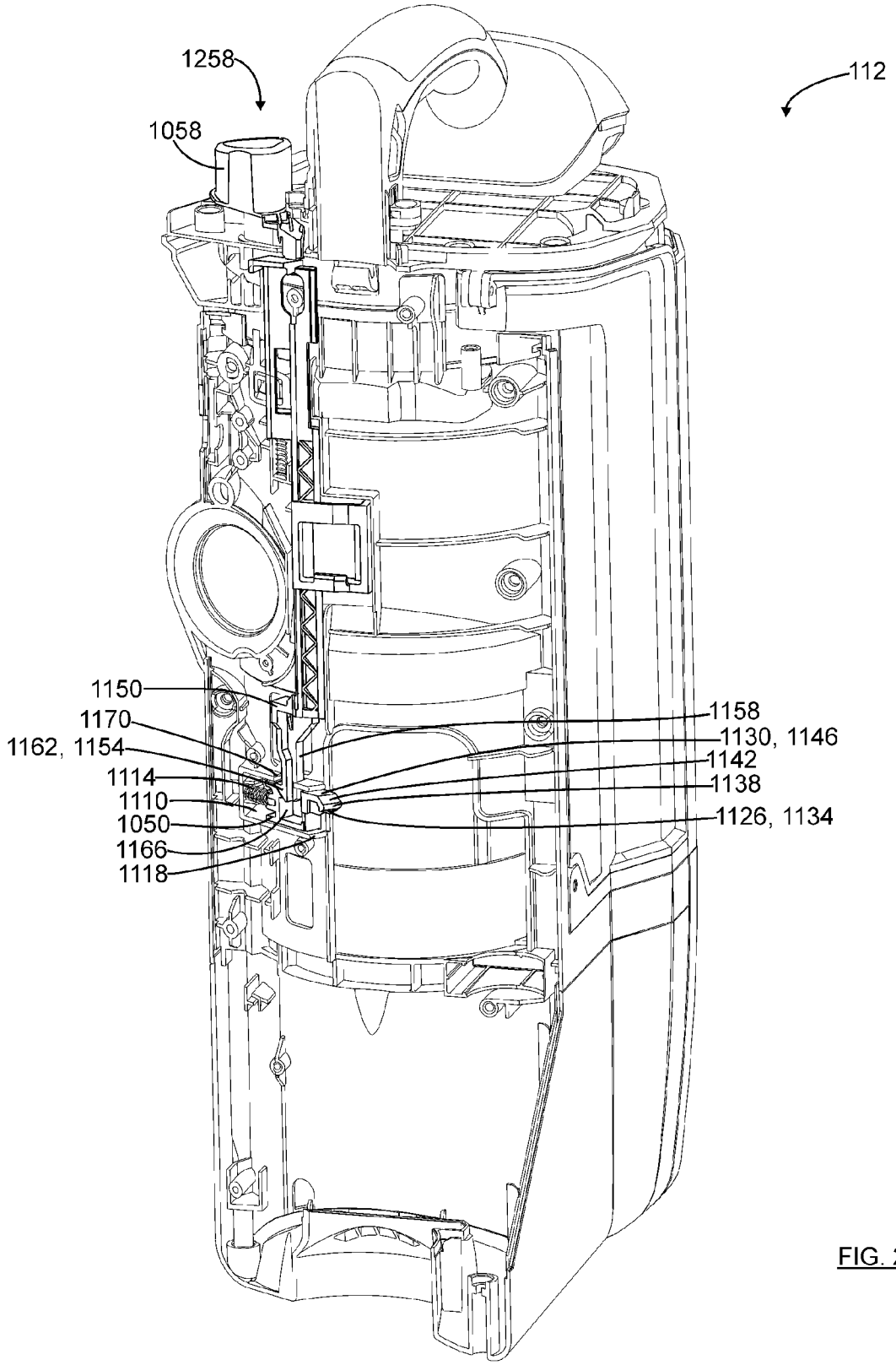
Figure 22C:
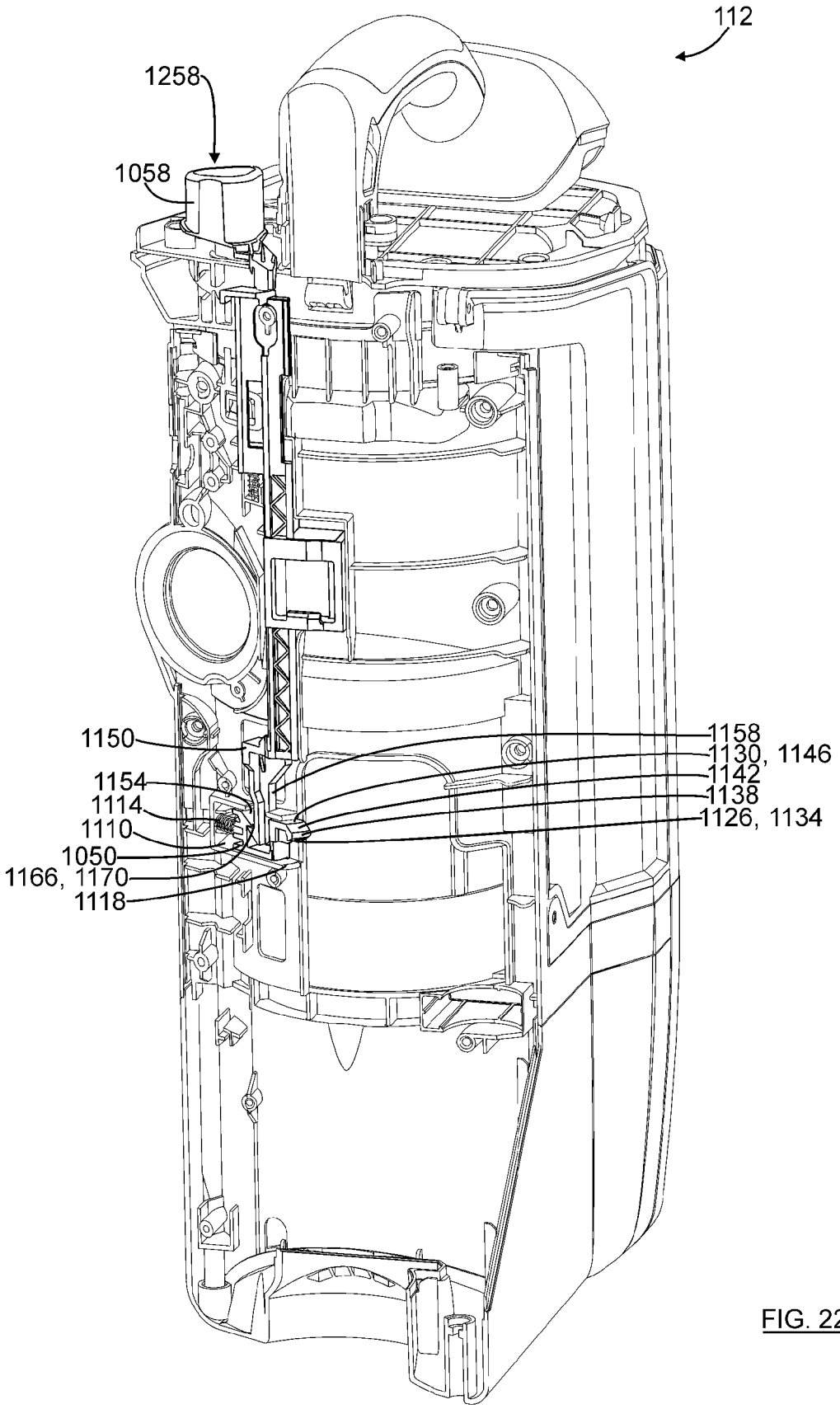
Figure 22D:
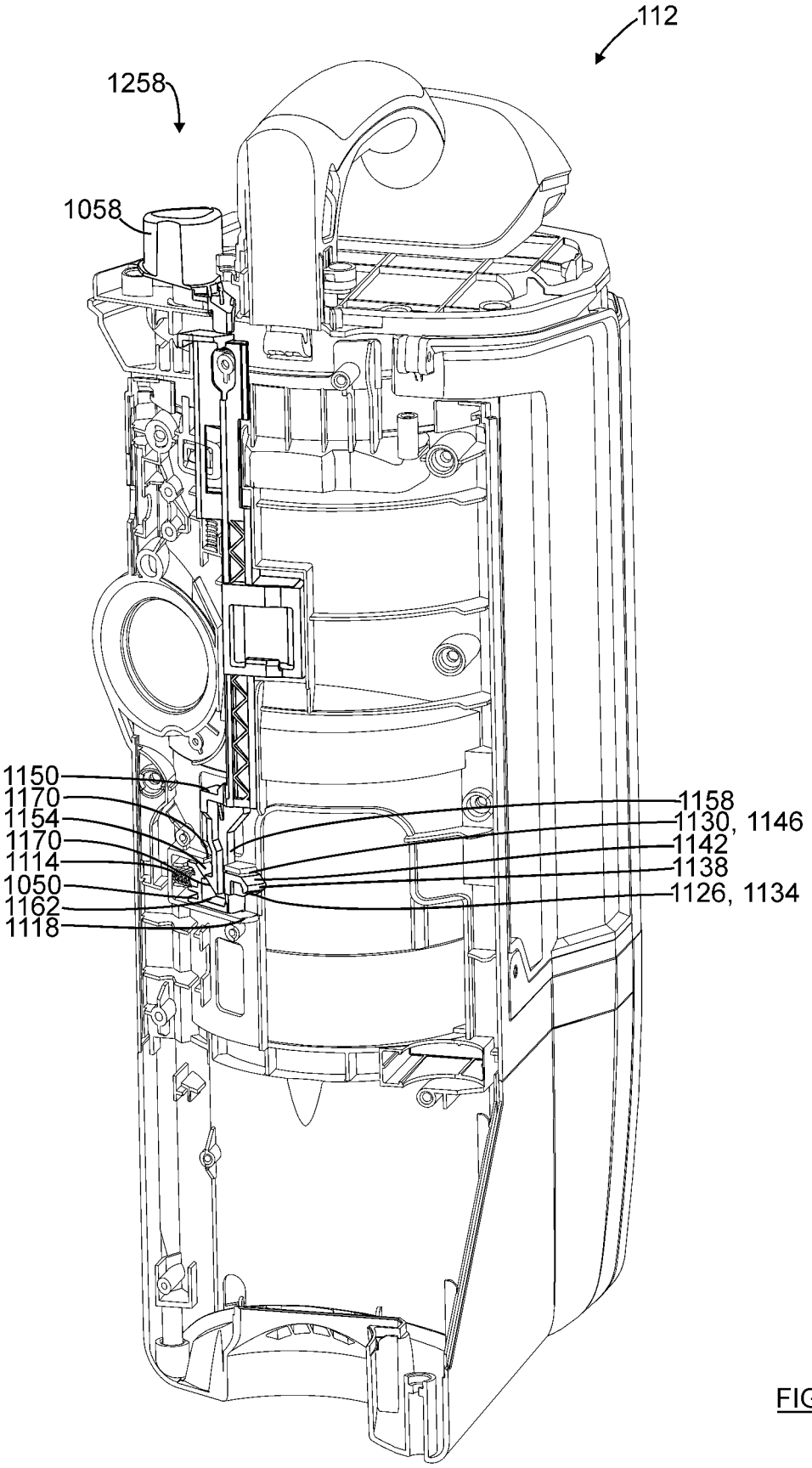

In the example shown, locking mechanism 1258 may include an unlock actuator 1058 drivingly connected to a locking member 1050 by a longitudinally extending transmission member 1150. Locking member 1050 may translate laterally outwardly to engage with upper portion 104, placing locking mechanism 1258 into a locked position (FIG. 22*a*). Vertical translation of longitudinally extending transmission member 1150 toward locking member 1050 (e.g. by interaction with unlock actuator 1058) may urge locking member 1050 to translate laterally inwardly (FIG. 22*b*) to disengage with upper portion 104, placing locking mechanism 1258 in an unlocked position (FIG. 22*c*). Once in the unlocked position, locking mechanism 1258 may remain unlocked until the surface cleaning unit 112 is withdrawn from upper portion 104 or reengaged with the upper portion 104. The act of withdrawing or reengaging surface cleaning unit 112 with upper portion 104 may release locking mechanism 1258 from the unlocked position (FIG. 22*d*), allowing locking mechanism 1258 to move to the locked position when appropriate.

As exemplified, locking mechanism 1258 may be wholly connected to surface cleaning unit 112. When surface cleaning unit 112 is removed from upper portion 104, so too may locking mechanism 1258, which may remain connected to surface cleaning unit 112. In the example shown, locking mechanism 1258 is positioned behind rear surface 1210 of surface cleaning unit 112. Locking member 1050 of locking mechanism 1258 is exemplified as a plunger which is extendable through an opening 1262 in rear surface 1210 of surface cleaning unit 112. Locking member 1050 of locking mechanism 1258 may engage with a front side 1178 of upper portion 104. As exemplified, front side 1178 includes an opening 1266. Opening 1266 may be sized and positioned to receive locking member 1050 when locking mechanism 1258 is in the locked position.

Lock release actuator 1058 may be positioned in any suitable location. Preferably, lock release actuator 1058 is positioned proximate upper end 1066 of surface cleaning apparatus 112. This may permit a user to activate lock release actuator 1058 (e.g. depressing a button actuator) with little or no bending over. Further, lock release actuator 1058 is preferably positioned proximate handle 160. In some embodiments, this may permit a user to simultaneously grasp handle 160 and activate lock release actuator 1058. In the example shown, lock release actuator 1058 is positioned on openable lid 228 of cyclone bin assembly 136. As shown in FIG. 25, lock release actuator 1058 may extend through an opening 1270 in an inner surface of lid 216 for interacting with transmission member 1150. When lid 216 is in an open position, as shown in FIG. 25, lock release actuator 1058 may disengage (e.g. separate from) transmission member 1150. When lid 216 is in a closed position, lock release actuator 1058 may re-engage (e.g. reestablish contact with) transmission member 1150 for driving the translation of transmission member 1150.

Preferably, locking mechanism 1258 inhibits vertical translation of surface cleaning unit 112 away from upper portion 104 (e.g. in the downstream direction) when locking mechanism 1258 is in the locked condition. However, in some embodiments, locking mechanism 1258 may not inhibit forward rotation (i.e. rotation over surface cleaning head 108) of locking mechanism 1258, which in some circumstances may remove locking member 1050 from opening 1266 defeating locking mechanism 1258. Therefore, surface cleaning apparatus 100 may include additional retentive elements for at least inhibiting forward rotation of surface cleaning unit 112 when connected to upper portion 104. For example, one or both of surface cleaning unit 112 and upper portion 104 may include one or more mounting members, such as wings 1174 and/or clip 1206, for mounting surface cleaning unit 112 to upper portion 104 and inhibiting at least forward rotation of surface cleaning unit 112.

Bleed Valve

The following is a description of a bleed valve that may be used by itself in any surface cleaning apparatus or in any combination or sub-combination with any other feature or features disclosed herein.

Referring again to FIG. 1, in some embodiments, surface cleaning apparatus 100 may include one or more bleed valves. A bleed valve may be operable to provide a secondary air inlet into the airflow pathway between the dirty air inlet and the suction motor. For example, if an obstruction occurs at the dirty air inlet (e.g. a clog), the flow of air through the airflow pathway and the suction motor may decline. Where the suction motor relies upon this airflow for cooling, the reduced airflow may lead to overheating of the suction motor. In this case, a bleed valve may be opened to provide a secondary air inlet which may permit the suction generated by the suction motor to draw additional air through the bleed valve to the suction motor. This may help to prevent the suction motor from overheating.

A bleed valve may also be operable to modulate the level of suction developed at the dirty air inlet. Opening the bleed valve may reduce the suction at the dirty air inlet, and closing the bleed valve may restore the suction at the dirty air inlet. This may be useful for selecting a level of suction best suited to a surface to be cleaned. For example, low suction may be recommended for thick carpet and high suction may be recommended for hard floors. In some cases, the bleed valve may have multiple open positions (i.e. corresponding to different degrees of openness), each of which admits a different amount of air, for selecting from among multiple different levels of suction at the dirty air inlet. For example, the bleed valve may be set to a half-open position to draw medium suction for short carpet, or to a fully-open position to draw minimum suction for thick carpet. Further, the bleed valve may be continuously variable between closed and full-open which may allow for precise control of the amount of air admitted through the valve.

Preferably, surface cleaning apparatus 100 may include two bleed valves. A first bleed valve may be provided for preventing the suction motor from overheating, and the second bleed valve may be provided for adjusting the level of suction developed at the dirty air inlet based on the type of surface being cleaned. The first bleed valve may be configured to open and close automatically in response to the pressure and/or airflow in the air flow pathway and may be provided downstream of a pre-motor filter. For example, the first bleed valve may open automatically in response to pressure or airflow below a certain threshold.

The second bleed valve may be selectively operable by a user for setting the level of suction at the dirty air inlet (e.g. in accordance with the recommended level of suction for the surface to be cleaned). For example, the surface cleaning apparatus 100 may include a control member that is may be operatively connected to the second bleed valve by any means known in the art (e.g., electrically, mechanically, or electromechanically coupled to the bleed valve) for setting the position of the bleed valve (e.g. to an open, partially open or a closed position). Examples of suitable control members include dials, switches, levers, slides, buttons, and touchscreens. The bleed valve may be located at any position along the airflow pathway. For example, the bleed valve may provide a secondary air inlet at a portion of the airflow pathway provided by, e.g., the handle 160, wand 180 or hose 124.

Optionally, handle 160 may form part of the airflow pathway between dirty air inlet 116 and surface cleaning unit 112. For example, handle 160 may be interposed between wand 180 and hose 124. If handle 160 forms part of the airflow pathway, then the bleed valve may be part of handle 160. For example, the bleed valve may be internal of handle 160 (in which case handle 160 is provided with a grill or the like for the upstream side of the bleed valve to be in communication with the ambient air) or it may be located on an exterior portion (e.g., in a recess provided in the outer surface of handle 160). In such a case, the control for the bleed valve may be provided on handle 160 or remotely therefrom.

Alternatively, handle 160 may surround a portion of wand 180 and/or hose 124 without participating in the airflow pathway to the surface cleaning unit 112. In such a case, the control for the bleed valve may be provided on handle 160 and operatively controlled to the bleed valve. For example, the bleed valve may be provided in the hose or a hose cuff and operated by a control provided on handle 160.

Reference is now made to FIGS. 26 and 27*a*-27*b*. In the example shown, a bleed valve 2002 is located inside handle 160. Bleed valve 2002 may be any suitable valve. As exemplified, bleed valve 2002 may include a socket 2006 and a plug 2010. In the example shown, handle 160 forms part of the airflow pathway from the surface cleaning head 108 to hose 124 (FIG. 1). For example, handle 160 may include a conduit 2014 which may be in airflow communication with upstream hose 124 (FIG. 1). Socket 2006 may provide a secondary inlet to the airflow pathway in addition to primary inlet at, e.g., the dirty air inlet of the surface cleaning head or upstream end 200 of handle 160 if handle 160 is disconnected from wand 180. For example, socket 2006 may provide an opening into conduit 2014 to admit ambient air into the airflow pathway as exemplified by the arrows in FIG. 12*a*.

Bleed valve 2002 may include at least an open position in which air may be admitted into the airflow pathway through bleed valve 2002, and a closed position in which air is not permitted into the airflow pathway through bleed valve 2002. As exemplified, plug 2010 may be movable between an open position in which plug 2010 is spaced apart from socket 2006 as shown in FIG. 27*a*, and a closed position in which plug 2010 seals socket 2006. Preferably, handle 160 includes one or more vents 2022 which allow ambient air to pass through handle 160 toward socket 2006 when bleed valve 2002 is in the open position. Optionally, socket 2006 may include a seal (e.g. O-ring) which may compress against socket 2006 to form an air-tight seal with socket 2006 when in the closed position.

A control member may be provided to manually operate bleed valve 2002. Preferably, the control member is located on or adjacent the handle 160 to provide easy user access while operating the surface cleaning apparatus 100. For example, the control member may be provided at a location that is operable by the same hand of a user that is user to move the surface cleaning head 108 using handle 160. Accordingly, for example, the control member may be provided on hand grip portion 182. In this way, a user may use, e.g., their thumb to adjust the control while vacuuming. Accordingly, if a user moves a surface cleaning head 108 from a hard floor to an area rug, the user may easily adjust the position of bleed valve 2002.

In the example shown, handle 160 includes a brush control 3026. Brush control 3026 is an example of a control member. Brush control 3026 may be operably coupled to bleed valve 2002 to select the position of bleed valve 2002. For example, brush control 3026 may include at least a first position shown in FIG. 27*a* which moves bleed valve 2002 to the open position, and a second position shown in FIG. 27*b* which moves bleed valve 2002 to the closed position.

The control member may be operably connected to bleed valve 2002 in any suitable manner. For example, the control member may be connected to bleed valve 2002 by an electrical, mechanical, or electromechanical connection. In the example shown, brush control 3026 is mechanically coupled to bleed valve 2002 by a linkage 2030. For example, the bleed valve may comprise a plug 2010. Brush control 3026, linkage 2030 and plug 2010 may be made as a one piece assembly, e.g., they made molded as a unit. And may me slidably mounted in handle 160 in a tack. Brush control 3026 may be movable upwardly to the open position shown in FIG. 27*a*, which moves plug 2010 away from socket 2006, and may be movable downwardly to the closed position shown in FIG. 27*b*, which moves plug 2010 into socket 2006.

In some embodiments, the control member may be positionable at one or more additional positions between the open position and the closed position. For example, brush control 3026 may be positionable in one or more intermediate positions between the open (FIG. 27*a*) and closed positions (FIG. 27*b*). Each intermediate position of brush control 3026 may move plug 2010 to a different distance from socket 2006 to admit a different amount of air to enter the airflow pathway. As exemplified, moving brush control 3026 to an intermediate position closer to the openmost position of brush control 3026 exemplified in FIG. 27*a* moves plug 2010 from inlet 2006 thereby allowing more air to enter the airflow pathway, and vice versa.

Optionally, handle 160 may include one or more visual markings, which may be provided adjacent brush control 3026 (e.g., below brush control 3026 in a panel as exemplified in FIG. 11) which correspond to positions of the control member. For example, the visual markings may identify the positions of brush control 3026 which are recommended for different floor cleaning surface types. Such markings may help to remind users of the recommended bleed valve setting for particular surface types. In some embodiments, handle 160 includes a THICK CARPET marking identifying the openmost position of brush control 3026, a HARD FLOOR marking identifying the closed position of brush control 3026, and a SHORT CARPET marking identifying an intermediate position of brush control 3026.

Brush Control

The following is a description of a brush control that may be used by itself in any surface cleaning apparatus or in any combination or sub-combination with any other feature or features disclosed herein.

Reference is now made to FIG. 28. In some embodiments, surface cleaning apparatus 100 includes an electrically powered peripheral device, other than a suction motor. For example, surface cleaning head 108 may include a power brush 2034. Power brush 2034 may include a plurality of bristles 2038 which are driven by a brush motor 3094 (e.g. an electric motor) 3094 as shown in FIG. 30 to rotate about an axis of rotation 2042. In use, bristles 2038 may be positioned to contact the surface to be cleaned, in order to dislodge and collect dirt and hair. The brush drive motor may be drivingly connected to the brush by any means known in the surface cleaning arts, such as a belt drive or direct drive.

Generally, it is recommended to use a power brush on certain surface types, such as carpet which may retain dirt and hair more persistently, and to disable the power brush for certain other surface types, such as hard surfaces (e.g. hardwood or tiles) where the bristles may deflect dirt away from the dirty air inlet or scratch the surface. Further, it may be recommended to change the speed of the power brush (i.e. the rotary speed of the bristles) to a faster speed for certain surface types (e.g. thick carpet) than for other surface types (e.g. short carpet).

Reference is now made to FIGS. 27*a*-27*b*, 28, 29 and 30. In some embodiments, the surface cleaning apparatus 100 may include a control member operably connected to adjust the speed of the brush. The control member may be operably connected to the brush drive motor or to a transmission member positioned between the brush drive motor and the brush to selectively activate and/or control the speed of the power brush. This may permit a user to selectively activate, deactivate, speed up or slow down the power brush according to the surface type to be cleaned. The control member may be mechanically, electrically, or electromechanically coupled to the brush motor controlling the speed of the power brush. Examples of suitable control members include dials, switches, levers, slides, buttons, and touch-screens.

As exemplified, handle 160 includes a brush control 3026. Brush control 3026 is an example of a suitable control member. Brush control 3026 may be electrically coupled to the brush motor of power brush 2034 in any suitable manner, such as by way of an electrical connector or by way of one or more conductors as shown, for example, in FIG. 30. In the example shown, brush control 3026 is movable between at least an off position as shown in FIG. 27*b* and a high speed position as shown in FIG. 27*a*. In some cases, brush control 3026 includes, or is mechanically coupled to, a multi-position switch 3020, and may also have one or more intermediate selectable positions in addition to the off and high speed positions shown, such as a medium speed. In some embodiments, brush control 3026 is infinitely positionable between the off and high speed positions shown for selecting a speed within a continuous spectrum from off to high speed. In use, a user may move brush control 3026 from the off position to any other non-zero speed position to operate the power brush at the selected speed.

In the illustrated embodiments, multi-position switch 3020 can be positioned electrically downstream from a main power control 3014. Multi-position switch 3020 is provided in electrical communication between the main power control 3014 and the surface cleaning head 108 and, in particular, brush motor 3094. In this configuration, the supply of power to the surface cleaning head 108 and brush motor 3094 may be controlled via the multi-position switch 3020 and one or more processors and circuits as exemplified herein with reference to FIGS. 30 and 31. This allows the surface cleaning head 108 to be selectively energized or de-energized while the surface cleaning unit 112, and the suction motor 128 therein, remain energized. Using the multi-position switch 3020, a user may, e.g., control the rotating brush within the surface cleaning head when cleaning one surface (e.g. a thick carpet), may control the rotating brush within the surface cleaning head to rotate at a lower or intermediate speed when cleaning another surface (e.g., a short carpet) and may turn off the rotating brush when cleaning another surface (e.g. a non-carpeted floor such as a tile or hardwood floor) without interrupting the suction supplied by the surface cleaning unit 112.

The multi-position switch 3020 may be located at any position that is electrically connected to the main power control 3014 and the surface cleaning head 108. In the illustrated embodiment, the multi-position switch 3020 is provided on the handle 160, and is generally adjacent the hand grip portion 182 and may be on the hand grip portion 182. This may allow a user to operate the brush control 3026 and thus control the power brush during use, such as by changing the position of brush control 3026, as the cleaning surface type changes (e.g., using the same hand as is moving surface cleaning head 108 using handle 160). For example, brush control 3026 may be positioned on the handle 160 so that it is operable by a user's hand, while the user uses the hand to direct the surface cleaning head. Alternatively, the auxiliary power switch may be provided in another location, including, for example on the surface cleaning unit, on the surface cleaning head, on the upper or lower wand portion, on the hand grip, or on the cuff or other portion of the hose 124.

In some embodiments, an indicator 3010 may be provided adjacent brush control 3026, with visual markings which communicate a correspondence between the different positions of brush control 3026 and the speed of power brush 2034. For example, visual markings may be provided for OFF, LOW SPEED, and HIGH SPEED. Alternatively or in addition, the visual markings may communicate a correspondence between the different positions of brush control 3026 and the recommended surface type for the corresponding speed. For example, visual markings may be provided for HARD FLOOR (at the off position), SHORT CARPET (at the medium or intermediate speed position), and THICK CARPET (at the high speed position).

In some embodiments, the indicator may be illuminated, for example using LEDs. For example, a backlight LED may be provided to align with the selected position of the brush control 3026 when the multi-position switch is moved by the user. In another example, separate backlight LEDs for each position of the brush control 3026 may be selected enabled or disabled, for example by a handle control processor, when the switch is moved.

Combination Bleed Valve and Brush Control

The following is a description of a combination bleed valve and brush control that may be used by itself in any surface cleaning apparatus or in any combination or sub-combination with any other feature or features disclosed herein.

In some embodiments, surface cleaning apparatus may include both the manually operable bleed valve and the brush speed selector as discussed separately herein. In such an embodiment, each of the manually operable bleed valve and the brush speed selector may have their own individual control.

Preferably, one control member may be used to control both the position (i.e. openness) of the bleed valve, and the brush speed of the power brush. This may permit a user to use one control member to adjust the suction developed at the dirty air inlet and the brush speed of the power brush. In the example shown, slider switch 2026 is mechanically coupled to bleed valve 2002, and electrically connected to the brush drive (not shown) of power brush 2034.

Each position of the control member may therefore simultaneously correspond to a pair of settings: a bleed valve position and a power brush speed. Adjusting the position of the control member may automatically change both the bleed valve position and the power brush speed according to the corresponding pair of settings. In some embodiments, each pair of settings may correspond to settings that recommended for a particular cleaning surface type. For example, it may be recommended when cleaning hard flooring that the bleed valve should be closed and the power brush should be turned off. Accordingly, there may be a position on the control member for closing the bleed valve and turning off the power brush. As exemplified, when brush control 3036 is moved to the lowest position shown in FIG. 27*b*, the bleed valve 2002 may be fully closed and the power brush 2034 may be turned off.

In another example, it may be recommended when cleaning thick carpet that the bleed valve should be fully open and the power brush speed should be set to maximum. Accordingly, there may be a position on the control member for fully opening the bleed valve and setting the power brush speed to maximum. As exemplified, when brush control 3036 is moved to the uppermost position shown in FIG. 27*a*, the bleed valve 2002 may be fully open and the speed of the power brush 2034 may be set to maximum.

The control member may be positioned anywhere on surface cleaning apparatus 100. Preferably, the control member is positioned on handle 160. As exemplified, brush control 3036 is positioned on hand grip portion 182 of handle 160. This may provide easy access for a user to control the power brush and bleed valve during use, such by changing the position of the control member, as the cleaning surface type changes.

If visual markings are provided, which are preferably located adjacent the control member, then the markings may be used to communication a recommended position of the control member based on the type of surface being cleaned. Therefore, a user need not consider whether a high or low brush speed is needed or an open or closed position of the bleed valve is needed. Instead, the user may move the control member to position corresponding to the floor type being cleaned, e.g., HARD FLOOR, SHORT CARPET, and THICK CARPET and the positioning of the control member in the selected position will automatically adjust the speed of the brush and the position of the bleed valve to the recommended positions corresponding to the selected position of the control member.

It will be appreciated that other visual markings may be provided, such as OFF, LOW SPEED, and HIGH SPEED in regards to the power brush speed and/or CLOSED, PARTIALLY CLOSED, and OPEN in regards to the position of the bleed valve 2002.

Main Power Control

The following is a description of a main power control that may be used by itself in any surface cleaning apparatus or in any combination or sub-combination with any other feature or features disclosed herein.

The surface cleaning apparatus 100 may include a main power control or master on/off electrical switch 3014 that controls the supply of power received from the wall socket (or any other type of power source that is connected to the surface cleaning unit, including, for example, a battery). Preferably, the main power control 3014 controls the supply of power to the suction motor 128, brush motor 3094 and other components within the surface cleaning apparatus 100. Accordingly, main power control 3014 may be used to turn all electrical components on or off, or if a component has an individual on/off control switch such as brush control 3026, main power control 3014 may energize a circuit including the individual on/off control switch. In some embodiments, and as described further with respect to FIGS. 30 and 31, main power control 3014 is interposed in series with one or more hot conductors, which allows the main power control 3014 to be provided in handle 160, wand 180, hose 124, surface cleaning head 108 or surface cleaning unit 112.

When the main power control 3014 is off, the surface cleaning unit 112 (and the hose 124, surface cleaning head 108 and other components) may be de-energized. When the main power control 3014 is on, the surface cleaning unit 112 (and hose 124, surface cleaning head 108, etc.) may be energized.

Main power control 3014 may be located at any position. Preferably, main power control 3014 is located on or adjacent the handle 160 to provide easy user access while operating the surface cleaning apparatus 100. For example, main power control 3014 may be provided at a location that is operable by the same hand of a user that is user to move the surface cleaning head 108 using handle 160. Accordingly, for example, the control member may be provided on hand grip portion 182. In this way, a user may use, e.g., their thumb to adjust the control while vacuuming.

As exemplified, handle 160 includes a main power control 3014. Main power control 3014 may be electrically coupled to the suction motor 128 of surface cleaning unit 112 and the brush motor 3094 of power brush 2034 in any suitable manner, such as by way of an electrical connector or by way of one or more conductors as shown, for example, in FIGS. 30 and 31. In the example shown, main power control 3014 is a toggle switch movable between an off position and on position. In some cases, main power control 3014 may be a slider switch or other suitable switch.

In the illustrated embodiments, main power control 3014 may be interposed between a hot conductor 3510 of an AC electrical plug and a power control conductor 3550 for controlling a suction motor relay circuit 3090. In this configuration, the supply of power to the suction motor 128 may be controlled via the main power control 3014, which may be located in the handle 160. This allows the surface cleaning unit 112 to be selectively energized or de-energized from the handle by a user while grasping the hand grip, and without requiring the user to locate a power control on the surface cleaning unit 112 or surface cleaning head 108.

Electrified Hose

The following is a description of an electrified, stretchable suction hose that may be used by itself in any surface cleaning apparatus or in any combination or sub-combination with any other feature or features disclosed herein. Advantageously, an electrified hose may be mounted directly or indirectly to a surface cleaning unit 112 and removable therewith from upper portion 104. Accordingly, when the surface cleaning unit is used in a hand carriable configuration, the electrified hose may still be electrified and used to power a tool or handle 160.

In at least some embodiments, hose 124 may include one or more electrical conductors (e.g. wires) that can carry electrical power and/or control or data signals between the upstream and downstream ends of the hose. Optionally, the conductors within the hose may be limited to carrying electrical power and the transmission of control or data signals may be accomplished using another suitable means. For example, the means for transmitting the control or data signals may be a wireless transmitter, which may help reduce the need to provide separate data conductors in addition to the hose.

Upstream or downstream ends of hose 124 may include multi-conductor connectors that are mateable with corresponding multi-conductor connectors of surface cleaning unit 112 or handle 160. In the illustrated example of FIGS. 16 and 30, a downstream end of hose 124 has a multi-conductor connector 3042, in which male push-type connectors for each of the respective conductors of hose 124 are provided. Multi-conductor connector 3042 is mateable with a multi-conductor connector 3038 of surface cleaning unit 112, which has female push-type connectors corresponding to the male connectors of multi-conductor connector 3042. It will be appreciated that the male-female relationship may be reversed, or connectors of other suitable types may be used.

Providing electrical conductors within the hose 124 may allow the hose to transmit electrical signals (power and/or control signals) between its upstream and downstream ends. Optionally, the conductors may be attached to the inner surface of the hose (i.e. within the air flow path), attached to the outer surface of the hose or incorporated within the sidewall of the hose 124. This may eliminate the need for a separate wire or other power transfer apparatus to be provided in addition to the hose and/or to run in parallel with the hose. Reducing the need for external power or control wires may reduce the chances that the exposed electrical wires may be damaged, unintentionally disconnected during use or otherwise compromised.

Providing electrical conductors within the hose 124 may allow the hose 124 to serve as a primary, and optionally only, electrical connection between the surface cleaning unit 112 and the surface cleaning head 108 (or any other portion of the vacuum cleaner that is connected to an external power supply) and the rest of the vacuum cleaner upstream from the hose. Optionally, in configurations in which the surface cleaning unit 112 is the only portion of the vacuum cleaner connected to the electrical power cord which is plugged into the wall, the hose 124 may serve as the primary electrical conduit for carrying power and/or control signals to the surface cleaning head 108, a plurality of cleaning tools, auxiliary tools, lights, sensors, power tools and other components that are connected to the upstream end of the hose 124 and used in combination with the surface cleaning unit. For example, as exemplified, hose 124 may be wired in series with wand 108 and therefore hose 124 and wand 180 (and optionally handle 160 to which each of hose 124 and wand 180 may be removably connected) may be used to provide power from surface cleaning unit 112 to surface cleaning head 108.

In an example embodiment, surface cleaning unit 112 is connected to the source of power. Accordingly hose 124 is used to carry a power control signal used to energize surface cleaning unit 112. In addition, hose 124 is used to carry a power control signal and power to energize surface cleaning head 108. In other embodiments, hose 124 may perform only one or two of these functions.

It will be appreciated that transmitting power via the hose 124 will allow the hose to be used to supply power to cleaning tools and/or other power tools which may eliminate the need to provide a separate power connection for the tools or to require the use of batteries or an air turbine. For example, using an electrified hose to supply electrical power may allow the surface cleaning head 108 to be powered in a variety of different cleaning configurations, including those in which the surface cleaning unit 112 is removed from upper portion 104.

In some embodiments, some or all of the wand 180 may also be configured to include conductors corresponding to those of hose 124, to transmit power and/or signals. This may help provide an electrical connection between the hose, e.g., upstream end of the hose 124, and other portions of the vacuum cleaner.

Referring now to FIGS. 1 and 30, the handle 160 and surface cleaning unit 112 are provided with electrical connections via conductors and connectors. Providing electrical connections between the portions of the apparatus allows power to be transmitted from the surface cleaning unit 112 to the handle 160 and on to the surface cleaning head 108 (for example to power a rotating brush assembly) via the wand 180 and without the need for a separate electrical wire or connection.

In the example embodiment of FIGS. 30 and 31, a power control circuit 3002 is provided in surface cleaning unit 112. Power control circuit 3002 has three conductors connected via a multi-conductor connector to respective conductors of hose 124: a hot conductor 3510, a neutral conductor 3520 and a power control conductor 3550*b*. Hose 124 carries the hot, neutral and power control conductors, each of which is connected using a multi-conductor connector to a respective conductor of the handle control circuit 3102.

Handle control circuit has a main power control 3014 interposed in a hot conductor 3510*b*. A power control conductor 3550*a* is tied to the downstream portion of hot conductor 3510*b*, such that it can only be energized when the main power control 3014 is on (e.g., switch is closed). When main power control 3014 is on, power control conductor 3550*a* also becomes 'hot' and energizes power control circuit 3002. Power control circuit 3002 includes a suction motor relay circuit 3090 which is activated when power control conductor 3550*a* and 3550*b* are energized, and operates to close a relay, allowing suction motor 128 to become energized.

Electrified Wand

The following is a description of an electrified wand that may be used by itself in any surface cleaning apparatus or in any combination or sub-combination with any other feature or features disclosed herein. Advantageously, an electrified wand may be mounted directly or indirectly to a surface cleaning unit 112 and removable therewith from a base. The electrified wand may be used to power a tool or surface cleaning head 108.

In at least some embodiments, wand 180 may include one or more electrical conductors (e.g. wires) that can carry electrical power and/or control or data signals between the ends of the hose. Optionally, the conductors within the wand may be limited to carrying electrical power and the transmission of control or data signals may be accomplished using another suitable means. For example, the means for transmitting the control or data signals may be a wireless transmitter, which may help reduce the need to provide separate data conductors in addition to the wand.

Upstream and/or downstream ends of wands 180 may include multi-conductor connectors that are mateable with corresponding multi-conductor connectors of surface cleaning head 108 and/or handle 160 respectively. In the illustrate example of FIGS. 13 and 30, upper portion 104 which is mounted to surface cleaning head 108 has a multi-conductor connector 1042, in which male push-type connectors for each of the respective conductors of wand 180 are provided. Multi-conductor connector 1042 is mateable with a multi-conductor connector 1038 of an upstream end of wand 180, which has female push-type connectors corresponding to the male connectors of multi-conductor connector 1042. It will be appreciated that the male-female relationship may be reversed, or connectors of other suitable types may be used. It will be appreciated that multi-conductor connector 1042 may be provided on surface cleaning head 108 or any other location on upper portion 104, such as an exterior surface thereof. Preferably, it is located internally of upper portion 104 such that an electrical connection is made when wand 180 is inserted into upper portion 104.

Similarly, a downstream end of wand 180 may be provided with a multi-conductor connector 3344, which is mateable with a multi-conductor connector 2046 of handle 180, as seen in FIGS. 27*a* and 27*b*.

Providing electrical conductors within the wand 180 may allow the wand to transmit electrical signals (power and/or control signals) between its upstream and downstream ends. Optionally, the conductors may be attached to the inner surface of the wand (i.e. within the air flow path), attached to the outer surface of the wand or incorporated within the sidewall of the wand 180. This may eliminate the need for a separate wire or other power transfer apparatus to be provided in addition to the wand and/or to run in parallel with the wand. Reducing the need for external power or control wires may reduce the chances that the exposed electrical wires may be damaged, unintentionally disconnected during use or otherwise compromised.

Providing electrical conductors within the wand 180 may allow the wand 180 to serve as a primary, and optionally only, electrical connection between the surface cleaning unit 112 and the surface cleaning head 108 (or any other portion of the vacuum cleaner that is connected to an external power supply) and the rest of the vacuum cleaner upstream from the wand. Optionally, in configurations in which the surface cleaning unit 112 is the only portion of the vacuum cleaner connected to the electrical power cord which is plugged into the wall, the wand 180 may serve as the primary electrical conduit (e.g., in series with hose 124) for carrying power and/or control signals to the surface cleaning head 108, a plurality of cleaning tools, auxiliary tools, lights, sensors, power tools and other components that are connected to the upstream end of the wand 180 and used in combination with the surface cleaning unit. In an example embodiment, wand 180 is used to carry a power control signal used to energize surface cleaning unit 112.

Transmitting power via the wand 180 may also allow the wand to be used to supply power to cleaning tools and/or other power tools which may eliminate the need to provide a separate power connection for the tools or to require the use of batteries or an air turbine. For example, using an electrified wand to supply electrical power may allow the surface cleaning head 108 to be powered in a variety of different cleaning configurations, including those in which the surface cleaning unit 112 is removed from upper portion 104.

Referring now to FIGS. 1 and 30, the handle 160 and surface cleaning head 108 are provided with electrical connections via conductors and connectors. Providing electrical connections between the portions of the apparatus allows power to be transmitted from the surface cleaning unit 112 to the handle 160 and on to the surface cleaning head 108 (for example to power a rotating brush assembly) via the wand 180 and without the need for a separate electrical wire or connection. In other embodiments, it will be appreciated that hose 124 may be connected directly to wand 180 and the controls provided on wither the hose 124 or wand 180.

In the example embodiment of FIGS. 30 and 31, a handle control circuit 3102 is provided in handle 160. Handle control circuit 3102 has three conductors connected via a multi-conductor connector to respective conductors of wand 180: a hot conductor 3510*c*, a neutral conductor 3520*c* and a brush control conductor 3552*a*. Wand 180 carries the hot, neutral and brush control conductors, each of which is connected using a multi-conductor connector to a respective conductor of the brush control circuit 3202.

Handle control circuit has a handle control processor 3110, which is coupled to brush control 3020. Based on the selected position of brush control 3020, handle control processor 3110 is configured to transmit a brush control signal via brush control conductor 3552*a*. The signal is relayed via the control conductor of wand 180 to brush control conductor 3552*b* of brush control circuit 3202. Brush control circuit 3202 has a brush control processor 3210, which receives the brush control signal, and is configured to modulate a motor speed of brush motor 3094 accordingly.

Each of handle control processor 3110 and brush control processor 3210 may be a suitable microprocessor or microcontroller. In one example embodiment, the processors are 8-bit microcontrollers with a RISC-type instruction set.

Lighted Tools Powered by Electrified Hose

The following is a description of lighted tools that may be used by itself in any surface cleaning apparatus or in any combination or sub-combination with any other feature or features disclosed herein.

Optionally, one or more light source may be provided in some or all of cleaning tools that are used in combination with the surface cleaning apparatus.

Providing a light source on some or all of the tools may allow a user to direct the light onto a surface being cleaned. The light source may also illuminate the downstream end of the accessory that is being connected by the user, which may help a user see the connector details and/or align the accessory for proper assembly, especially in low light conditions. The light source can be any suitable light source, including, for example an incandescent light bulb, a fluorescent light bulb, a light emitting diode (LED), the end of a fiber optic filament and any other suitable source.

Alternatively, instead of providing the light source on the auxiliary cleaning tools, an LED may be provided in the downstream portion of the connector itself (for example on the upstream end of the handle. Preferably, the light source can be provided in the downstream portion of the connector (in the direction of air flow) so that it can remain energized when the connector is separated. A light source on the downstream portion of the connector may be useful to illuminate a transparent or translucent cleaning tool that is attached to the connector, even if the tool does not have its own onboard light source (e.g. via partial internal reflection and/or refraction of the light within the transparent and/or translucent material). Accordingly, the auxiliary tool may comprise a light pipe. This may allow handle 160 to illuminate its surroundings, for example the crevice between a cushion and a couch frame, which may assist a user in seeing or inspecting the surface to be cleaned.

Referring to FIG. 29, the surface cleaning head 108 may include lights, such as LEDs 3024 for illuminating the surface being cleaned. In some cases, it may be desirable to allow a user to turn the brush motor on and off as required, while leaving the LEDs illuminated without increasing the number of conductors provided in the hose 124. Optionally, a switching circuit can be provided that may allow the LEDs to remain powered regardless of the state of the motor driving the rotating brush. In the example embodiment, LEDs 3024 are automatically powered and illuminated when surface cleaning head 108 is energized, whether at a high power or low power setting, while the LEDs 3024 are switched off when the brush motor 3094 is disabled. For example, LEDs 3024 may be controlled by a brush control processor 3210. One example of a suitable switching circuit is explained with reference to FIGS. 30 and 31. Optionally, LEDs 3024 may remain switched on when the brush motor 3094 is disabled.

Similarly, lights for illumination may be provided on other portions of the surface cleaning apparatus and, in particular, on portions that are removable. For example, a handle light 3006 may be provided on handle 160, and may be controlled by handle control processor 3110. Handle light 3006 may be provided near a handle grip and positioned to illuminate an area proximal to the upstream end 200 of handle 160. In another example, a wand light 3030 may be provided on wand 180, near an upstream end 192 of 180. Positioning the lights near upstream ends of handle 160 or wand 180 allows for convenient illumination when using the detached handle or wand to clean dark areas such as corners and crevices.

As with LEDs 3024, handle light 3006 may be automatically switched on when handle is detached from wand 180 and automatically switched off when the handle is re-attached to wand 180. Similarly, wand light 3030 may be automatically powered when wand 180 is detached from surface cleaning head 108 and automatically switched off when wand 180 is re-attached to surface cleaning head 108. Optionally, handle light 3006 may be automatically switched on when wand 180 is detached from surface cleaning head 108 and automatically switched off when wand 180 is re-attached to surface cleaning head 108.

Power Control Circuit

Reference is made to FIGS. 30 and 31 illustrating a schematic diagram of a power control circuit 3002 for a surface cleaning apparatus that may be used by itself in any surface cleaning apparatus or in any combination or sub-combination with any other feature or features disclosed herein.

Power control circuit 3002 comprises a power connector 3040, a suction motor relay circuit and a suction motor 128. It will be appreciated that power control circuit 3002 may also comprise various other elements, such as resistors, capacitors, diodes, transistors, varistors and fuses, the description of which is omitted here to ease explanation and understanding.

Power connector 3040 may be a two- or three-prong power connector, connectable to a 120V or 240V alternating current (AC) power supply. Power connector connects to a line-level or hot conductor 3510 and a neutral conductor 3520.

Hot conductor 3510 may be electrically coupled to a first terminal of a power control switch. In the example embodiment, hot conductor 3510 is coupled, via hose 124, to a first terminal of main power control 3014 of handle control circuit 3102, which is described in further detail herein. Both handle control circuit 3102 and main power control 3014 may be provided in handle 160, rather than in surface cleaning unit 112. A second terminal of main power control 3014 is tied to a power control conductor 3550*a*. Power control conductor 3550*a* is electrically coupled, via hose 124, to power control conductor 3550*b*.

Power control conductor 3550*b* is electrically coupled to suction motor relay circuit 3090. Suction motor relay circuit 3090 is configured such that when the power control conductor 3550*b* is energized (e.g., when main power control 3014 is in the 'on' position), the relay circuit operates to close a relay, allowing suction motor 128 to become electrically coupled to hot conductor 3510, and thereby energized. Conversely, when main power control is 'off' (e.g., switch is open), suction motor relay circuit 3090 is configured to open the relay and thereby de-energize the suction motor 128.

The suction motor relay circuit 3090 allows the main power control 3014 to be disposed elsewhere on the surface cleaning apparatus, for example in handle 160, without requiring separate power and control wiring. It will be appreciated that power control circuit 3002 may also be adapted for a DC circuit, e.g., if the power supply is a battery or the like.

Handle Control Circuit

Reference is made to FIGS. 30 and 31 illustrating a schematic diagram of a handle control circuit 3102 for a surface cleaning apparatus that may be used by itself in any surface cleaning apparatus or in any combination or sub-combination with any other feature or features disclosed herein.

Handle control circuit 3102 includes hot conductors 3510 and 3510*b*, power control conductor 3550*a*, brush control conductor 3552*a*, neutral conductors 3520*b* and 3520*c*, main power control 3014, brush control 3020 and handle control processor 3110. Optionally, handle control circuit 3102 may include one or more indicator lights, whose operation is described with reference to FIG. 32. It will be appreciated that handle control circuit 3102 may also comprise various other elements, such as resistors, capacitors, diodes, transistors, TRIACs (triodes for alternating current) and fuses, the description of which is omitted here to ease explanation and understanding.

Hot conductor 3510 is electrically couplable to hot conductor 3510*b* via main power control 3014. When main power control 3014 is in the 'on' position, hot conductor 3510*b* conducts line-level power, via wand 180 (and multi-conductor connectors), to surface cleaning head 108.

In the example embodiment of FIG. 31, brush control 3020 is a multi-position switch. The switch is electrically connected, via jumpers to input/output pins of handle control processor 3110. Handle control processor 3110 is configured to detect a selected position of the switch, based on the I/O pin signals, and to select a desired brush speed. Based on the selected position of the multi-position switch, the handle control processor 3110 can generate a brush control signal.

A brush control conductor 3552*a* is also electrically coupled to another I/O pin of brush control processor 3210. Accordingly, brush control processor 3210 can transmit the brush control signal via brush control conductor 3552*a* (and wand 180) to a brush control processor 3210 provided in surface cleaning head 108. Thereupon, the brush control processor 3210 is configured to select between at least two different brush power level outputs of the brush motor 128 based on the brush control signal.

It will be appreciated that handle control circuit 3012 may also be adapted for a DC circuit, e.g., if the power supply is a battery or the like.

Brush Control Circuit

Reference is made to FIGS. 30 and 31 illustrating a schematic diagram of a brush control circuit 3202 for a surface cleaning apparatus that may be used by itself in any surface cleaning apparatus or in any combination or sub-combination with any other feature or features disclosed herein.

Brush control circuit 3202 includes hot conductor 3510*d*, brush control conductor 3552*b*, neutral conductor 3520*d*, brush control processor 3210, bridge rectifier 3280 and TRIAC 3290. Optionally, brush control circuit 3202 may include one or more LEDs 3024 and other indicator lights (e.g., a brush indicator light 3086 as shown in FIGS. 12 and 30), under the control of brush control processor 3210 as described with reference to FIG. 33. It will be appreciated that brush control circuit 3202 may also comprise various other elements, such as resistors, capacitors, diodes, transistors and fuses, the description of which is omitted here to ease explanation and understanding.

Hot conductor 3510*d* is electrically coupled to TRIAC 3290, which is coupled to bridge rectifier 3280.

Both brush control conductor 3552*b* and hot conductor 3510*d* are electrically coupled to an I/O pin of brush control processor 3210. The input of the I/O pin can be modulated by a brush control signal provided by handle control processor 3110. Brush control processor 3210 detects the input and determines an appropriate brush power level output for brush motor 3094.

The desired brush power level output can be attained by using another I/O pin of brush control processor 3210 to control TRIAC 3290. For example, brush control processor 3210 may provide a small trigger pulse signal at a controlled phase angle to control the percentage of current that flows through TRIAC 3290 to bridge rectifier 3280. Bridge rectifier converts the incoming modulated current to DC, which allows brush motor 3094 to be powered accordingly. It will be appreciated that brush motor 3094 may be AC or DC powered and brush control circuit 3202 modified accordingly.

Optionally, brush control circuit 3202 may also include an upright switch 3350. In the example embodiment, upright switch 3350 may be coupled to yet another I/O pin of brush control processor 3210, which may detect the state of the upright switch 3350. Upright switch 3350 may also be mechanically coupled to surface cleaning head 108 and upper portion 104, such that the switch is engaged in the 'on' position when the upper portion 104 is inclined relative to the vertical, and disengaged in the 'off' position when the upper portion 104 is returned to the vertical.

It will be appreciated that brush control circuit 3202 may also be adapted for a DC circuit, e.g., if the power supply is a battery or the like.

Indicator Light Logic

The following is a description of an indicator light circuit logic that may be used by itself in any surface cleaning apparatus or in any combination or sub-combination with any other feature or features disclosed herein.

Reference is made to FIG. 32, which illustrates a logic flow diagram for operating various indicator lights of surface cleaning apparatus 100. In the example embodiment illustrated, the logic flow is for controlling brush indicator light 3086 and headlight LEDs 3024 of surface cleaning head 108, handle light 3006 and brush selection indicators 3010*a*, 3010*b* and 3010*c* (FIG. 26).

The logic flow may be executed by any suitable processor. In the illustrated example, the logic flow is executed by handle control processor 3110 and brush control processor 3210 in co-operation. For ease of exposition, only one processor will be referred to herein, however it will be appreciated that various acts of the logic flow may be performed by one or the other, or both, of handle control processor 3110 and brush control processor 3210.

Logic flow 3600 begins at 3602. At 3606, the processor determines, based on one or more switches, or based on a state of the circuits formed by conductors within hose 124, whether hose 124 is in a 'home' position (e.g., whether the hose 124 and handle 160 are attached to wand 180).

If it is determined at 3606 that the hose 124 is not in a 'home' position, handle light 3006 may be enabled, to provide illumination for the user while using the handle 160, and also to provide a visual indication that the handle 160 is not in complete engagement with wand 180.

If it is determined at 3606 that the hose 124 is in the 'home' position, handle light 3006 may be disabled, and LEDs 3024 of surface cleaning head 108 may be enabled at 3614. LEDs 3024 are arranged in a strip, and may act as headlights for the surface cleaning head, illuminating the surface to be cleaned.

At 3618, the processor determines a position of brush control 3020. If a 'thick carpet' mode is presently selected by brush control 3020, a 'thick carpet' indicator may be enabled at 3622 and brush indicator 3086 may also be enabled. Other indicator lights not corresponding to a currently-selected mode, such as the 'short carpet' or 'bare floor' indicators, may be disabled.

Brush indicator 3086 indicates that the brush motor is engaged, and that the brushes are rotating.

If instead, a 'short carpet' mode is presently selected by brush control 3020, the processor determines this at 3630, and enables a 'short carpet' indicator at 3634, along with brush indicator 3086. Other indicator lights not corresponding to a currently-selected mode, such as the 'thick carpet' or 'bare floor' indicators, may be disabled.

If instead, a 'bare floor' mode is presently selected by brush control 3020, the processor determines this at 3642, and enables a 'bare floor' indicator at 3642. Brush indicator 3086 may be disabled, along with other indicator lights not corresponding to a currently-selected mode, such as the 'thick carpet' or 'short carpet' indicators.

The processor or processors may continuously monitor the handle control circuit 3102 and brush control circuit 3202 for any changes in state, such as the user detaching the handle 160 from wand 180, or changing the selected mode via brush control 3020. When a change is detected, the logic flow may be repeated.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A surface cleaning apparatus comprising:

a) a surface cleaning head comprising, a brush driven by a brush motor, a dirty air inlet and a cleaning head air outlet;

b) an upper portion moveably mounted to the surface cleaning head between a storage position and a floor cleaning position;

c) an air flow path extending from the cleaning head air outlet to a clean air outlet;

d) an air treatment member and a suction motor provided in the air flow path;

e) the air flow path comprising a flexible electrified air flow conduit wherein the brush motor is electrically connected to a power source by a circuit that includes the flexible electrified air flow conduit; and, f) a handle assembly drivingly connected to the surface cleaning head and comprising a main power control and a brush control controllingly coupled to the brush motor.

2. The surface cleaning apparatus of claim 1 wherein the handle assembly comprises a handle useable by a hand of a user to direct the surface cleaning head and the brush control and the main power control are each operable by the hand while the user uses the hand to direct the surface cleaning head.

3. The surface cleaning apparatus of claim 1 wherein the handle assembly comprises a handle and the brush control and the main power control are each positioned proximate the handle.

4. The surface cleaning apparatus of claim 1 wherein the handle assembly comprises a handle and the brush control and the main power control are each positioned on the handle.

5. The surface cleaning apparatus of claim 1 wherein the brush control is adjustable such that the brush motor is operable in at least two different modes.

6. The surface cleaning apparatus of claim 5 wherein the brush control comprises a multi-position switch.

7. The surface cleaning apparatus of claim 1 wherein the upper portion comprises a rigid airflow conduit removably connectable to the cleaning head air outlet, the airflow conduit comprising a conduit air inlet and a conduit air outlet, the conduit air inlet having an associated multi-conductor connector mateable with a multi-conductor connector of the surface cleaning head.

8. The surface cleaning apparatus of claim 1 wherein the brush control is a multi-position control, the circuit comprises a handle control processor coupled to the multi-position control and a brush control processor, wherein the handle control processor is configured to transmit a brush control signal via a control conductor to the brush control processor based on a selected position of the multi-position control, and wherein the brush control processor is configured to sequentially select between at least two different brush power level outputs of the brush motor based on the brush control signal.

9. The surface cleaning apparatus of claim 8 wherein the main power control is provided in series with the control conductor and a hot conductor.

10. The surface cleaning apparatus of claim 1 wherein the upper portion comprises a rigid airflow conduit having a lower end that is removably connectable in air flow communication and electrically connectable to the surface cleaning head, and the handle assembly is removably connectable in air flow communication and electrically connectable to an upper end of the rigid airflow conduit.

11. The surface cleaning apparatus of claim 10 wherein the upper end of the rigid conduit is an outlet end and the flexible electrified air flow conduit is downstream of the upper end and is electrically connected to the rigid conduit via the handle assembly.

12. The surface cleaning apparatus of claim 1 further comprising a light source disposed on the handle assembly.

13. The surface cleaning apparatus of claim 12 wherein the light source is automatically powered when the handle assembly is electrically disconnected from the surface cleaning head.

14. The surface cleaning apparatus of claim 1 further comprising a surface cleaning unit removably mounted to the support structure, the surface cleaning unit comprising the suction motor and the air treatment member.

15. A surface cleaning apparatus comprising:

a) a surface cleaning head comprising, a brush driven by a brush motor, a dirty air inlet and a cleaning head air outlet;

b) an upper portion moveably mounted to the surface cleaning head between a storage position and a floor cleaning position;

c) an air flow path extending from the cleaning head air outlet to a clean air outlet;

d) an air treatment member and a suction motor provided in the air flow path;

e) the air flow path comprising a flexible electrified air flow conduit wherein the brush motor is controllingly connected to a power source by a circuit that includes the flexible electrified air flow conduit; and, f) a handle assembly drivingly connected to the surface cleaning head and a light source disposed on the handle assembly.

16. The surface cleaning apparatus of claim 15 wherein the light source is automatically powered when the handle assembly is electrically disconnected from the surface cleaning head.

17. The surface cleaning apparatus of claim 15 further comprising at least one of a main power control and a brush control controllingly coupled to the brush motor positioned proximate the handle assembly.

18. The surface cleaning apparatus of claim 17 wherein the handle assembly comprises a handle useable by a hand of a user to direct the surface cleaning head and the at least one of the brush control and the main power control are operable by the hand while the user uses the hand to direct the surface cleaning head.

19. The surface cleaning apparatus of claim 17 wherein the handle assembly comprises a handle and the at least one of the brush control and the main power control are positioned proximate the handle.

20. The surface cleaning apparatus of claim 17 wherein the handle assembly comprises a handle and the at least one of the brush control and the main power control are positioned on the handle.

21. The surface cleaning apparatus of claim 15 wherein the upper portion comprises a rigid airflow conduit having a lower end that is removably connectable in air flow communication and electrically connectable to the surface cleaning head, and the handle assembly is removably connectable in air flow communication and electrically connectable to an upper end of the rigid airflow conduit.

22. The surface cleaning apparatus of claim 15 further comprising a surface cleaning unit removably mounted to the support structure, the surface cleaning unit comprising the suction motor and the air treatment member.

* * * * *